US012638249B2

(12) United States Patent
Griffith et al.

(10) Patent No.: US 12,638,249 B2
(45) Date of Patent: May 26, 2026

(54) THERMAL STORAGE SYSTEM AND METHOD

(71) Applicant: Other Lab, LLC, San Francisco, CA (US)

(72) Inventors: Saul Thomas Griffith, San Francisco, CA (US); Brenton Piercy, San Francisco, CA (US); Hans von Clemm, Palo Alto, CA (US); Pushan Panda, San Francisco, CA (US); Joanne Huang, San Francisco, CA (US)

(73) Assignee: OTHER LAB, LLC, San Francisco, CA (US)

( * ) Notice: Subject to any disclaimer, the term of this patent is extended or adjusted under 35 U.S.C. 154(b) by 50 days.

(21) Appl. No.: 18/781,090

(22) Filed: Jul. 23, 2024

(65) Prior Publication Data

US 2024/0377143 A1 Nov. 14, 2024

Related U.S. Application Data

(63) Continuation of application No. 17/148,365, filed on Jan. 13, 2021, now abandoned.

(Continued)

(51) Int. Cl.

| | |
|---|---|
| ***F28D 20/00*** | (2006.01) |
| ***F24D 11/02*** | (2006.01) |
| ***F24F 5/00*** | (2006.01) |

(52) U.S. Cl.

CPC ..... *F28D 20/0034* (2013.01); *F24D 11/02* (2013.01); *F24F 5/0017* (2013.01);

(Continued)

(58) Field of Classification Search

CPC ..... F28D 20/0034; F28D 2020/0004; F28D 2020/0078; F28D 2020/0082; F24D 11/02;

(Continued)

(56) References Cited

U.S. PATENT DOCUMENTS

| | | | |
|---|---|---|---|
| 2,996,894 | A | 8/1961 | Shade |
| 3,801,727 | A | 4/1974 | Wilkinson |

(Continued)

FOREIGN PATENT DOCUMENTS

| | | | |
|---|---|---|---|
| EP | 1106935 | A2 | 6/2001 |
| GB | 2514553 | A | 12/2014 |

(Continued)

OTHER PUBLICATIONS

International Search Report and Written Opinion mailed Apr. 29, 2021, Patent Application No. PCT/US2021/013306, 9 pages.

(Continued)

*Primary Examiner* — Joel M Attey

(74) *Attorney, Agent, or Firm* — Davis Wright Tremaine LLP

(57) ABSTRACT

A thermal storage system that includes one or more thermal storage tanks having a tank body that defines a tank cavity configured to hold a tank thermal storage medium; a heat exchanger assembly disposed in the tank cavity configured to run a flow of working thermal storage medium through the one or more thermal storage tanks so that heat exchange occurs between the flow of working thermal storage medium and the tank thermal storage medium; one or more cables that extend to one or more rooms of the building; and one or more heat exchange elements disposed within the one or more rooms configured to receive a flow of the working thermal storage medium from the one or more cables so that heat exchange occurs between the flow of the working thermal storage medium and an environment of the one or more rooms of the building.

19 Claims, 46 Drawing Sheets

Related U.S. Application Data

(60) Provisional application No. 62/960,302, filed on Jan. 13, 2020.

(52) U.S. Cl.
CPC ..... *F24F 5/0046* (2013.01); *F24D 2200/12* (2013.01); *F24F 2005/0025* (2013.01); *F24F 2005/0064* (2013.01); *F28D 2020/0004* (2013.01); *F28D 2020/0078* (2013.01); *F28D 2020/0082* (2013.01)

(58) Field of Classification Search
CPC ... F24D 2200/12; F24F 5/0017; F24F 5/0046; F24F 2005/0025; F24F 2005/0064
See application file for complete search history.

(56) References Cited

U.S. PATENT DOCUMENTS

| | | | | |
|---|---|---|---|---|
| 3,921,708 | A | 11/1975 | Brenner | |
| 4,294,227 | A | 10/1981 | Kreibich | |
| 4,407,449 | A * | 10/1983 | Moser | F01M 5/001 122/26 |
| 5,941,238 | A | 8/1999 | Tracy | |
| 5,944,089 | A | 8/1999 | Roland | |
| 2001/0004009 | A1 | 6/2001 | MacKelvie | |
| 2003/0159804 | A1 | 8/2003 | Butler | |
| 2004/0251011 | A1 * | 12/2004 | Kudo | F28D 20/00 165/172 |
| 2009/0173336 | A1 | 7/2009 | Leifer et al. | |
| 2010/0043473 | A1 | 2/2010 | Koh | |
| 2010/0089080 | A1 | 4/2010 | Koh | |
| 2021/0180802 | A1 * | 6/2021 | Ukibune | F24F 11/84 |

FOREIGN PATENT DOCUMENTS

| | | | |
|---|---|---|---|
| JP | 2503659 | B2 | 6/1996 |
| JP | 2000291985 | A | 10/2000 |
| JP | 2004271003 | A | 9/2004 |
| RU | 2537661 | C1 | 1/2015 |
| SU | 348827 | A1 | 8/1972 |

OTHER PUBLICATIONS

Australia Patent Office First Examination Report dated Feb. 20, 2027, Application No. 2021208487, 4 pages.

* cited by examiner 130
650
1000
1000
620
610
650
1000
620
610

DETAIL B

THERMAL STORAGE SYSTEM AND METHOD

CROSS-REFERENCE TO RELATED APPLICATION

This application is a continuation of U.S. application Ser. No. 17/148,365, filed Jan. 13, 2021, entitled "THERMAL STORAGE SYSTEM AND METHOD,", which is a non-provisional of and claims the benefit of U.S. Provisional Application No. 62/960,302, filed Jan. 13, 2020, entitled "THERMAL STORAGE SYSTEM AND METHOD". These applications are hereby incorporated herein by reference in their entirety and for all purposes.

BACKGROUND

A part of decarbonizing American building stock can include a technology solution that enables heating and cooling without using hydrocarbons. Renewables (e.g., solar and wind energy) can provide carbon-free electricity, but because of their variability, they do not always provide electricity at the time that energy is needed to heat or cool a building. Both electric resistance heating and electric heat pumps can transform the electricity into heat, or thermal energy. Heat pumps can also turn electricity into cold fluids that can be used for cooling. This thermal energy (hot and cold) can then be dissipated to the home to be used in cooling, heating, and domestic hot water.

Many technologies exist to store energy. Much work has been done on electrochemical batteries to store energy from intermittent renewables for later use. Electrochemical batteries can have a limited cycle life and can be quite expensive.

Thermal storage typically falls under one of two categories: Latent or Sensible energy storage. Latent thermal energy storage leverages the latent heat and melting points of specific phase change materials (PCM) to store thermal energy in the energy required to convert a liquid to a gas, or a solid to a liquid. These systems can have favorable energy densities but require materials and technologies that are not readily available.

Sensible energy storage systems store energy as sensible heat between phase changes. Historically, this is seen in buildings with high concrete content. The concrete acts as a thermal mass to suck up excess thermal energy (from the sun or heating devices) and slowly release it to the home. Sensible thermal storage systems in use today experience drawbacks due to their size, costs, lack of reliability, and difficulty of install. Hydronic versions of these systems are designed to contain water kept at high pressures and temperatures, which requires heavyweight storage vessels, typically cylindrical and cumbersome, to transport and install.

Space heating, water heating, HVAC, and refrigeration loads in residential, commercial, and industrial buildings in the US consume upwards of 12% of primary energy requirements. Being able to shift a load that large by 12-72 hours by cost-effectively storing thermal energy can make balancing a renewables-heavy grid a much more tractable problem, but current systems are not able to effectively do this.

In light of the above, a need exists for an improved system and method for thermal storage in an effort to overcome the aforementioned obstacles and deficiencies of conventional thermal storage systems.

BRIEF DESCRIPTION OF THE DRAWINGS

FIG. 7 illustrates a cross-section and close-up view of a portion of the cross-section that illustrates a tank defined by a structural shell with an insulation cavity that can comprise foam insulation, air, a fluid, a vacuum, or the like.

FIG. 31 illustrates one embodiment of a thermal storage system that comprises a first and second tank, a heat exchange system, and a domestic water system.

Figure 1:
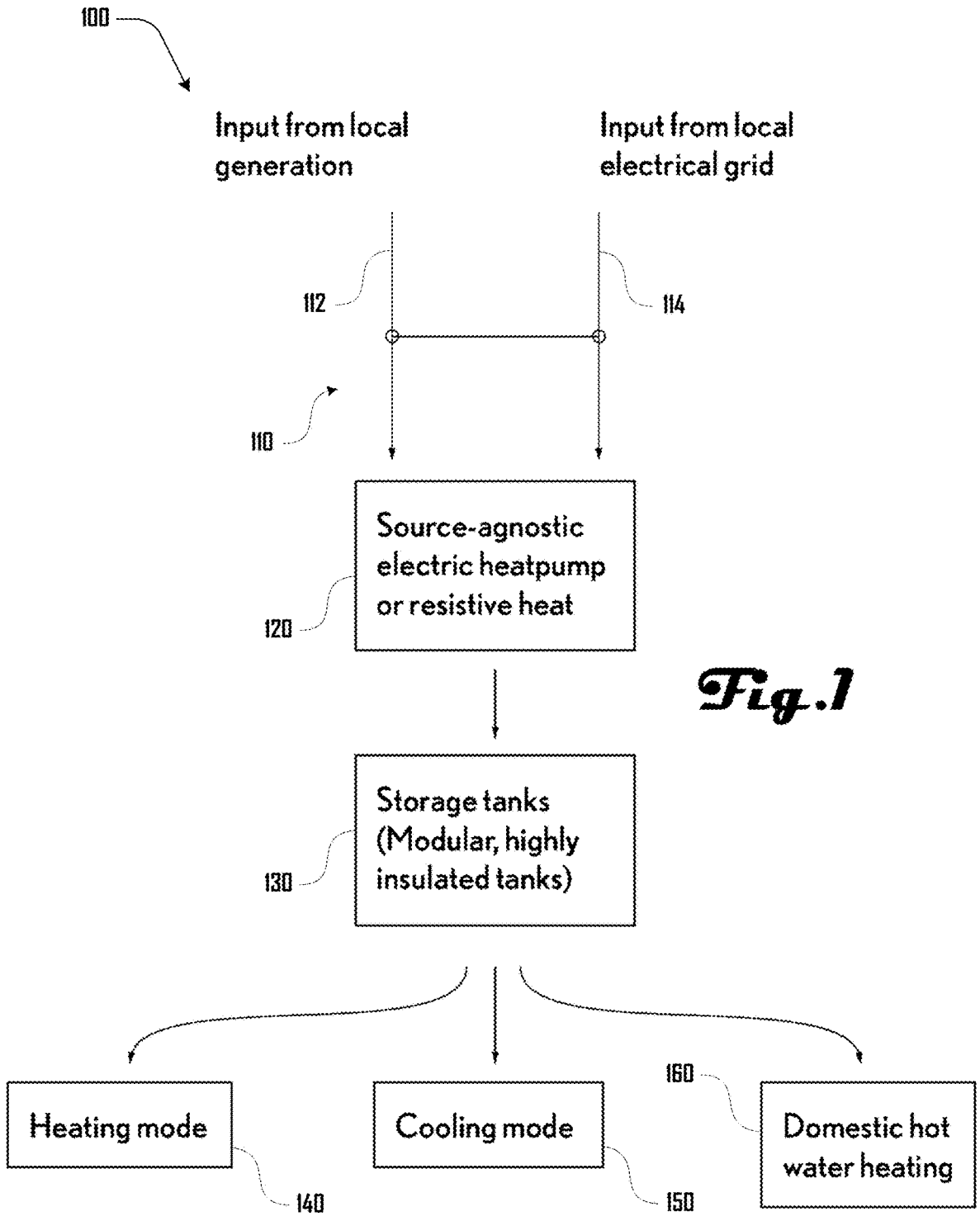
FIG. 1 is a block diagram of one example embodiment of a thermal storage system.

It should be noted that the figures are not drawn to scale and that elements of similar structures or functions are generally represented by like reference numerals for illustrative purposes throughout the figures. It also should be noted that the figures are only intended to facilitate the description of the preferred embodiments. The figures do not illustrate every aspect of the described embodiments and do not limit the scope of the present disclosure.

DETAILED DESCRIPTION OF THE PREFERRED EMBODIMENTS

An alternative to storing the incoming electricity in electrochemical batteries is to store the energy as a temperature differential (hot or cold) in a material storage medium. A simple example of such a material is water, which has a high heat capacity of about 4.2 kJ/K/kg. Because (for example) solar energy is typically available on a very predictable 24-hour cycle, converting solar energy at peak production times to thermal energy, and storing that energy for 4-24 hours can be a viable solution for dealing with the variability of zero-carbon sources of electricity.

Heat pumps can convert electricity to heat through a refrigerant compression cycle. Heat is drawn out of an already warm fluid (e.g., air or water, water-source or ground-source). The amount of electrical energy used to run the heat pump in various embodiments is typically much smaller than the amount of energy extracted from the fluid. This is grossly known as the "Coefficient of Performance" (COP). A COP of 3 indicates that 1 unit of (electrical) energy into the heat pump results in 3 units of (thermal) energy available. Heat pumps in some embodiments can be supplemented by a resistive heater that more directly generates heat as electricity is pushed through a resistor, heating the resistor. A resistive heating element of some embodiments has a "COP" of just below 1 (~0.98).

In various examples, water and other aqueous solutions can be low cost, completely non-toxic, and/or do not suffer lifetime or cycle issues in the same manner as electrochemical batteries. Therefore, storing heat in these solutions can be incredibly economical.

In some examples, electronic sensors and controls can be used to turn the entire system on and off, including managing when the heating elements send heat to the storage tanks, and when heat from the storage tanks is pumped into the building. Data can be collected from the building's historical energy use, room occupancy, temperature, humidity data, and the like. External data can also be collected from weather forecasts and historical data to intelligently determine the heating requirements of an upcoming time period. This data and information can be combined in algorithms that optimize the storage of energy. The optimization may include knowledge about other building systems or additional loads connected to the building, such as electric vehicles, and the like.

Additionally, in some embodiments, the system can have the ability to integrate with new and existing Distributed Energy Resource Management Systems (DERMS) and/or other software used by the electric power utilities for load balancing during peak times. In various examples, the system can store thermal energy and serve as a virtual battery to relieve excess demand on the utility grid with day-ahead pricing, weather, and demand forecast signals.

Various example embodiments outlined herein pertain to using components (e.g., a thermal storage medium, heat pumps, resistive heaters, insulated tanks, heat exchangers, air handlers, and AI-driven software) as not only methods of electrifying heat, but also as a giant potential battery commensurate in size with the challenge of balancing a grid that has high penetrations of variable load sources such as wind and solar energy, that will only continue to increase.

A thermal storage system, in one example embodiment 100 as shown in FIG. 1, can solve for three thermal loads: heating 140, cooling 150, and domestic hot water 160. As shown in FIG. 1, the example embodiment 100 comprises a switching system 110 that can receive electrical power from one or more local electrical power generation source (e.g., solar panels, wind turbine, or the like) via a local line 112 and receive electrical power from an electrical grid via a grid line 114. The switching system 110 can provide electrical power to various elements such as an electric heat pump 120 from the local line 112 and/or the grid line 114 based on various conditions.

For example, data from or regarding the electrical grid (e.g., pricing variability, generation source, planned load shift/demand response events, and the like) and weather predictions for solar generation (e.g., buildings with rooftop photovoltaics), can be obtained by a computer system associated with the switching system 110 and used by the computer system to determine whether to drive the heat pump 120 from local or grid electricity 112, 114. For example, a determination can be made by the computer system that obtaining power from the local source 112 will be at least a threshold amount for a period of time and sufficient to meet a predicted power need over that period of time, and the computer system can cause the switching system 110 to switch from the grid 114 to the local power source 112. A determination can then be made by the computer system that obtaining power from the local source 112 will not be at least a threshold amount for another period of time and sufficient to meet a predicted power need over that period of time, and the computer system can cause the switching system 110 to switch from the local power source 112 to the grid power source 114.

A source-agnostic heat pump 120 (e.g., ground-source, water-source, air-source, and the like) can heat a medium (e.g., a fluid) that is stored in modular, highly insulated tanks 130 as discussed in more detail herein. These tanks 130 can have temperature stratification in some examples to improve their efficiency. The modular design of some examples of the tanks 130 can enable such tanks 130 to fit in a wide variety of places as described in more detail herein (e.g., crawlspaces, basements, or other unusable space). Thermal energy stored by the tanks 130 via the medium can then be distributed into the home when needed (e.g., hydronic floor heating, forced air ducts, etc.) including heating 140, cooling 150, and domestic hot water 160 as shown in the example 100 of FIG. 1. The computer system can continue to calculate the optimal time and energy source to recharge the tanks 130 via the heat pump 120 so that thermal comfort of occupants or desired thermal levels are not below a desired threshold.

Thermal storage medium in one or more tanks 130 can be kept at a range of temperatures depending on whether hot and/or cold needs to be stored. For example, in some embodiments, hot storage can include tank thermal storage medium stored in a tank 130 within a range of 500 and 70° C., with further embodiments including storage within a range of 40°-80° C., 30°-90° C., 55°-65° C., or the like. In some embodiments, cold storage can include tank thermal storage medium stored in a tank 130 either at or below 0° C., with further embodiments including storage within a range of 0° to 15° C., 0° to 10° C., 0° to 5° C., −10° to 15° C., −5° to 10° C., −5° to 5° C. or the like. In various embodiments, one or more tank 130 can be configured for hot or cold thermal storage medium storage. Accordingly, some embodiments can include a plurality of tanks 130 with a first set of the plurality of tanks configured for hot thermal medium storage and a second set of the plurality of tanks configured for cold thermal medium storage.

Figure 2:
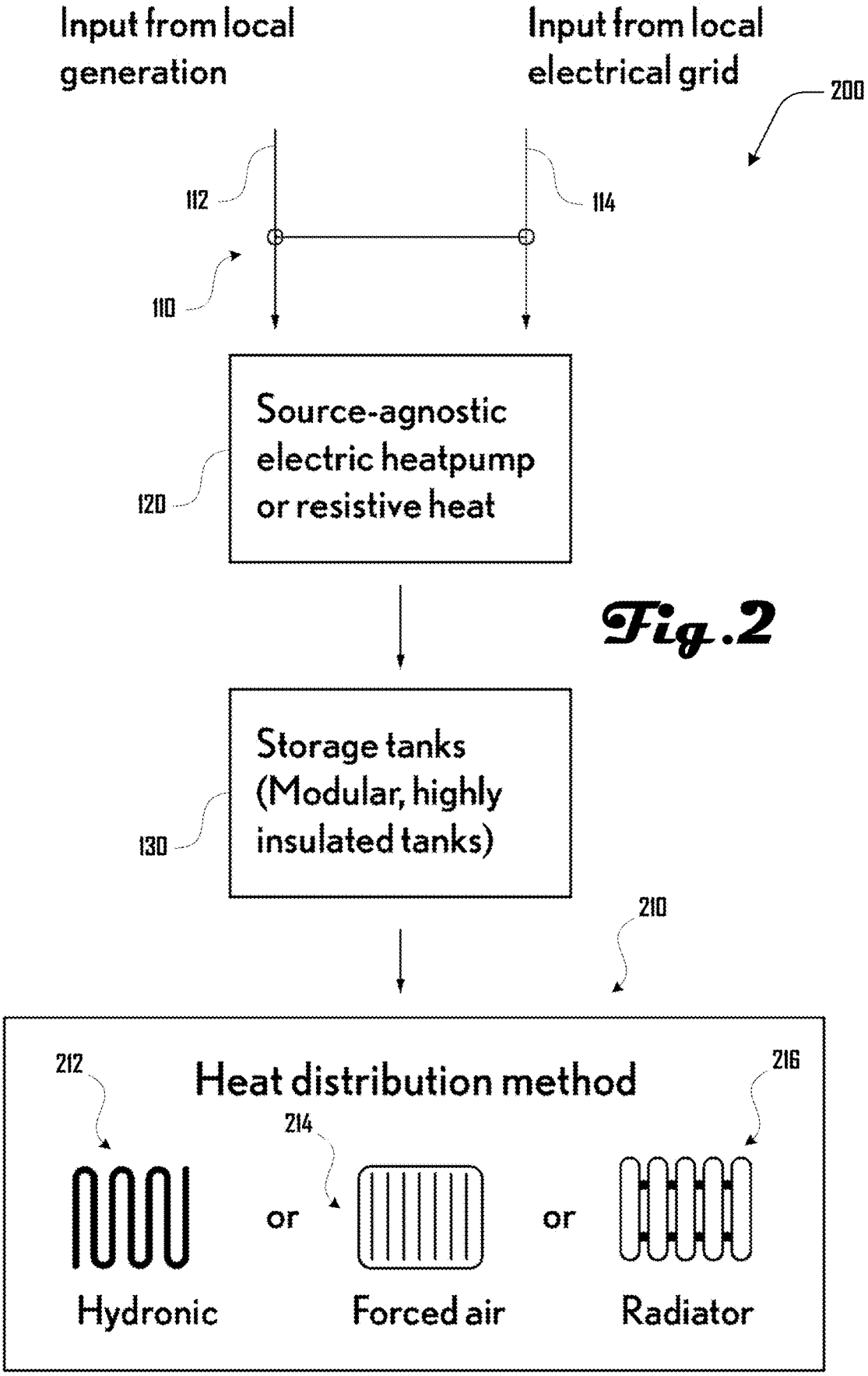
FIG. 2 is a block diagram of another example embodiment of a thermal storage system with one or more of hydronic, forced air and radiator as a heat distribution method.

The heating mode 140 in various examples can draw a hot medium from the storage tanks and distribute the hot medium throughout a building to heat the building in various suitable ways. For example, FIG. 2 illustrates another example embodiment 200 where hot medium can be distributed via a heat distribution method 201 including one or more of hydronic heating 212, forced air heating 214 and/or radiator heating 216. A thermal storage system in various embodiments can be designed for both new construction and retrofit of existing buildings by working with a variety of systems such as: hydronic floor heating, forced air duct (e.g., with a heat exchanger), and/or radiators. In various examples, the heat medium can stay within a closed loop and can use heat exchangers depending on the building's specific heat distribution method(s).

Figure 3:
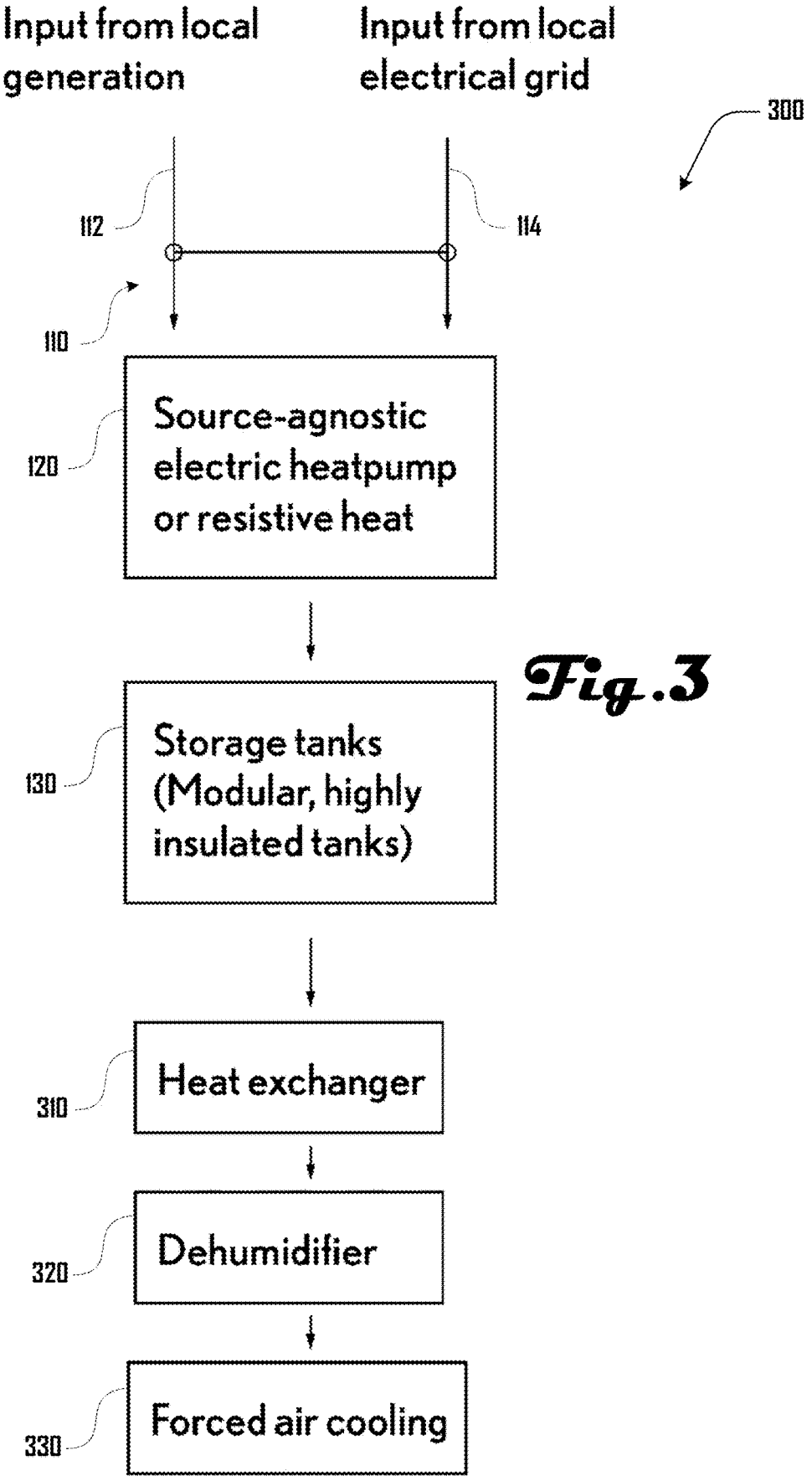
FIG. 3 is a block diagram of a further example embodiment of a thermal storage system with a heat exchanger, dehumidifier and forced air cooling.

A thermal storage system can work to cool a building's space in some embodiments. In many places, air conditioning is a high portion of summer electricity load and a focus of utility programs due to the strain this causes on the electrical grid. In the case of cooling, in some embodiments such as the example 300 of FIG. 3, cold medium, stored in the insulated tanks 130 can enter a heat exchanger 310 where incoming ambient air can then be cooled, dehumidified via a dehumidifier 320, and then distributed through the building such as via forced air cooling 330.

Figure 4:
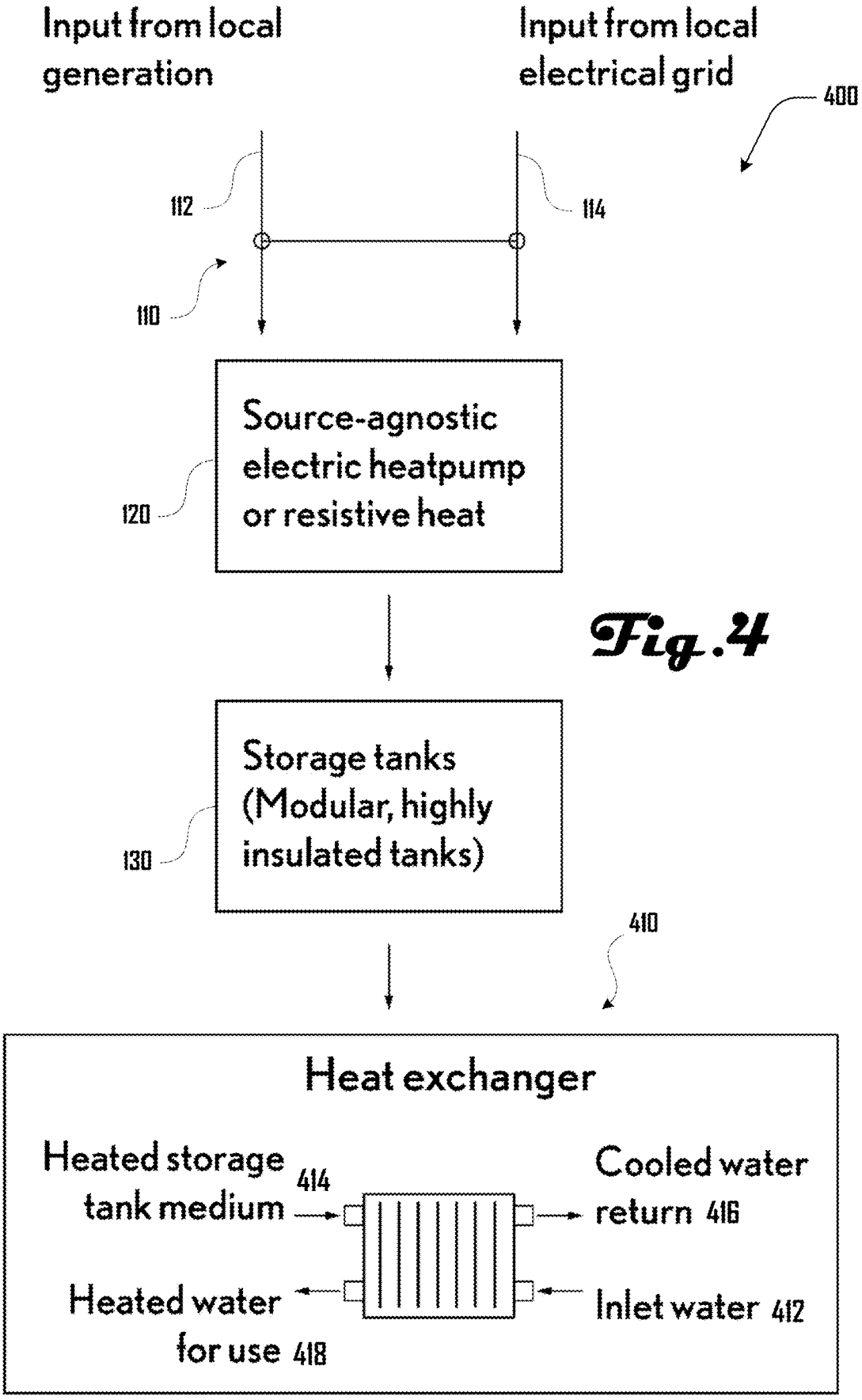
FIG. 4 is a block diagram of yet another example embodiment of a thermal storage system illustrating example elements of a heat exchanger of the system.

In some embodiments, such as the example 400 of FIG. 4, a thermal storage system can heat water for the home by using the storage medium from the storage tank(s) 130 and a heat exchanger 410 to heat inlet water 412. For example, inlet water 412 can be introduced to the heat exchanger 410 along with heated storage tank medium 414 and heat exchange between the inlet water 412 and heated storage tank medium 414 can generate cooled storage tank medium 416 that exits the heat exchanger 410 and can heat the inlet waster 412 to generate heated water 418. Some embodiments can include a resistive element to heat inlet water 412 as a backup method. In various embodiments, a computing device of the thermal storage system can use data (e.g., user's setting, usage patterns, weather, visitors, etc.) to predict and balance usage of storage medium between these modes.

In various embodiments, a computing system associated with a thermal storage system can aggregate and analyze building-specific (e.g., occupancy sensors, calendar, historical usage, and the like) and external (e.g., local weather prediction, grid signals, and the like) data to determine: necessary storage for future home thermal needs (e.g., when to drive the heat pump 120 and for how long for a calculated, predictive amount of storage needed) and thermal distribution (e.g., when to distribute heating, cooling, and domestic hot water to the building).

In various examples, a thermal distribution profile can continue to feed back into the thermal storage system, to continuously calculate and optimize for both savings (e.g., energy, money, carbon, and the like) and the user's thermal comfort. In some embodiments, integrated data across multiple systems can enable alerts of anomalous building envelope behavior (e.g., leaking window or roof) that could tell the building owner in advance of issues. One embodiment can integrate grid responsiveness to store energy ahead of a peak utility event, to effectively shift load with no compromise to the user's experience.

Figure 5:
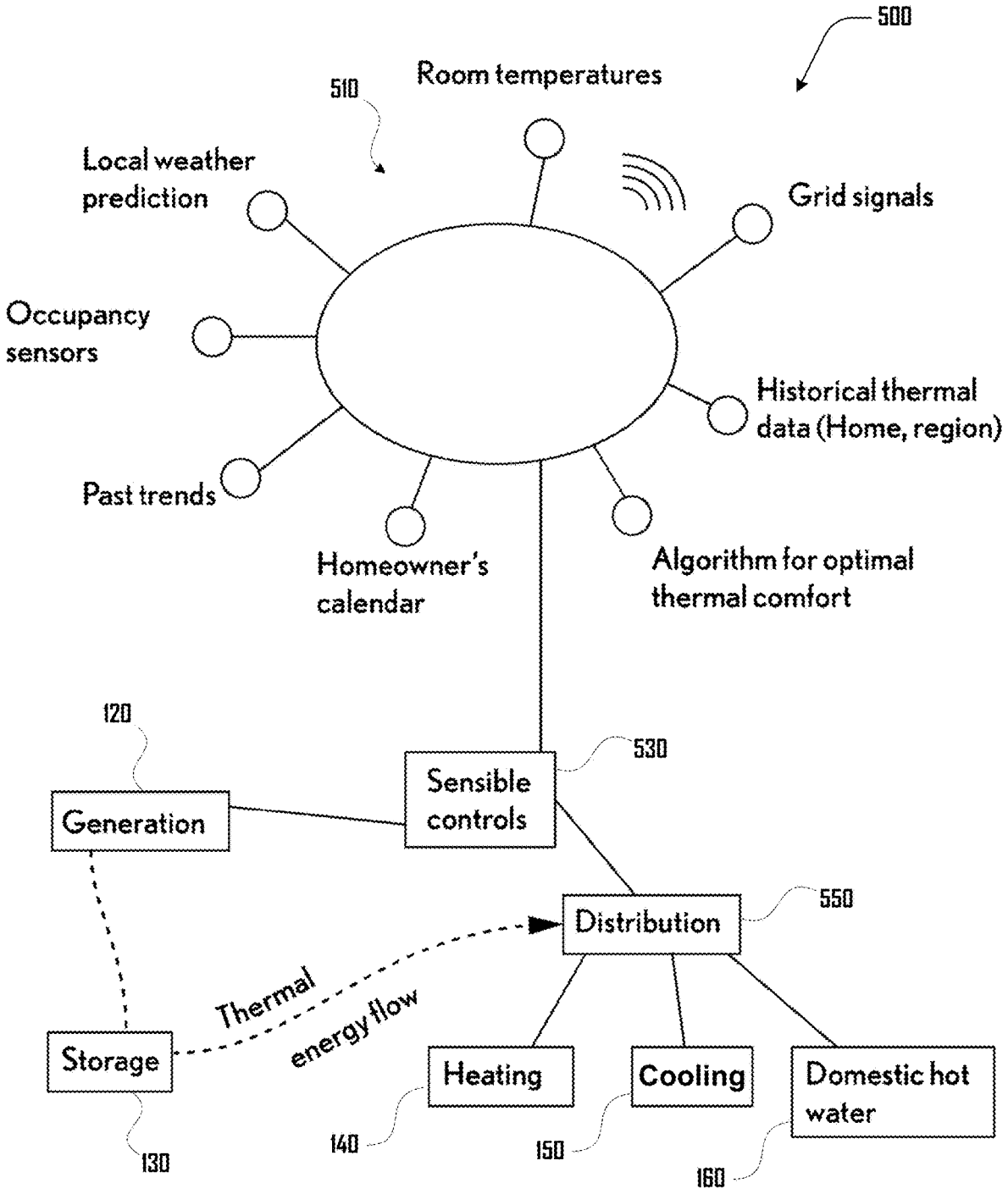
FIG. 5 illustrates another example embodiment of a thermal storage system that comprises a computer system that is operably connected to sensible controls.

For example, FIG. 5 illustrates an example embodiment 500 of a thermal storage system that comprises a computer system 510 that is operably connected to sensible controls 530. The sensible controls 530 can be configured to control a thermal generation system 120 (e.g., one or more heat pump) and a thermal storage medium distribution system 550, which can be configured to distribute a thermal storage medium from storage 130 (e.g., one or more tanks) to systems such as heating 140, cooling 150, and domestic hot water 160.

The computer system 510 can comprise various suitable local and/or remote devices such as an embedded computer system, laptop computer, tablet computer, smartphone, home automation system, entertainment system, and the like. Additionally, a local device can be operably connected to various remote devices (e.g., a server) via a wired and/or wireless network, which can comprise Wi-Fi, Bluetooth, the Internet, a Local Area Network (LAN), a Wide Area Network (WAN), or the like. Such devices can comprise a processor and a memory that stores software, that when executed allows the thermal storage system to perform various methods including some or all of the methods described herein. In some embodiments, such software can be embodied in, generated by, and/or receive data from a machine learning system, artificial intelligence system, neural network, or the like.

The computer system 510 can comprise various suitable sensors such as a room temperature sensor, occupancy sensor, humidity sensor, barometric pressure sensor, wind speed sensor, and the like. The computer system 510 can obtain data from various sources, including local or remote devices or sensors including from the sensible controls 530 or other portion of the thermal storage system either directly or via the sensible controls 530. For example, such data can include the temperature of one or more room in a building; temperature exterior to the building; weather prediction associated with the building location; occupancy sensor data; historical data or trends associated with the thermal storage system, building, or local environment; a homeowner's calendar (e.g., identifying a sleep, wake, home and away schedule); an optimal thermal comfort algorithm; electric grid data; time; sun position data; thermal storage system state data; temperature of thermal storage medium in one or more tanks 130; medium flow rate; and the like.

Some limitations have kept thermal storage technologies from progressing and becoming commonplace. For example, deficiencies of some systems can include the large amount of space they take up, low R values, weight, and costs associated with manufacturing and installation. While some storage tanks 130 can be made of stainless steel or other metals, with glass liners to prevent corrosion, in some examples such a tank 130 may be undesirable for some applications because such a construction can make them expensive to manufacture and undesirable for space efficiency in some use cases. Additionally, while some storage tanks 130 may have thin sections of insulation, such a configuration can be undesirable in some examples and can result in low R-values and undesirable standby losses for some applications. Various embodiments discussed herein can address such issues.

Some embodiments of a thermal storage system can comprise one or more thermal storage tanks 130 that are cubical or cuboid in shape (which can make such a tank 130 more space efficient); made of lightweight plastics adhered to insulative foams; and easy to install. Use of inexpensive plastic can reduce manufacturing costs, which can be desirable. Various embodiments include one or more tanks 130 defined by a sealed tub that can be used for residential and/or commercial thermal storage. In some embodiments tanks 130 can be configured for storage of non-pressurized aqueous solutions kept in the liquid phase.

Figure 6:
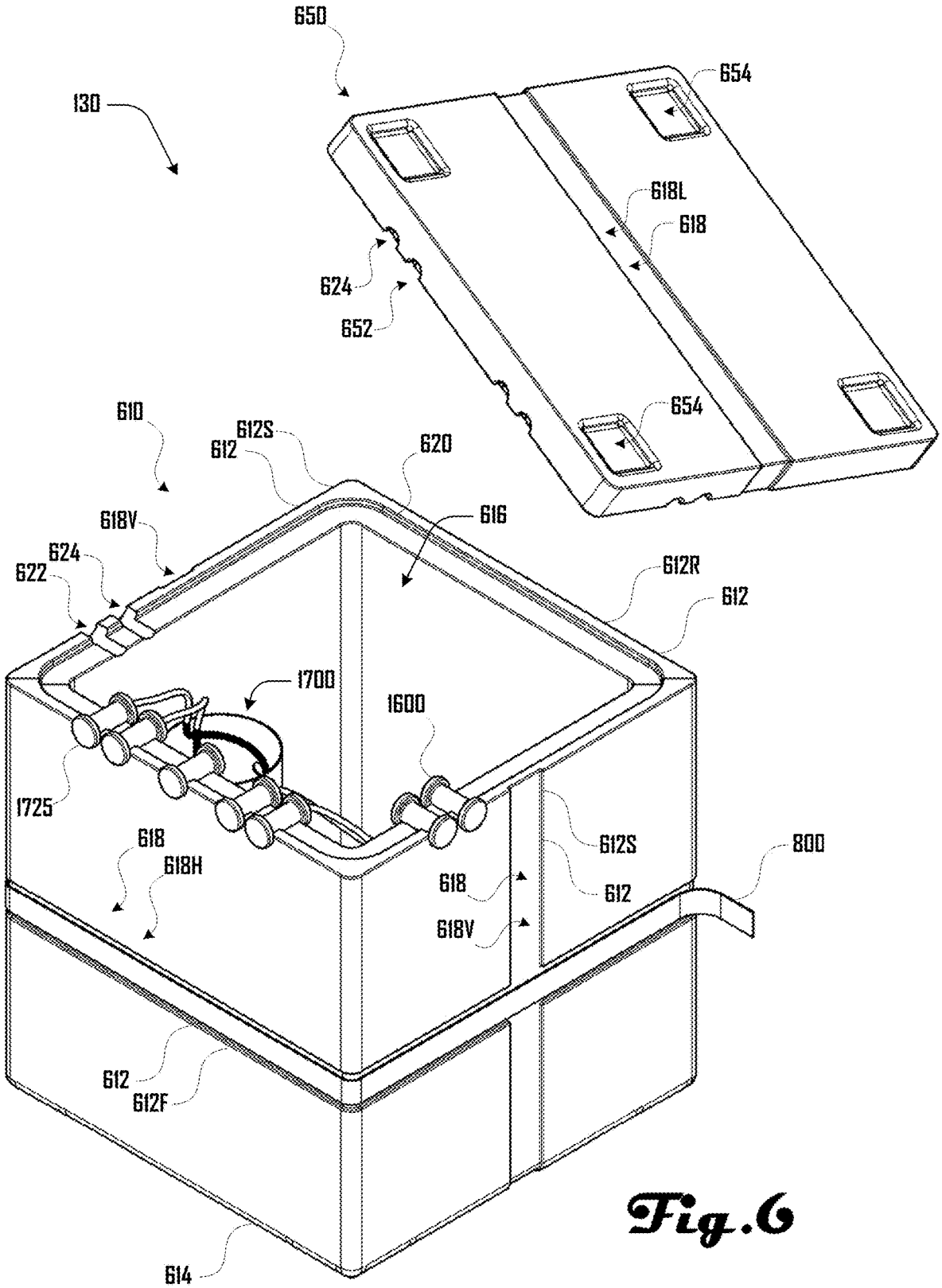
FIG. 6 illustrates an example embodiment of a thermal storage tank including a tank body and lid.

FIG. 6 illustrates an example embodiment of a tank 130 that comprises a tank body 610 that includes four sidewalls 612 and a base 614, which defines a tank cavity 616 that is configured to hold a thermal storage medium (e.g., a liquid) as discussed herein.

One or more faces of the sidewalls 612 can define one or more slots 618. For example, the embodiment shown in FIG. 6 includes a horizontal slot 618H that extends around and is defined by a front sidewall 612F and a pair of opposing side sidewalls 612S. The opposing side sidewalls 612S can also comprise a vertical slot 618V. Slots 612 can be absent from a rear sidewall 612R that opposes the front sidewall 612F. As discussed in more detail herein, the slots 618 can be configured for securing a plurality of tanks 130 together and/or for securing one or more tanks 130 to other elements or structures such as a wall or building element.

The sidewalls 612 can extend to and define a rim 620 that can define one or more gaps 622 that define a portion of a port 624, which can provide for various forms of interfacing with a thermal storage medium contained within the tank 130 as discussed in more detail herein. The tank 130 can further comprise a lid 650, which can be configured to be coupled on the rim 620 of the tank body 610 to enclose the tank cavity 616. Edges of the lid can define one or more notches 652 that define a portion of ports 624. For example, a plurality of corresponding notches 652 and gaps 622 on the lid 650 and tank body 610 can respectively define a plurality of ports 624 when the lid 650 is coupled with the rim 620 of the tank body 610, which as discussed in more detail herein can allow for elements to extend between the exterior of the tank 130 and the cavity 616 of the tank 130 to interface with a thermal medium stored within the cavity 616 of the tank 130.

A top and one or more sides of the lid 650 can define one or more slots 618. For example, as shown in the embodiment of FIG. 6, a lid slot 618L can be defined by the top and opposing sides of the lid 650 and correspond with the vertical slots 618V of the tank body 610. As discussed in more detail herein, the lid slot 618L and vertical slots 618V can be configured to couple a plurality of tanks 130 together and/or to couple one or more lids 650 to one or more respective tank bodies 610. The top face of the lid 650 can further define a plurality of divots 654 that can be configured to couple with corresponding feet (not shown) on the base 614 of another tank 130 that may be stacked on the first tank 130 as discussed in more detail herein.

Figure 7:
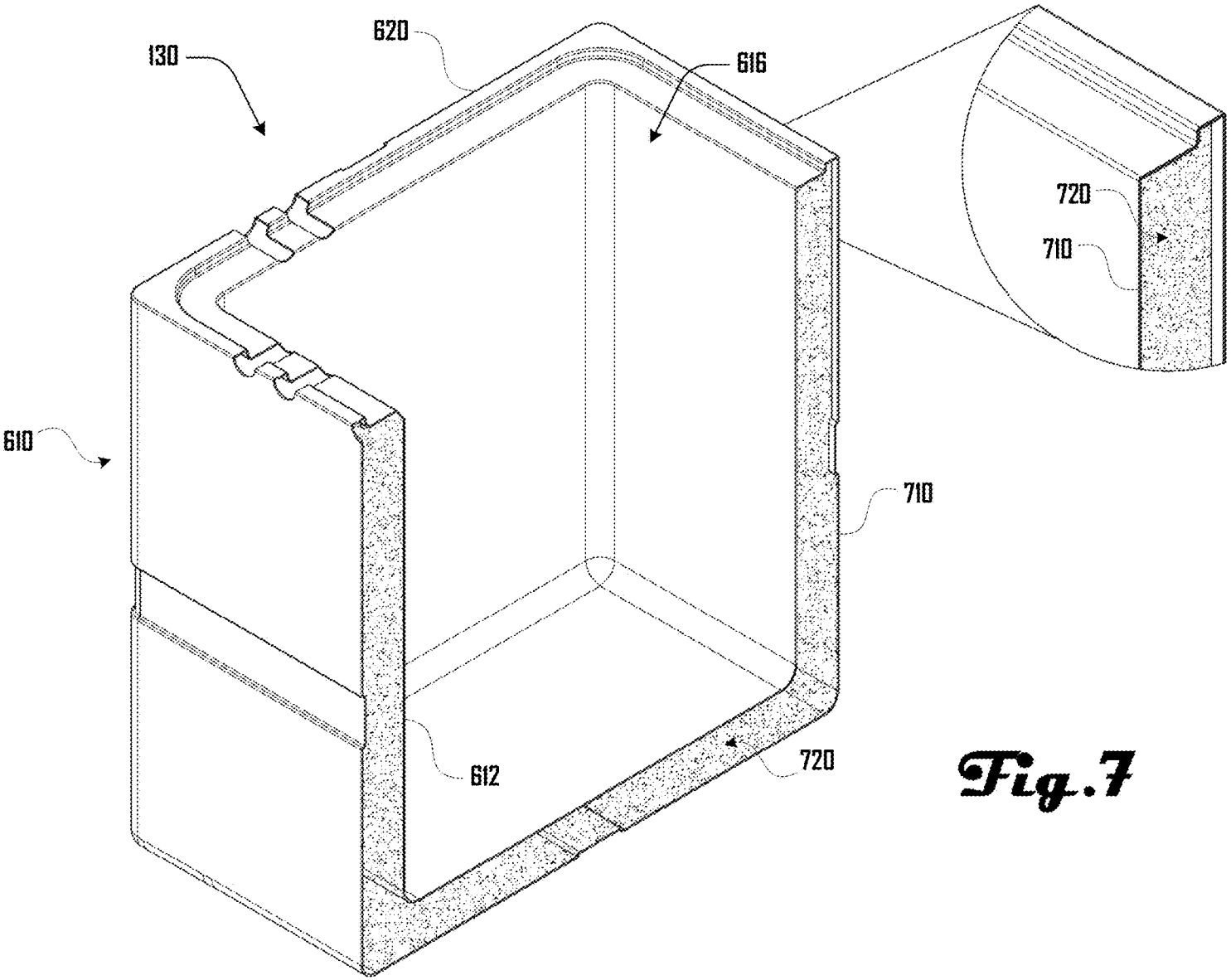

In some embodiments, tanks 130 can be made from a sandwich profile of foam insulation (e.g., polyurethane, polystyrene, etc.) sandwiched between structural walls made of plastic (e.g., polyurea, HDPE, and the like), or in some embodiments, a metal that can withstand higher temperatures and pressures. A rigid foam can provide structure and insulation to the tank 130, and a plastic shell can provide tensile strength to hold aspects together. FIG. 7 illustrates a cross-section and close-up view of a portion of the cross-section that illustrates a tank 130 defined by a structural shell 710 with an insulation cavity 720 that can comprise foam insulation, air, a fluid, a vacuum, or the like.

Figure 8B:
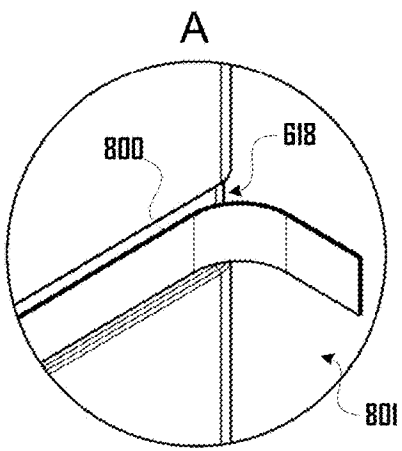
FIG. 8*a* illustrates an example embodiment of a tank where a strap is being used to secure the tank to a wall and FIG. 8*b* illustrates a close-up view of the strap being used to secure the tank to a wall as shown in a portion of FIG. 8*a*.
Figure 8A:
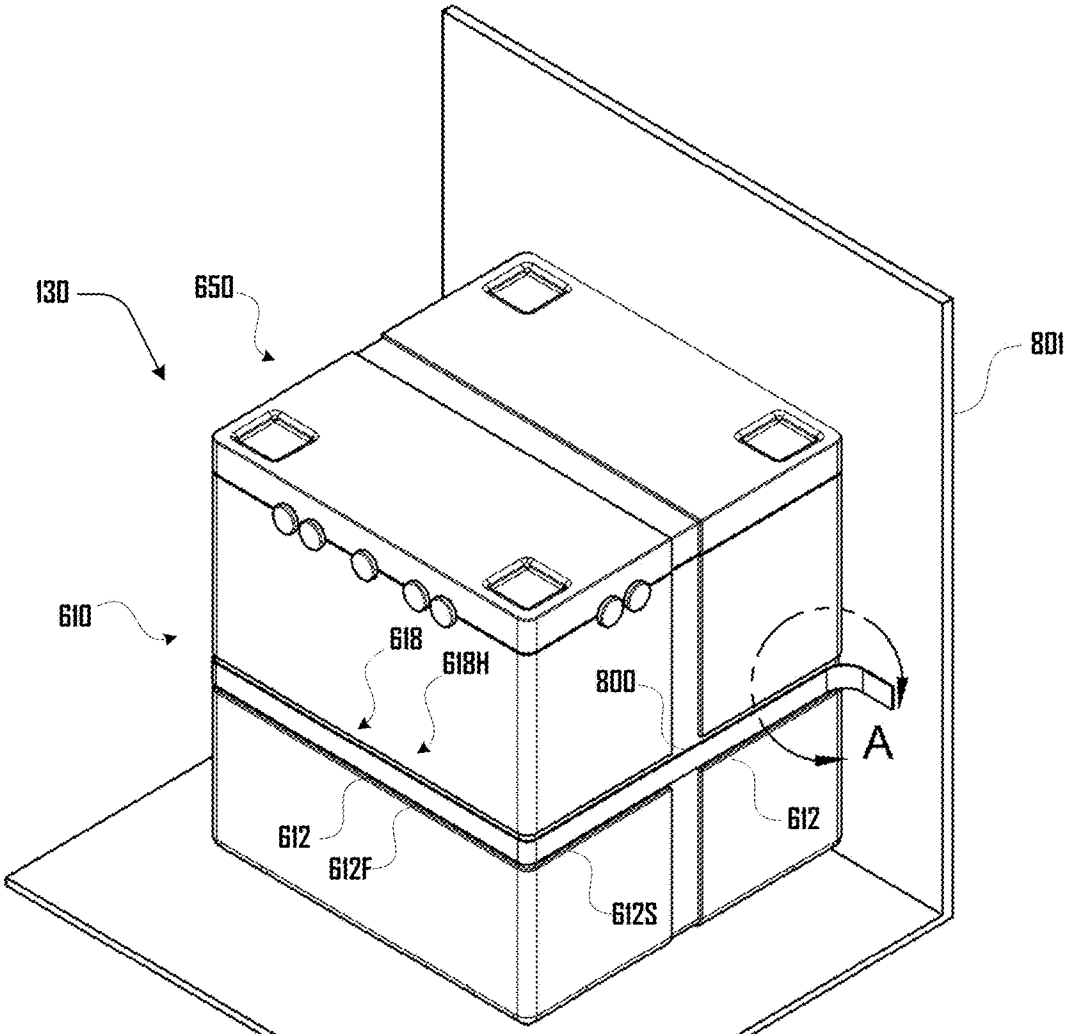

To secure tanks to nearby features (e.g., walls, fence, shed, or the like), embodiments of the tanks 130 can have one or more slots 618 to rout a strap 800 (e.g., stainless, fabric, or the like). For example, FIGS. 8*a* and 8*b* illustrate an example embodiment of a tank 130 where a strap 800 is being used to secure the tank 130 to a wall 801. The tank body 810 includes a horizontal slot 618H that extends around and is defined by the front sidewall 612F and the pair of opposing side sidewalls 612S, with the strap running in the horizontal slot 618H and being coupled to the wall 801 proximate to the respective side sidewalls 612S (note that only one side of the strap coupled to the wall 801 is shown as the second side is obscured in the example illustration). The strap 800 can be disposed in the horizontal slot 618H such that the strap 800 does not extend past the plane of the sidewalls 612, which can be desirable because such a configuration can allow further tanks to be positioned directly adjacent to and engaging each other without being impeded by the strap 800.

While examples of a rectangular horizontal slot 618 and a planar rectangular strap 800 are shown in various example embodiments, further embodiments can include various other suitable coupling elements such as a rope, bungie cord, wire or the like. Additionally, in further embodiments, such coupling elements can be absent or present in any suitable plurality. Also, the strap 800 can be coupled to a wall 801 or other structure in various suitable ways. In various embodiments, a durable and long-lasting strap that does not react with the material(s) of the tank 130 can be desirable.

Figure 9:
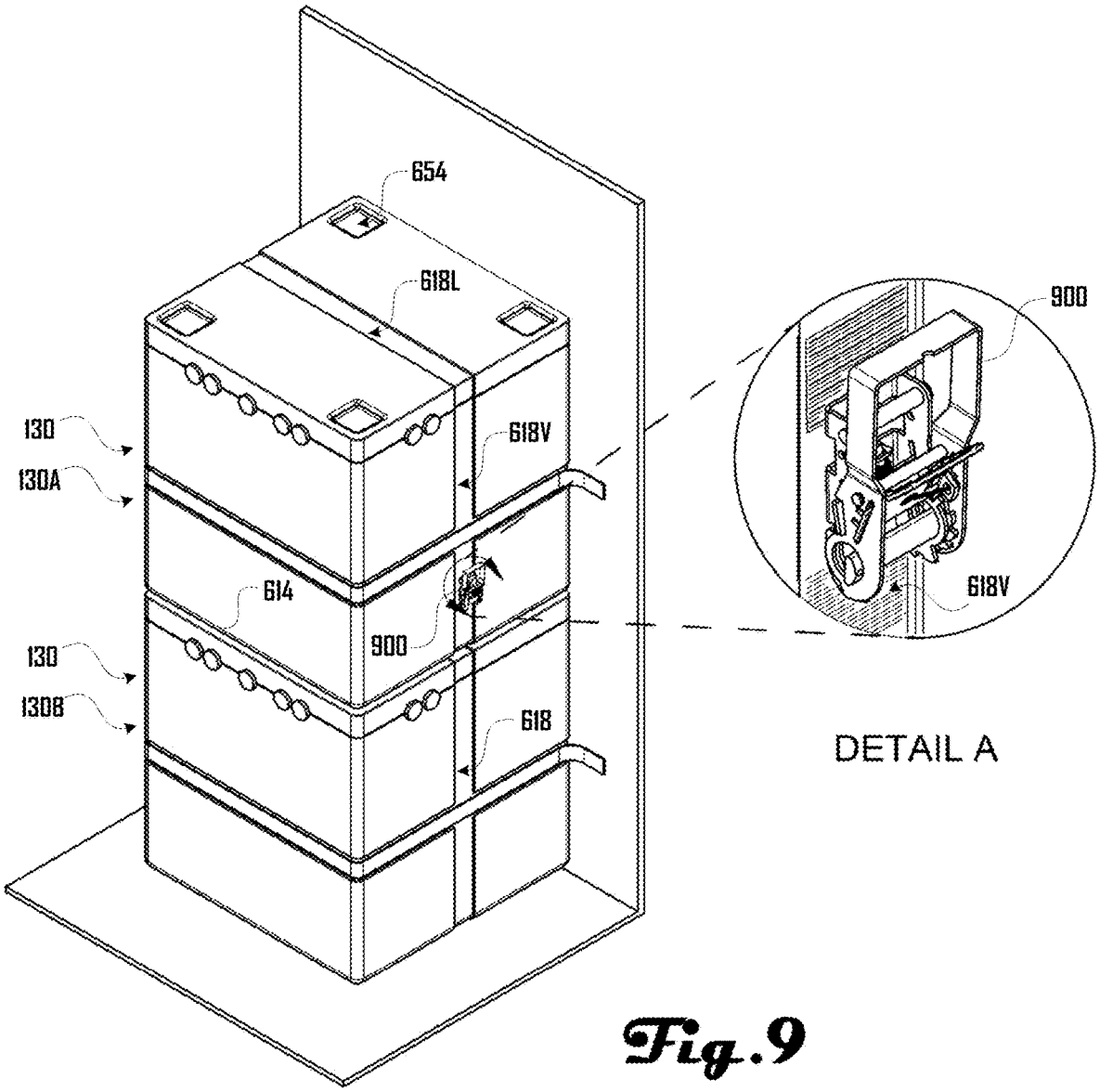
FIG. 9 illustrates a first tank stacked on a second tank including a ratchet assembly that can be configured to secure a strap around the tanks.

Attaching tanks 130 one to another can be desirable for safety and structure, as well as ensuring that members do not shift about and ensuring that a gasket between the tank body 610 and lid 650 provides a tight seal. In various embodiments, tanks 130 may stack and/or nest into one another. In some embodiments a latch-like mechanism, ratcheting straps, or the like can be used to couple a plurality of tanks 130 together and/or to couple one or more lids 650 to a respective tank body 610. For example, FIG. 9 illustrates a first tank 130A stacked on a second tank 130B including a ratchet assembly 900 which can be configured to secure a strap around the tanks 130. For example, a strap can run in the vertical slots 618V and lid slot 618L of the first tank 130A with the ratchet assembly 900 configured to tighten and hold the strap to secure the tanks 130 together. The top face of the lid 650 of second tank 130B can define a plurality of divots 654 (as shown on the lid 650 of the first tank 130A) that can be configured to couple with corresponding feet (not shown) on the base 614 of the first tank 130A, which can secure and orient the first and second tanks 130A, 130B together.

Figures 10A, 10B:
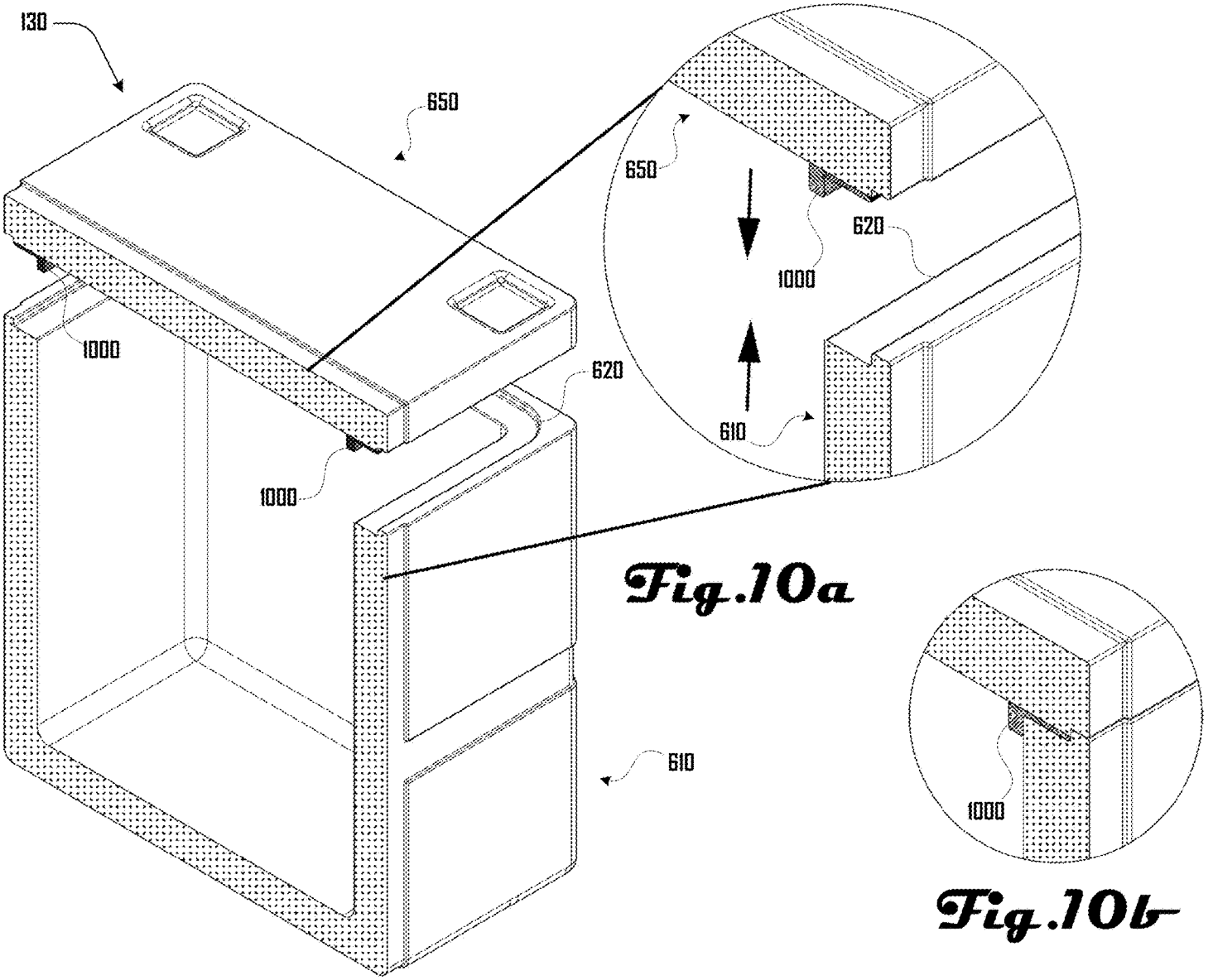
FIG. 10*a* illustrate a cross-section perspective view and close-up view of a gasket material around the rim of a tank and FIG. 10*b* illustrates a close-up view of the lid coupled to the tank body including the gasket material.

To generate a seal between the lid 650 and the tank body 610 (e.g., to minimize humidity escaping the tank 130 and standby losses), a gasket material 1000 can be installed around the rim 620 of the tank 130 as shown in the example of FIGS. 10*a* and 10*b*. In various embodiments, the force exerted by a latching mechanism, weight of the lid 650, weight of one or more tanks 130 stacked on the lid 650, friction fit, or the like, can create a sufficient seal to contain the contents of the thermal storage tank 130.

Figure 11A:
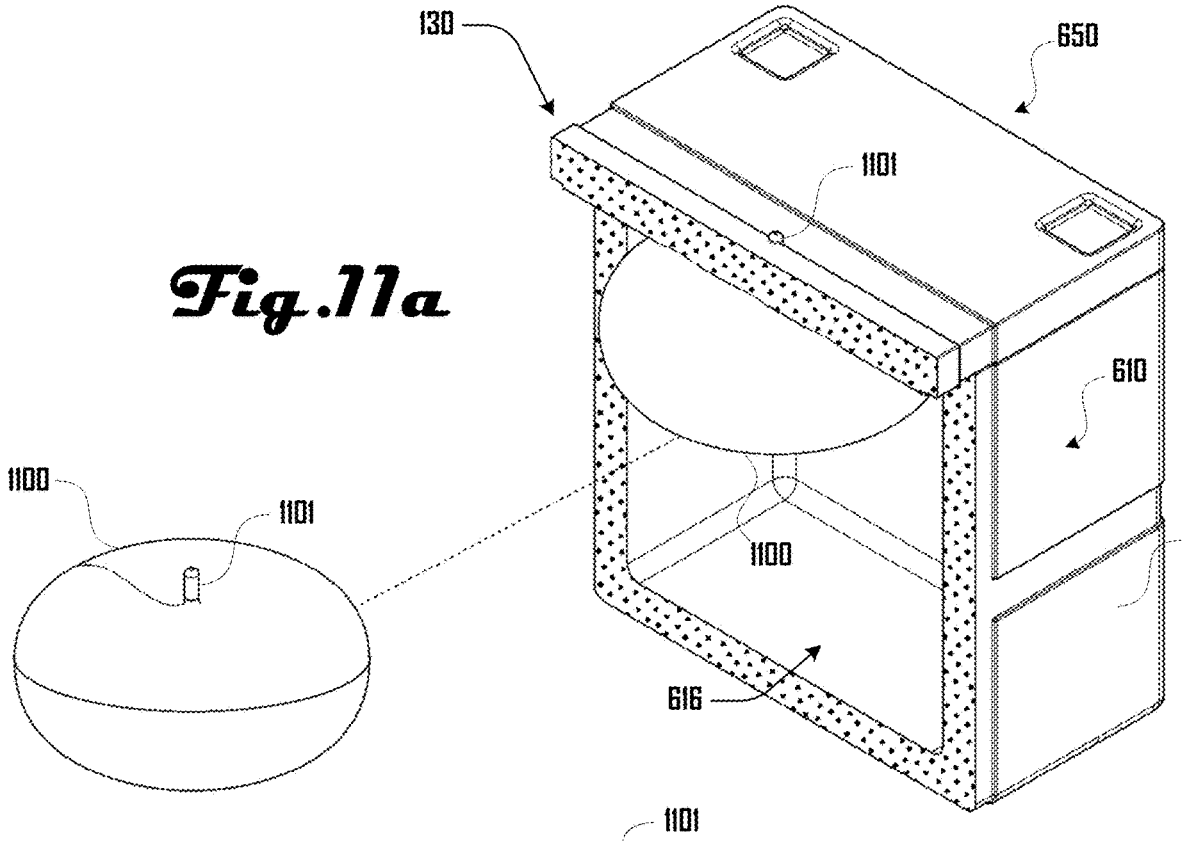
FIG. 11*a* is a perspective cross-sectional view of a tank comprising bladder, including a breakout perspective view of the bladder
Figure 11B:
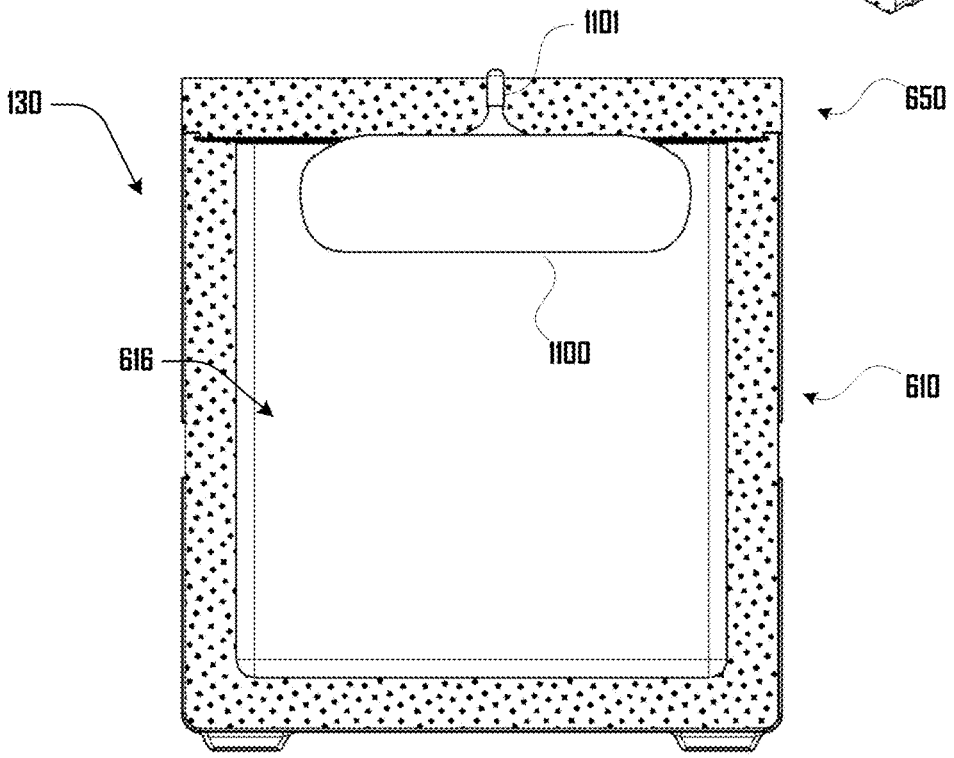
FIG. 11*b* is a cross-sectional side view of the tank and bladder of FIG. 11*a*.

To compensate for thermal expansion of the liquids contained, some embodiments can comprise a compliant bladder 1100 in the lid 650 of the tank 310 as shown in the example of FIGS. 11*a* and 11*b*, and the bladder 1100 can be pressurized to the same pressure of the contents within the cavity 616 of the tank 130. In various examples, the bladder 1100 can expand and contract depending on the volume of liquid enclosed in the cavity 616 of the tank 130. For example, a pressure sensor can be disposed within the cavity 616 of the tank 130 to determine a pressure within the cavity 616, and the bladder 1100 can be automatically inflated and deflated to correspond to the determined pressure within the cavity 616. In various embodiments, the bladder 1100 can comprise a stem 1101 that can extend through the lid 650, which can allow fluid to be introduced and removed from the bladder 1100.

Figure 12A:
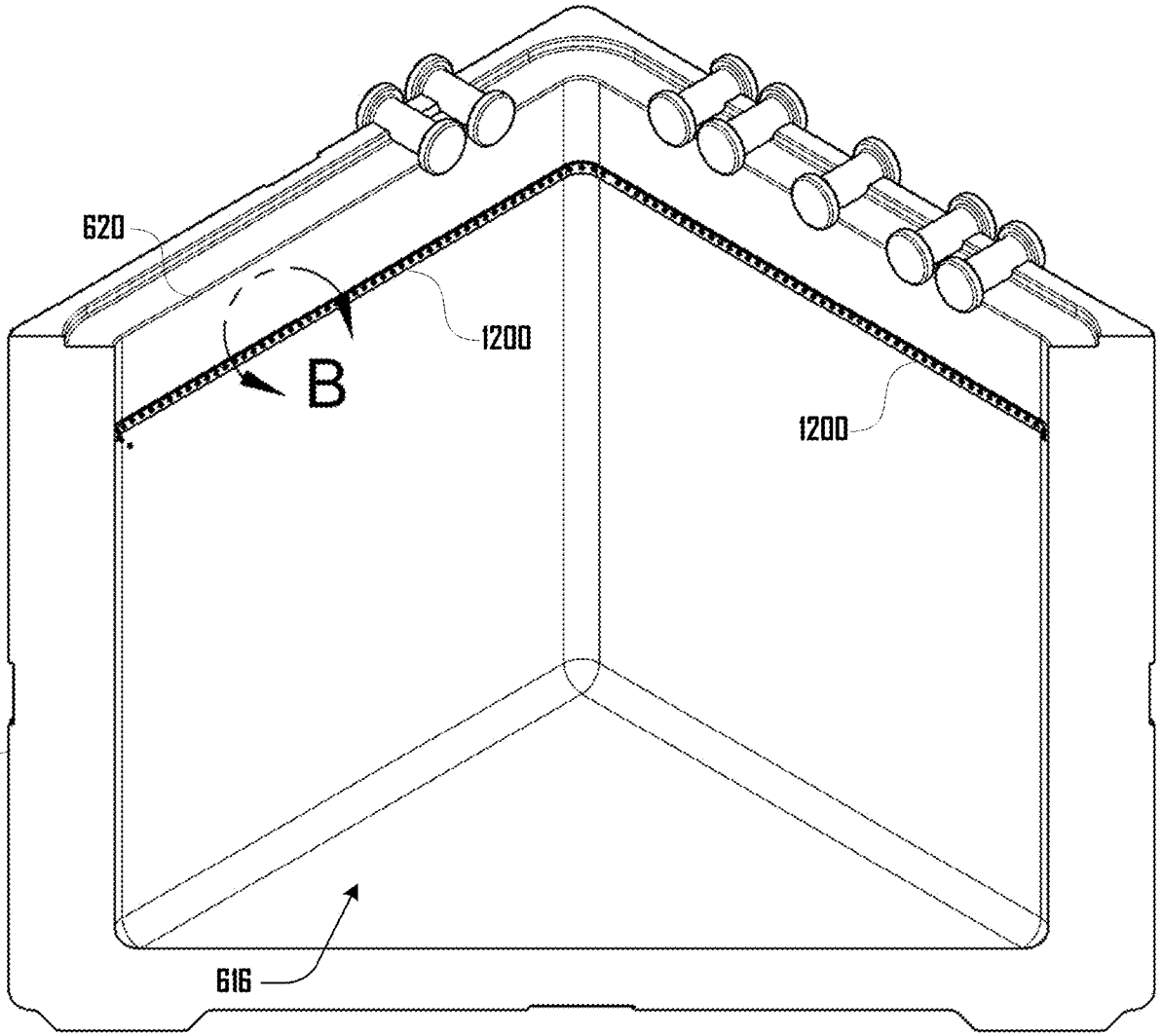
FIG. 12*a* illustrates an example embodiment of a tank comprising UV lights within the cavity of the tank body and FIG. 12*b* illustrates a close-up detail view of a portion of the UV lights of FIG. 12*a*.
Figure 12B:
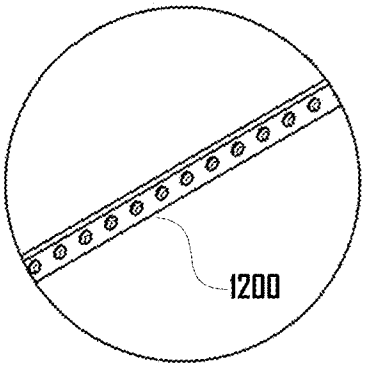

Some embodiments of the tank 130, such as the example of FIGS. 12*a* and 12*b* can include UV LED lights 1200 within the cavity 616 of the tank body 610 (e.g., around the inside of the sidewalls 612 within the cavity 616 proximate to the rim 650; positioned to be submerged in a thermal storage medium liquid disposed in the cavity 612; disposed on or in the lid 650, or the like). These lights 1200 can be programmed in some examples to turn on and off periodically to combat bacterial growth inside the tank 130. In various examples, due to the constantly changing temperature of the tank 130, the storage medium liquid may experience sufficient mixing by convection.

In various embodiments, any suitable plurality of tanks 130 can be stacked and/or positioned adjacent to each other modularly and plumbed in series or parallel to expand the total volume of storage while fitting through doorways and filling unused space. In some embodiments, the tanks 130 can be placed directly next to one another with plumbing hidden on the sides of the tanks 130.

Figure 13:
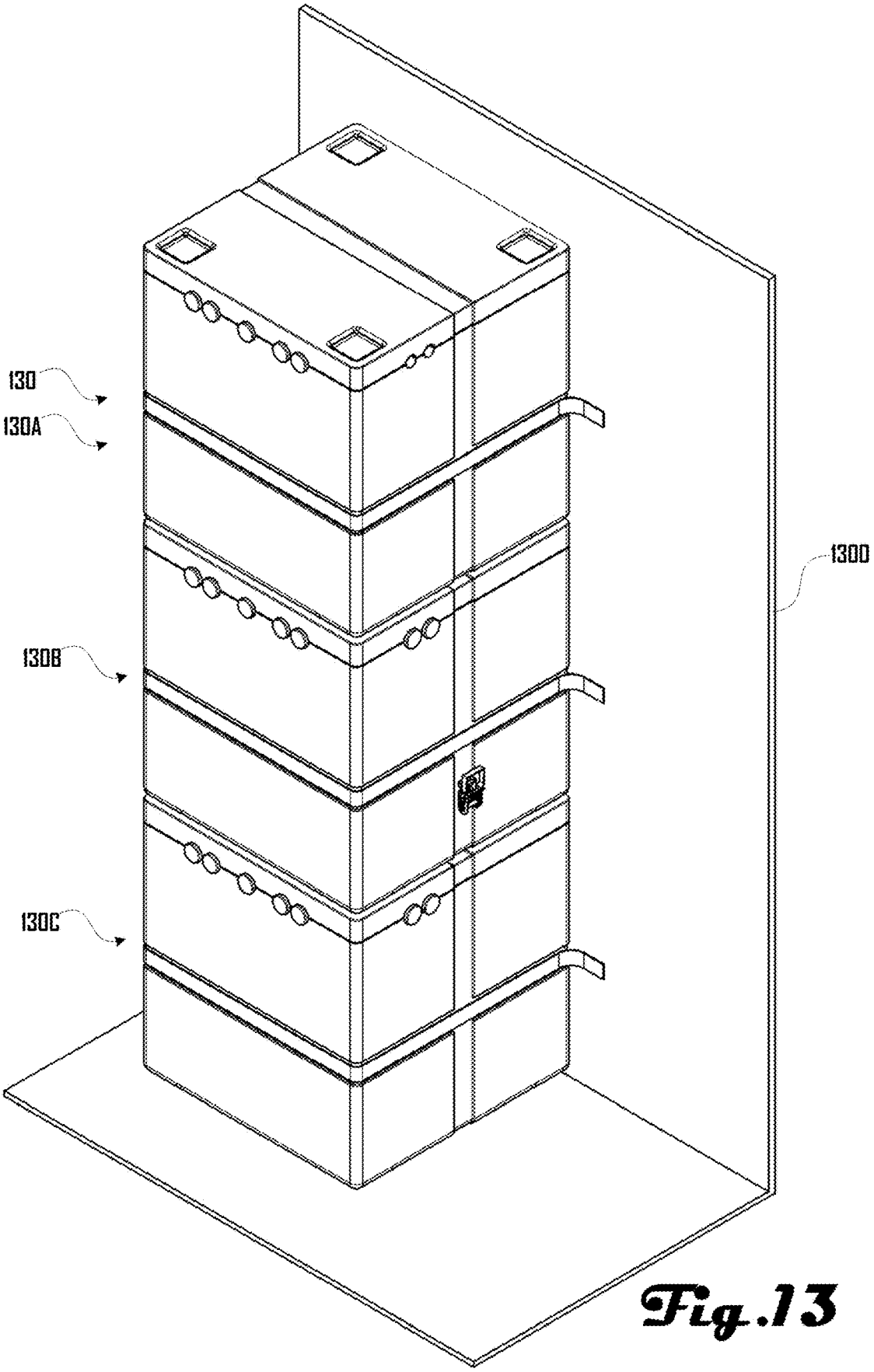
FIG. 13 illustrates an example of three tanks stacked on top of each other against a wall.
Figure 14:
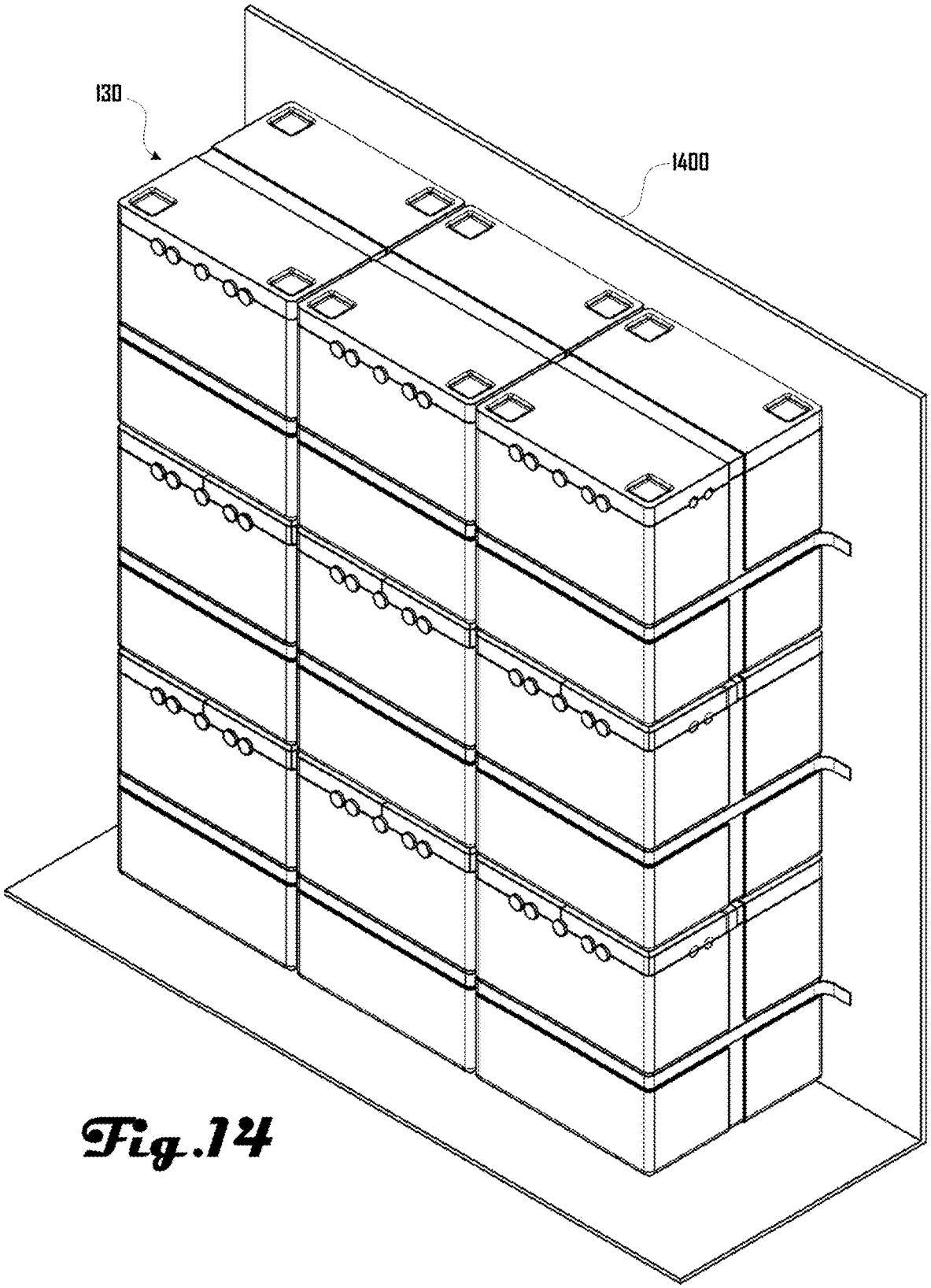
FIG. 14 illustrates an example of nine tanks in a three-by-three arrangement against a wall.
Figure 15:
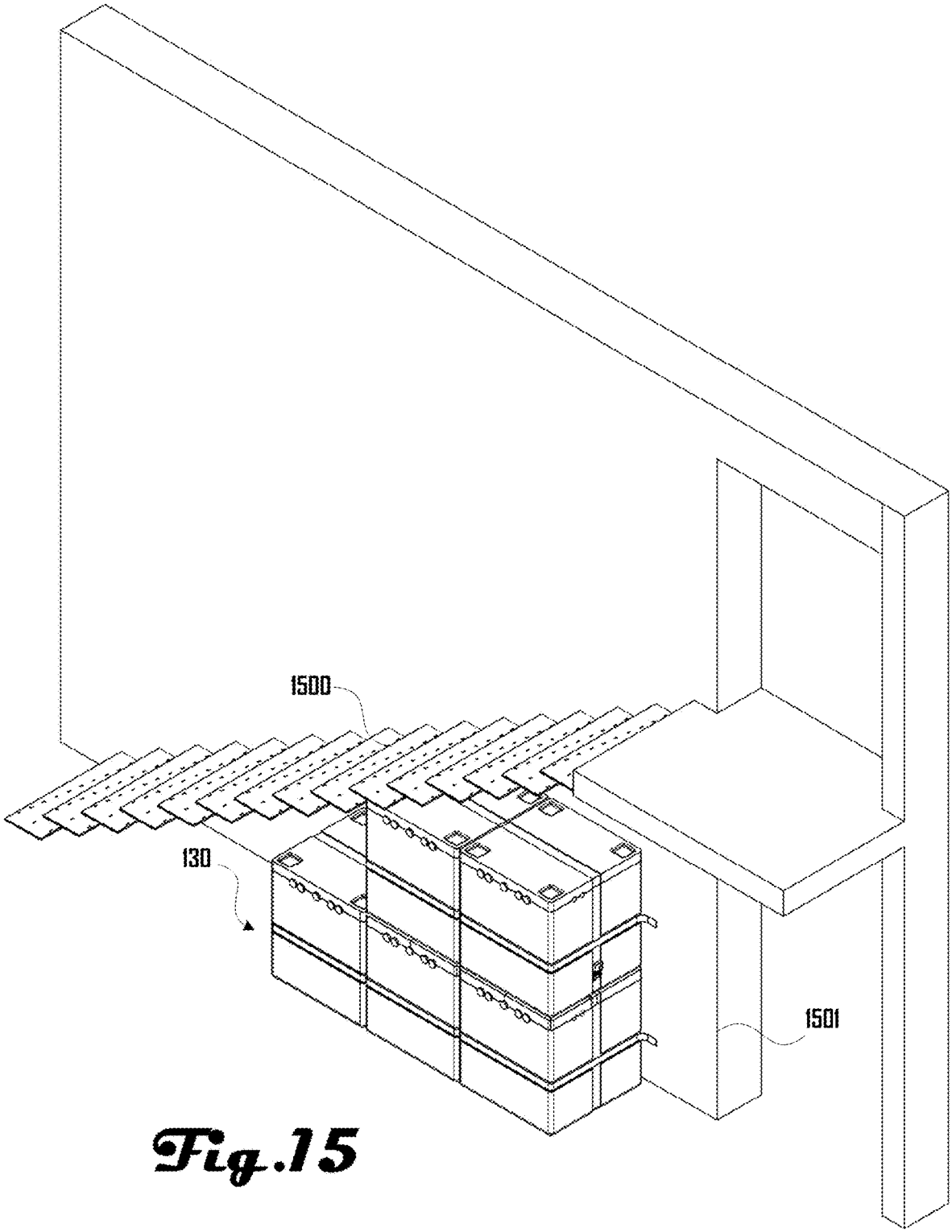
FIG. 15 illustrates an example of five tanks arranged under a set of stairs and against a wall.

For example, FIG. 13 illustrates three tanks 130A, 130B, 130C stacked on top of each other against a wall 1300. FIG. 14 illustrates nine tanks 130 in a three-by-three arrangement against a wall 1400. FIG. 15 illustrates five tanks 130 arranged under a set of stairs 1500 and against a wall 1501. In further embodiments, any suitable plurality of tanks 130 can be modularly configured together in various suitable ways. For example, a column of stacked tanks can comprise 2, 3, 4, 5, 6, 7, 8, 9, 10, 15, 25, 50, 100 or other suitable plurality of tanks 130. Additionally, a set of tanks 130 can comprise 2, 3, 4, 5, 6, 7, 8, 9, 10, 15, 25, 50, 100 or other suitable plurality of columns of tanks 130, which may or may not be columns of the same number.

Also, while the examples of FIGS. 13-15 illustrate tanks 130 being arranged in two dimensions (i.e., rows and columns), further embodiments can include configurations in three dimensions, including where faces of adjoining tanks 130 of the same size are and/or are not aligned. Also, while the examples of FIGS. 13-15 illustrate a set of tanks 130 being the same shape and size, further embodiments can include tanks with different shapes and/or sizes. For example, a set of tanks 130 can include tanks of 2, 3, 4, 5, 6, 7, 8, 9, 10, 15, 25, 50, 100 or other suitable number of different sizes.

Tanks 130 can have different dimensions for different uses and/or to provide access to varying locations. For example, an embodiment of a tank 130 for home retrofits can be cubic and three feet in all dimensions, which can be desirable so such tanks 130 are lightweight and easy to manage. Further embodiments can include tanks 130 with a maximum dimension (e.g., maximum dimension of a cuboid) of 1-7 feet, 2-6 feet, 3-5 feet, 4-8 feet, 4-10 feet, 10-20 feet, and the like.

Figure 16:
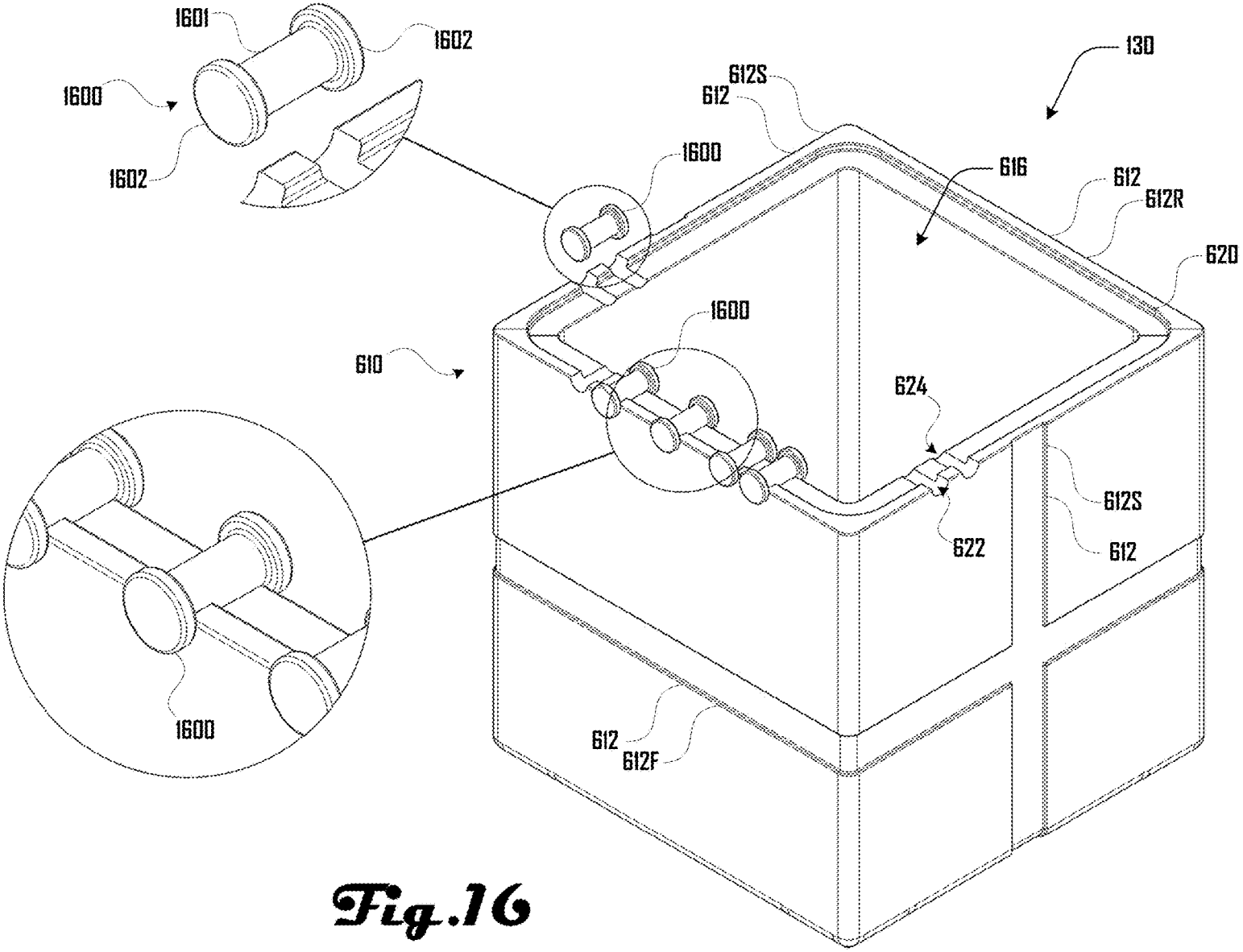
FIG. 16 illustrates an embodiment of a tank comprising a plurality of insulated caps that include a shaft with heads disposed on ends of the shaft.

Some embodiments of a tank 130 can include various forms of interfacing with a thermal storage medium contained within the cavity 616 of the tank 130. Examples of such interfaces can include heat exchangers, resistive heating units, fill valves, pumps, a port plug, and the like. Some embodiments can include uniform sealable ports incorporated into the tank 130 to allow different attachments to be included in the tank, or for ports to be plugged depending on use. For example, FIG. 16 illustrates an embodiment of a tank 130 comprising a plurality of insulated caps 1600 that include a shaft 1601 with heads 1602 disposed on ends of the shaft 1601.

As discussed herein and also illustrated in FIG. 6, a plurality of corresponding notches 652 and gaps 622 on the lid 650 and tank body 610 can respectively define a plurality of ports 624 when the lid 650 is coupled with the rim 620 of the tank body 610. Such notches 652 and gaps 622 in some examples can be half-circle in shape, and the coupling of the lid 650 to the tank body 610 can define circular or cylindrical ports 624 in which the caps 1600 can be disposed with the shafts 1601 of a caps 1600 extending within the ports 624 with the respective heads 1602 extending over internal and external portions of the tank 103 about the ports 624. Accordingly, the caps 1600 can act as insulating plugs for the ports 624 when an interface element is not present in the port 624.

Ports 624 can be located on various locations on the rim 620 including one or more ports 624 on the top of one or more sidewalls 612. For example, FIGS. 6 and 16 illustrate a plurality of ports 626 on the front and side sidewalls 612F, 612S with ports 626 being absent from the rear sidewall 612R. Additionally, in further embodiments, ports 612 can be of any other suitable size and shape and can be defined by various elements of the tank 130 in various suitable locations. For example, in some embodiments, ports 626 can be defined exclusively by the lid 650 and/or tank body 610 in various suitable locations. In various embodiments, some or all of the ports 626 can be uniform in size and shape or can be of different sizes and/or shapes.

Figure 17:
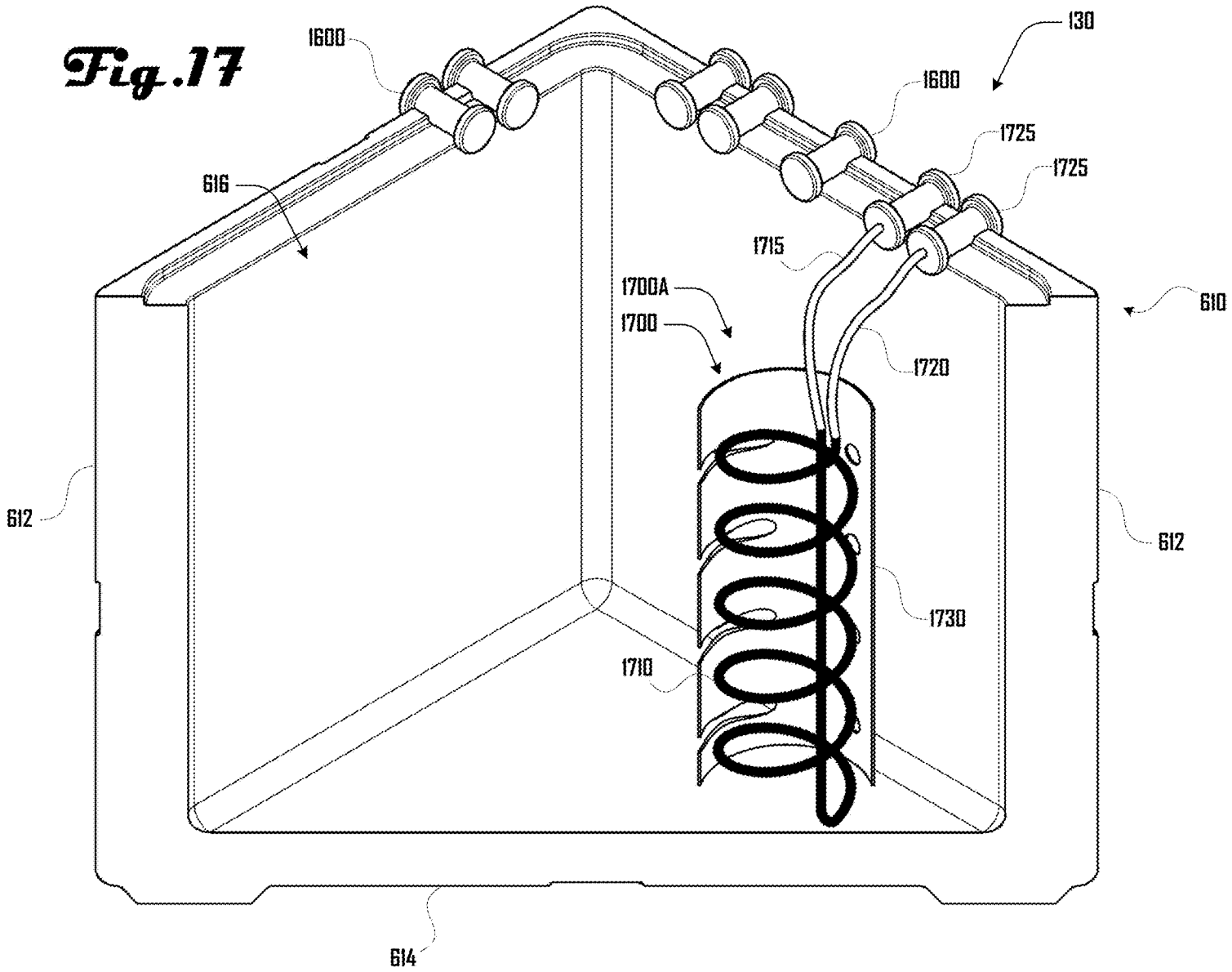
FIG. 17 illustrates an example embodiment of a heat exchanger assembly configured to charge and/or discharge a tank hung from the rim of the tank with elements extending into the cavity of the tank through one or more ports.

In various embodiments, including the example of FIG. 17, a heat exchanger assembly 1700 to charge and/or discharge the tank 130 can be installed and hung from the rim 620 of the tank 130 with elements extending into the cavity 616 of the tank 130 through one or more ports 626. As shown in FIG. 17, one embodiment 1700A of a heat exchanger assembly 1700 can comprise a heat exchange coil 1710 connected to inlet and outlet lines 1715, 1720 that extend through respective port plugs 1725 disposed within ports 626 of the tank 130. A heat exchanger shell 1730 can be disposed about the heat exchange coil 1710.

In various embodiments, a fluid at a first temperature can enter the tank 130 and heat exchange coil 1710 via the inlet line 1715 where heat exchange can occur between a thermal storage medium disposed within the cavity 616 of the tank 130 and fluid can leave the heat exchange coil 1710 and tank 130 via the outlet line 1720 at a second temperature, which may be greater or smaller than the first temperature depending on the heat exchange occurring between the fluid and the thermal storage medium disposed within the cavity 616 of the tank 130.

Embodiments of a heat exchanger assembly 1700 can be constructed of corrugated or non-corrugated stainless steel tubing or polymer based tubing (e.g., cross-linked polyethylene). Various suitable materials and forms of heat exchangers can be used depending on target costs, desired performance or other factors. To interface with a thermal storage medium disposed within the cavity 616 of the tank 130, the heat exchanger coil 1710 can coil down progressively to the base 614 of the tank 130 and can be the same or similar height as the tank cavity 616 to maximize surface area contact with a thermal storage medium disposed within the cavity 616 of the tank 130.

Figure 18:
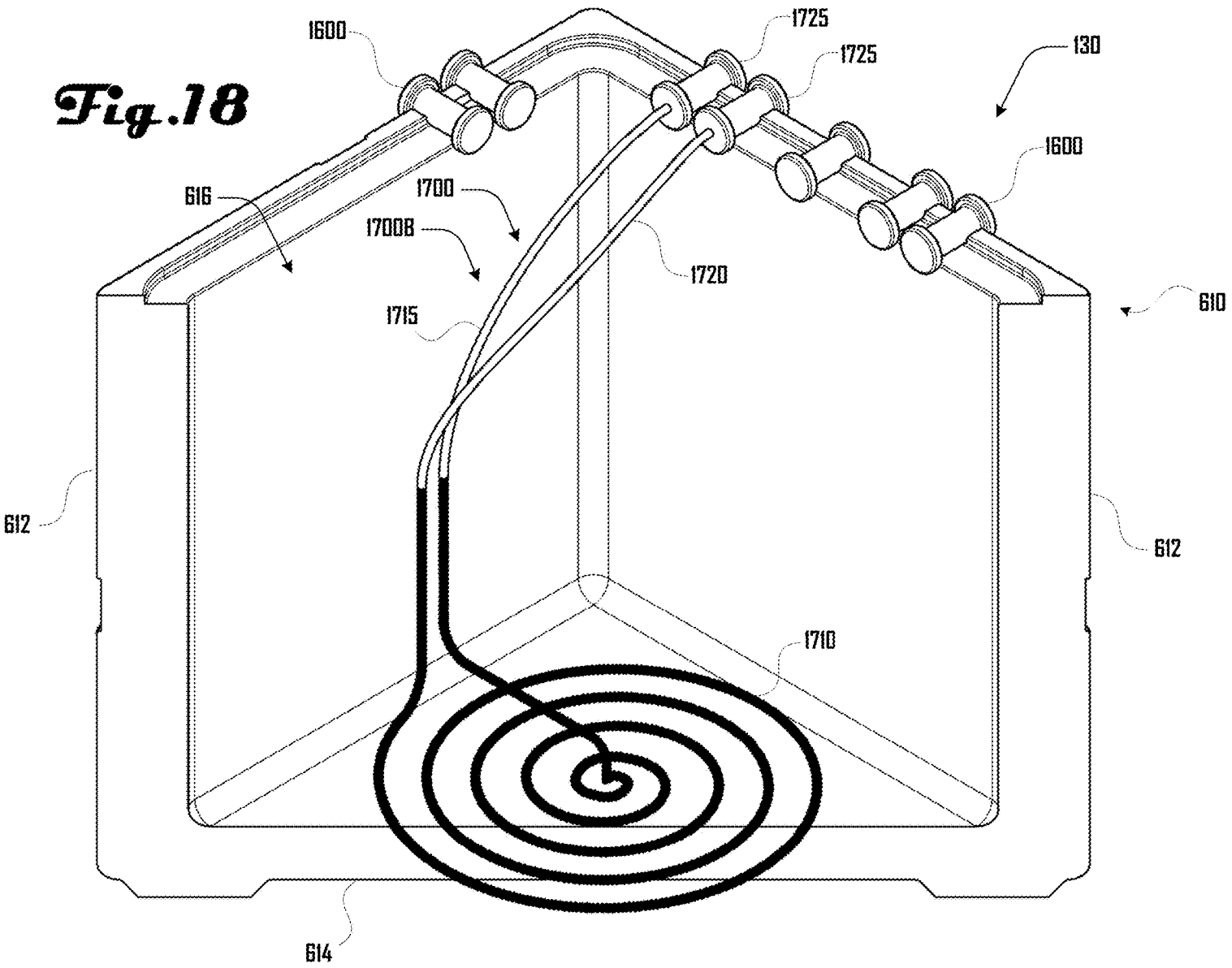
FIG. 18 illustrates another embodiment of a heat exchanger assembly that comprises a heat exchange coil connected to inlet and outlet lines that extend through respective port plugs disposed within ports of a tank.

FIG. 18 illustrates another embodiment 1700B of a heat exchanger assembly 1700 that comprises a heat exchange coil 1710 connected to inlet and outlet lines 1715, 1720 that extend through respective port plugs 1725 disposed within ports 626 of the tank 130. In contrast to the helical coil 1710 shown in FIG. 17, FIG. 18 illustrates a planar spiral coil 1710 that is disposed at the base 614 of the tank body 610 within the cavity 616 of the tank 130.

For domestic hot water (DHW) combined systems (e.g., as discussed herein), DHW supply can be isolated from other elements in a closed-loop system (e.g., storage and heat pump loops) to keep the water clean and pure. This can be accomplished with a submerged heat exchanger; however, certain embodiments of a DHW-specific heat exchanger can either interface directly with the coldest or warmest portion of thermal energy stored, depending on what is required. Such heat exchangers can have a profile that substantially only interfaces with one plane within the cavity 616 and various embodiments can allow a thermocline to be maintained throughout the tanks 130. For example, FIG. 18 illustrates an example of a planar spiral heat exchange coil 1710 that can be configured to generally interface with one plane within the cavity 616. Accordingly, while the example of FIG. 18 shows the planar spiral heat exchange coil 1710 disposed at the base 614 of the tank 130, further embodiments can include one or more planar spiral heat exchange coil 1710 disposed at any suitable horizontal plane within the cavity 616 of the tank 130.

Also, while FIGS. 17 and 18 illustrate a single heat exchanger assembly 1700 disposed within the cavity 616 of the tank 130, further embodiments can include any suitable plurality of heat exchanger assemblies 1700 disposed within the cavity 616 of the tank 130 with such a plurality being the same or different type of heat exchanger assembly 1700 (e.g., embodiments 1700A, 1700B).

Figure 19:
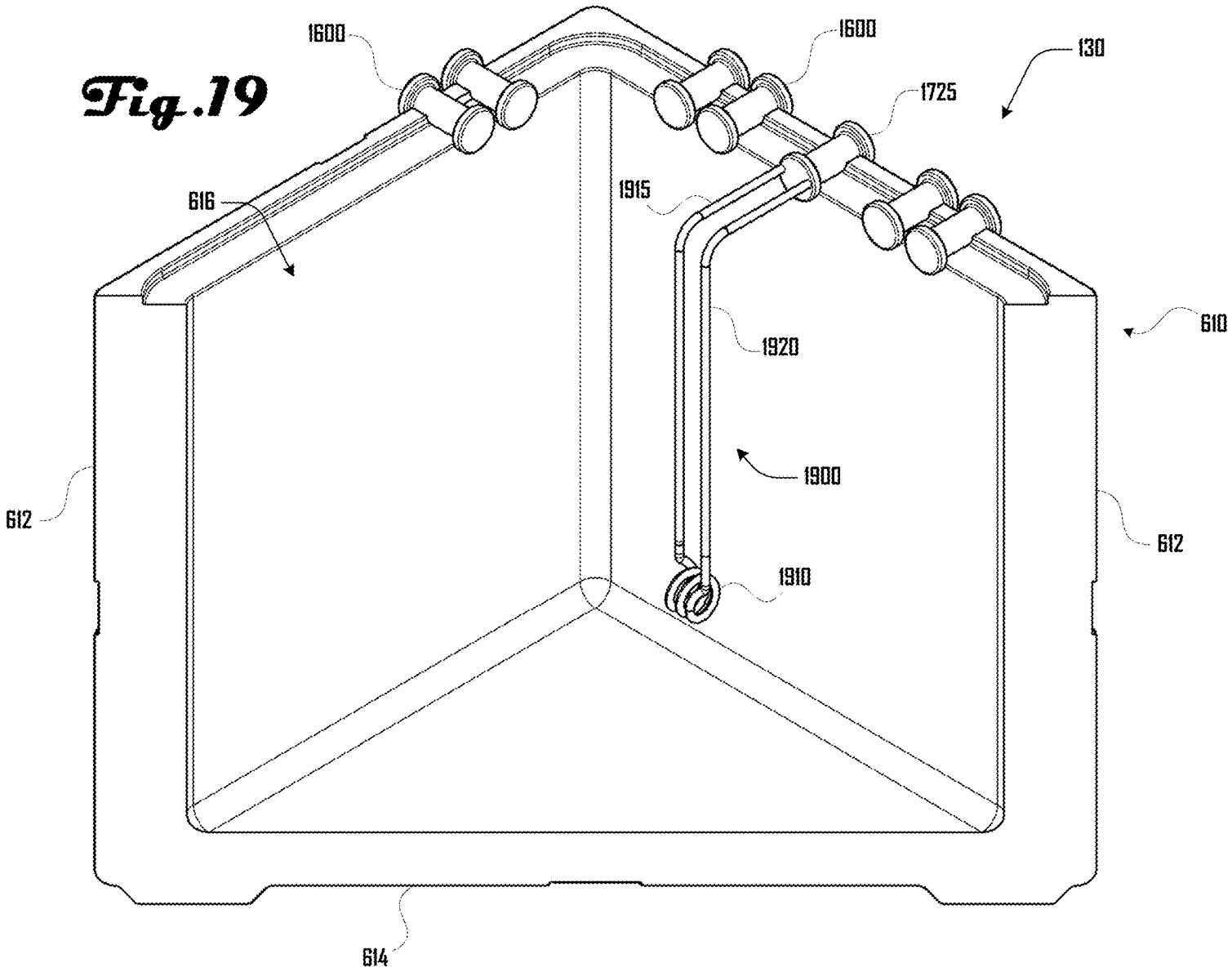
FIG. 19 illustrates an example embodiment of a tank comprising a heating coil connected to power lines that extend through a port plug disposed within a port of a tank.

Some embodiments can include thermal input capacity. Resistive heaters can have a lower COP than heat pumps but are inexpensive per kW. In some embodiments of a thermal storage system, curtailing large amounts of renewable generation can be desirable to help the electricity grid manage its supply and demand, or if a residence has thermal loads that are difficult to predict. In these instances, an electric resistance heat unit 1900 can be installed into one or more tanks 130, such as shown in the example of FIG. 19. Specifically, FIG. 19 illustrates a heating coil 1910 connected (via lines 1915, 1920) to power lines 1715, 1720 that extend through a port plug 1725 disposed within a port 626 of the tank 130. In various examples, one or more of such electric resistance heat units 1900 can be turned on instantaneously by the system (e.g., controlled by a computing device) and can provide substantial, if not all, required amounts of heat to the system, when necessary or desirable.

Figure 20:
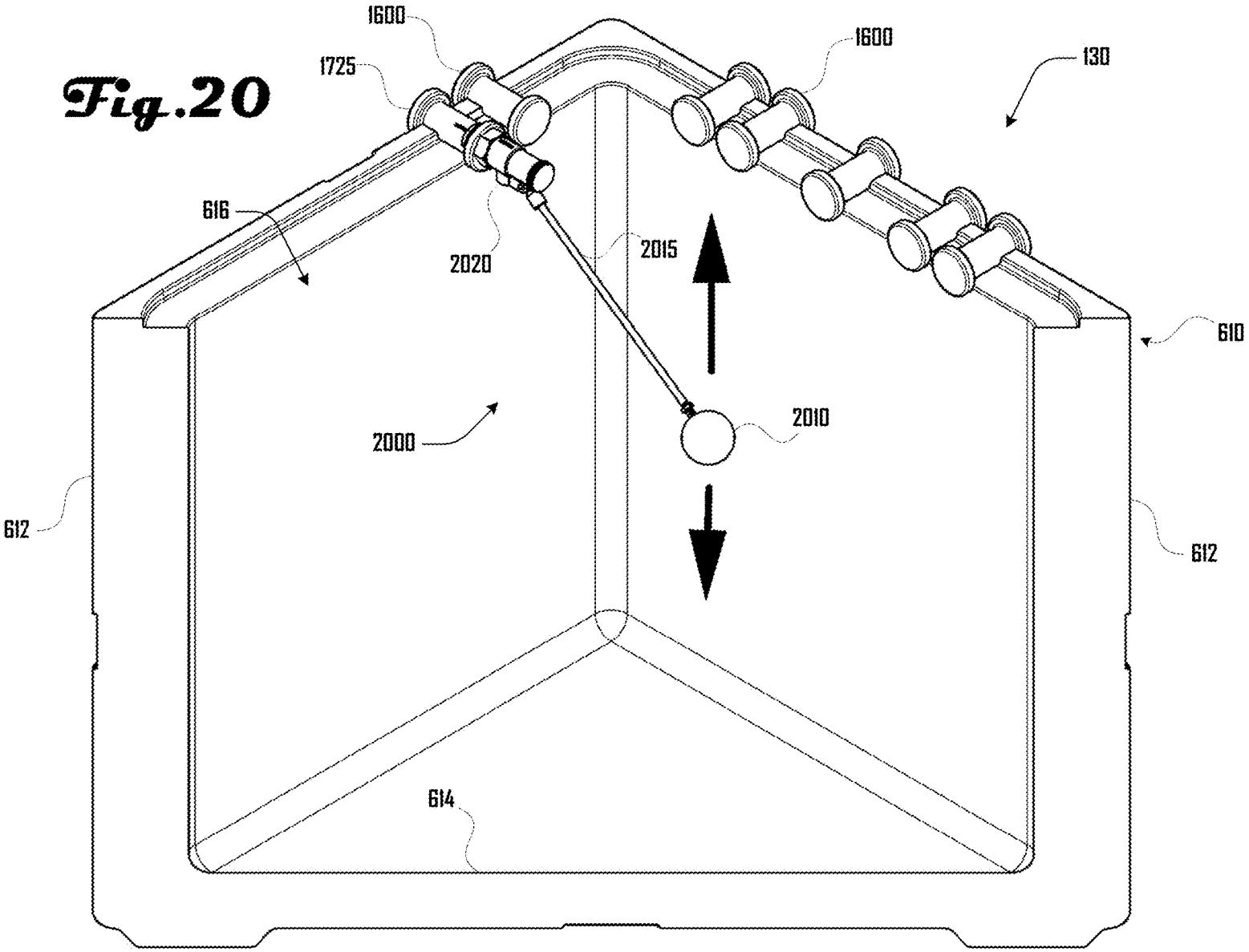
FIG. 20 illustrates an example embodiment of a tank comprising ballcock float unit configured to maintain a level of thermal storage medium fluid in the cavity of a tank.

Gradual evaporation of thermal storage medium disposed within the cavity 616 of a tank 130 can occur in various examples. To compensate for this, some embodiments can include a ballcock float unit 2000 that is configured to maintain a substantially constant thermal storage medium fluid level in the tank 130 such as shown in the example of FIG. 20. For example, as shown in FIG. 20, a ballcock float unit 2000 can comprise a float 2010 disposed at an end of a rod 1015, with the rod 2015 configured to actuate a valve 2020 that can introduce thermal storage medium fluid into the cavity 616 of the tank 130. For example, the float 2010 can be configured to float on or otherwise follow the level of thermal storage medium fluid within the cavity 616 of the tank 130 and when the level of thermal storage medium fluid reaches a minimum level, the float 2010 can cause the rod 2015 to actuate the valve 2020 to introduce thermal storage medium fluid into the cavity 616 of the tank 130 to raise the level of the thermal storage medium fluid until the float 2010 causes the rod 2015 to actuate the valve 2020 to stop introduction of thermal storage medium fluid into the cavity 616 of the tank 130.

While various embodiments discussed herein related to a set of modular tanks 130 that can be easily transported and sized to fit through conventional doors (e.g., a height of 6'6", 6'8", 7'0" or 8'0" by 2'0", 2'4", 2'8", 2'10", 3'0" or 3'6") or other entryways, further embodiments can include tanks of various suitable sizes, which may or may not be modular, movable or sized to fit through conventional doors or entryways. For example, some embodiments of a tank 130 may be larger and less modular, resulting in a tank 130 of much greater volume. A larger tank 130 may require less material per unit volume, making them less expensive in some examples.

Figure 21:
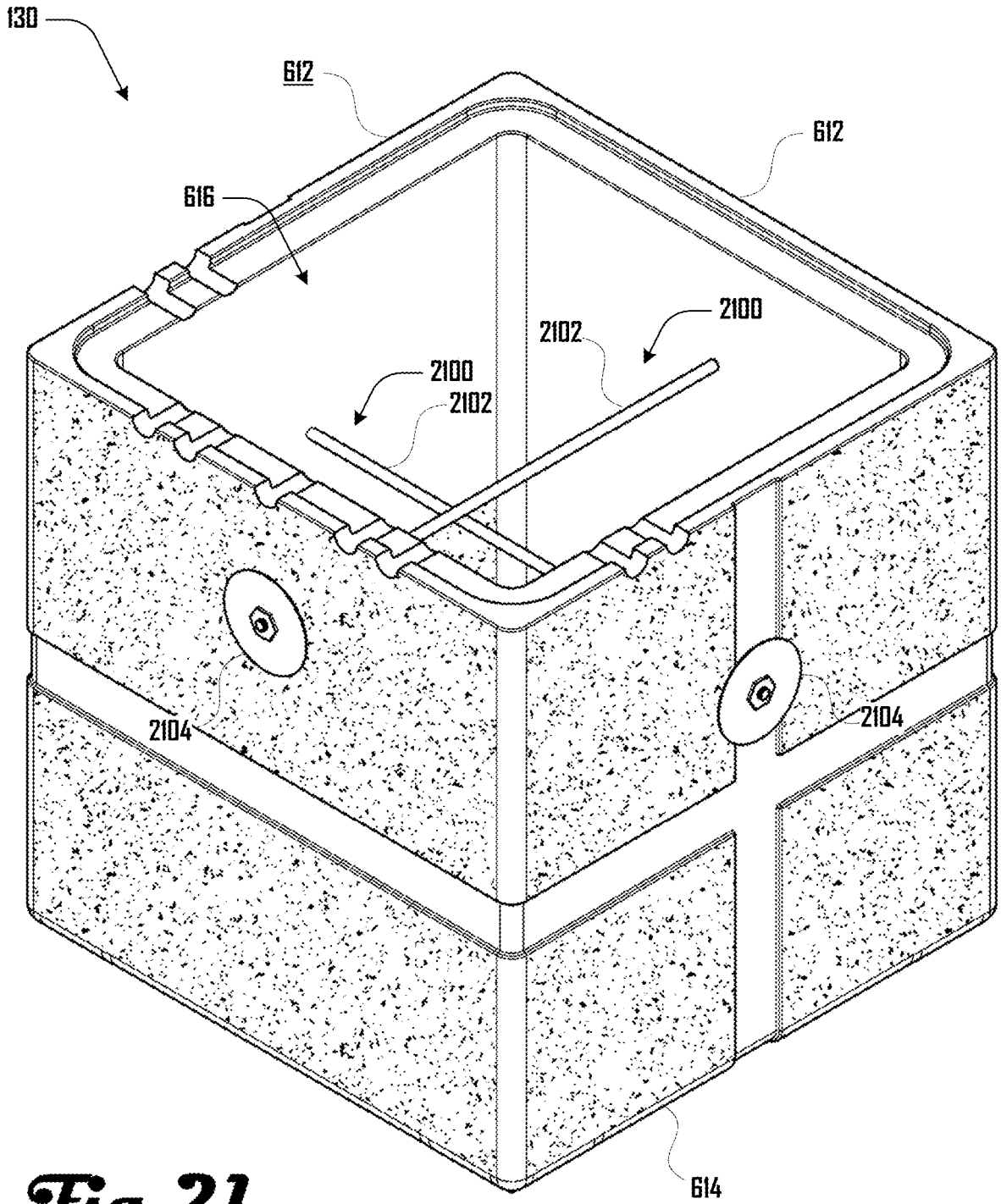
FIG. 21 illustrates an example of a tank that comprises a pair of supporting members with a rod extending through respective opposing sidewalls and through the cavity with washers coupled on opposing ends of the rods engaging opposing external faces of the sidewalls.

Some examples of tanks 130 may include additional supporting members to handle greater volumes while still being structurally sound. For example, before coating the tank with a durable elastomer, tensile members may be inserted with large washer-like sections of material to support broad surfaces and provide greater dimensional stability. FIG. 21 illustrates an example of a tank 130 that comprises a pair of supporting members 2100 that comprise a rod 2102 extending through respective opposing sidewalls 612 and through the cavity 616 with washers 2104 coupled on opposing ends of the rods 2102 engaging opposing external faces of the sidewalls 612. Various other suitable structural supports can be used to reinforce a tank 130.

Tanks can be manufactured in various suitable ways. For example, some embodiments of a tank 130 can be manufactured by molding insulating foam such as polystyrene and then coating the foam with a durable elastomer, which in some examples can create a lightweight, low cost, and highly insulating tank 130. Another embodiment of the tank 130 can be created by coating the inside cavity of a mold with a durable elastomer before injecting insulating foam such as polystyrene or polyurethane. One embodiment of the tank 130 can be created using cut-to-length extruded shapes of a durable polymer that has insulating material inserted before bonding sealing end caps to the tank 130. One embodiment of the tank 130 can be manufactured using roto-molding of a polymeric skin that is then filled with insulative material such as polyurethane or expanding polystyrene.

Conventional thermal storage and hot water tanks can have an equivalent R-value of 8-12, which may correspond to standby losses that are undesirable for various embodiments of a thermal storage system discussed herein. Embodiments of some tanks 130 discussed herein can contain a minimum of three inch thick walls of extruded polystyrene or polyurethane foam, providing an R-value of at least 18 all around, with no other materials to act as thermal bridges and increase standby losses. Further embodiments can have and R-value greater than or equal to 12, 14, 16, 18, 20, 25, 30, 35, 40, 45, 50, 55, 60, 65, 70, 80, 90, 100, 150, and the like.

For creating customizable tank geometries, one embodiment of the tank 130 can be constructed with modular panels of insulating foam assembled together utilizing keying geometries and/or adhesives. The assembled foam form can then be coated via spraying or rolling with a durable elastomeric polymer that provides a durable, temperature resistant shell holding the foam into its final shape. Using parametric modeling of the tanks, the tanks 130 may be built to any number of sizes and geometries. This modular manufacturing technique may also implement tensile members incorporated into the foam structure before coating to provide additional support.

Figure 22:
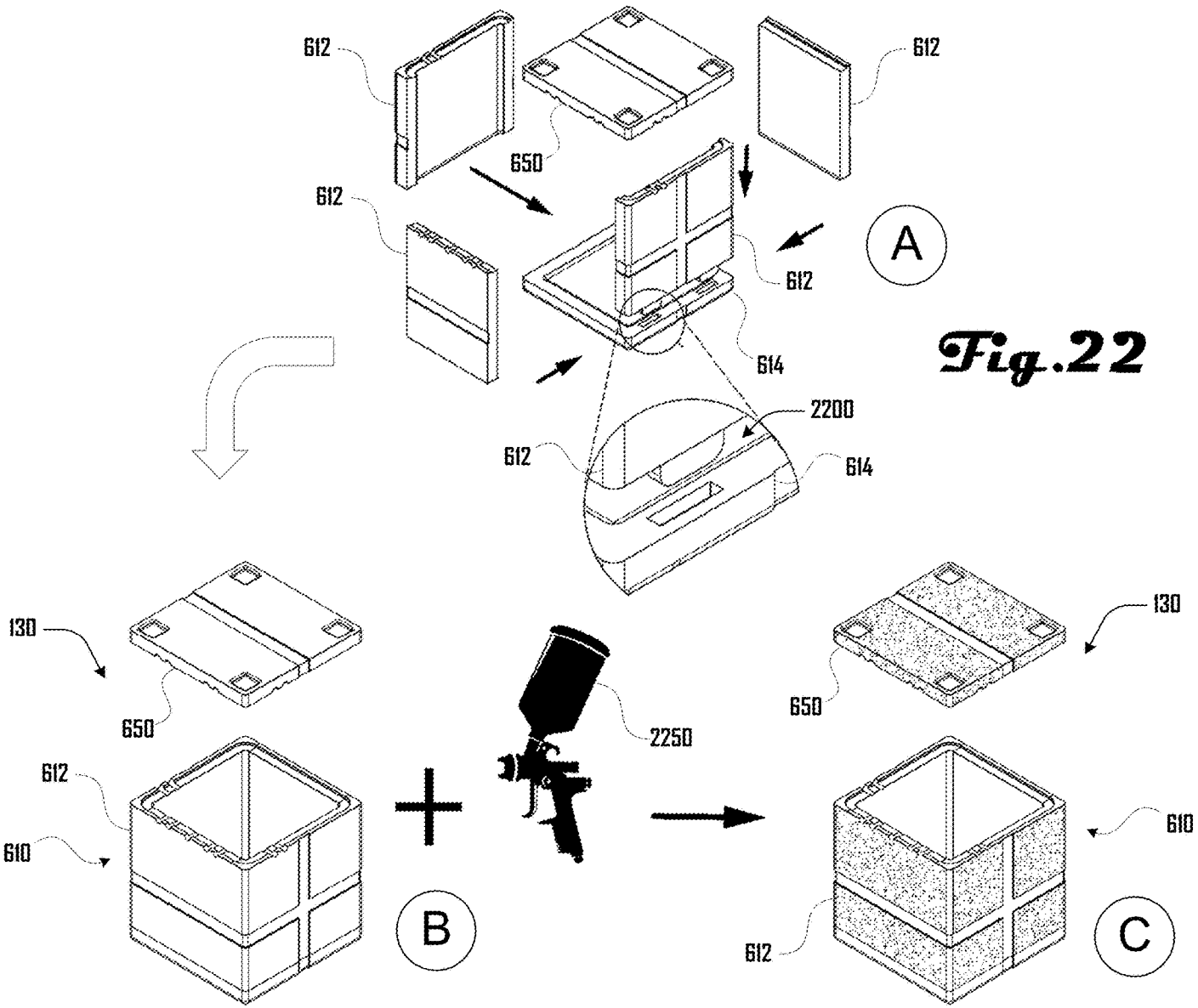
FIG. 22 illustrates a method of constructing a tank in accordance with one embodiment.

For example, FIG. 22 illustrates a method of constructing a tank 130 that begins with a first step A, where a set of sidewalls 612 and a base 614 are coupled together via coupling structures 2200 (e.g., one or more tab and slot) to generate an assembled tank body 610. In some embodiments, other suitable coupling structures and/or an adhesive can be used to assemble the tank body 610. As shown in step B, a sprayer 2250 can be used to apply a coating to the tank body 610 and lid 650 to generate a coated tank 130 as shown in step C. In various embodiments, a coating applied to the tank 130 can comprise a polymer or other suitable materials that when dried and/or cured provides a shell to hold pieces of the tank 130 in place.

Figure 23:
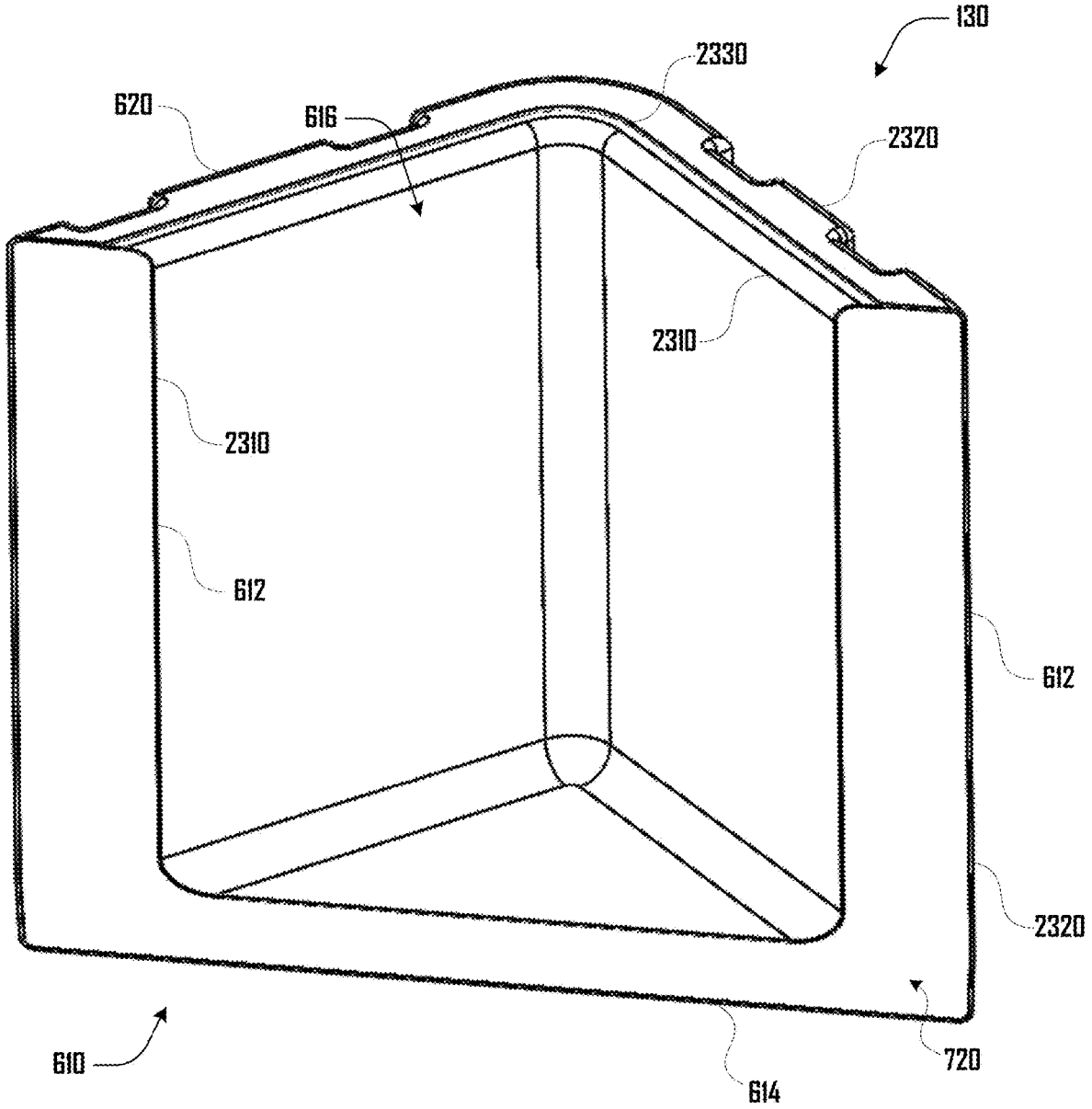
FIG. 23 illustrates a cross-section of an embodiment of a tank that includes an internal portion made of a first material and an external portion made of a second material with the internal and external portions coupled at a joint about the rim of the tank body.

If higher temperatures are desired for a particular embodiment, an inner surface of a tank 130 may be made of formed metal. An outer skin can be formed by blow molding a durable polymer and the two parts can joined by molding insulating foam in between them. For example, FIG. 23 illustrates a cross-section of an embodiment of a tank 130 that includes an internal portion 2310 made of a first material (e.g., formed metal) and an external portion 2320 made of a second material (e.g., a polymer) with the internal and external portions 2310, 2320 coupled at a joint 2330 about the rim 620 of the tank body 610. The internal and external portions 2310, 2320 can define an insulation cavity 720.

Figure 24:
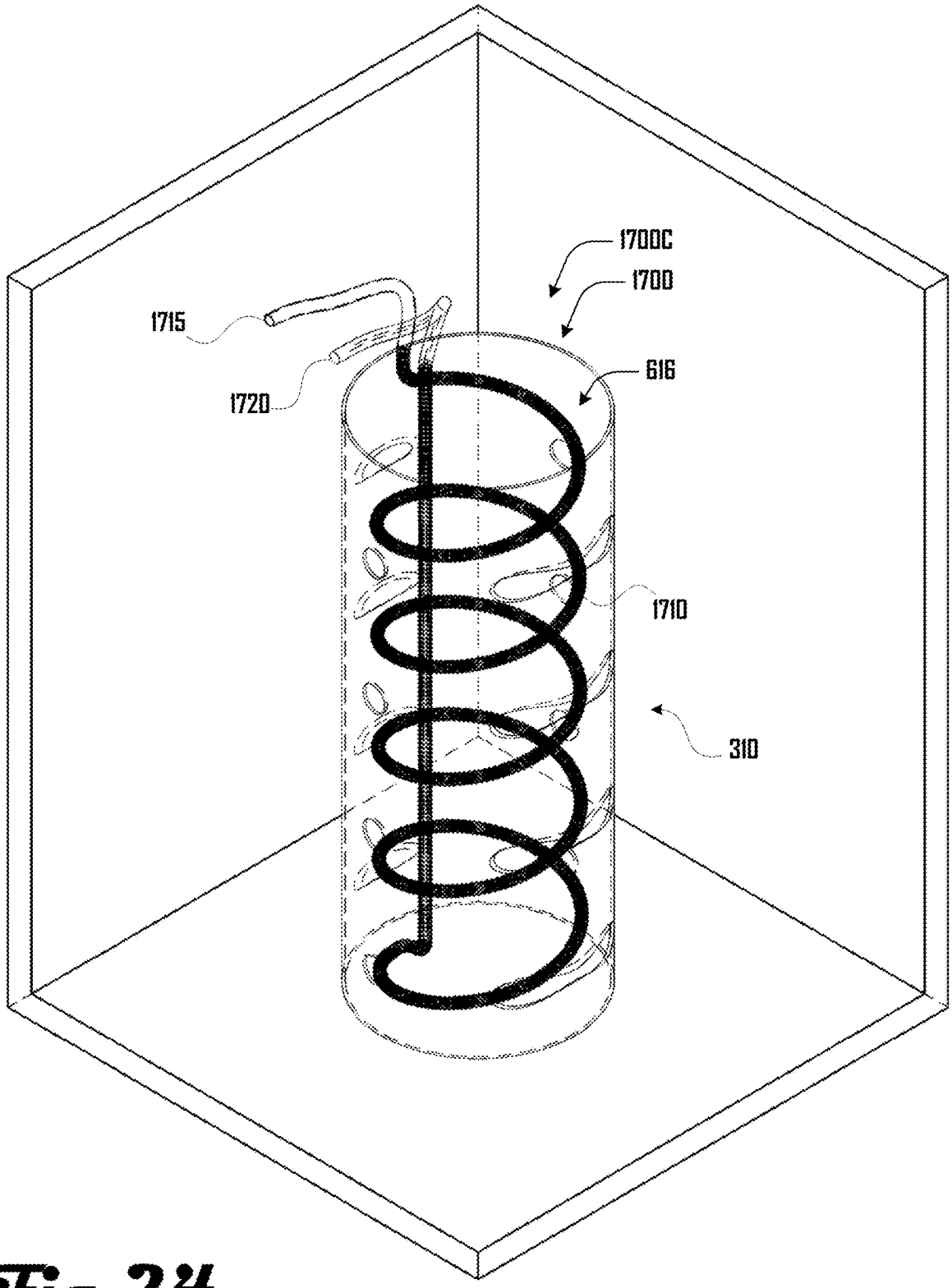
FIG. 24 illustrates an example of a tank with another embodiment of a heat exchanger assembly that comprises a heat exchange coil connected to inlet and outlet lines.

By inducing low-flow conditions in some embodiments of a thermal storage tank 130, it can be possible to develop a thermocline (e.g., a steep temperature gradient in a thermal storage medium in a tank 130 defined by a layer above and below where the thermal storage medium is at different temperatures) where a temperature difference between hot and cold layers exceeds 20° C. When adding and removing thermal energy to a tank 130, it can be desirable to control the flow of thermal energy to maintain a thermocline in the tank 130. For example, FIG. 24 illustrates an example of a tank 130 with another embodiment 1700C of a heat exchanger assembly 1700 that comprises a heat exchange coil 1710 connected to inlet and outlet lines 1715, 1720. Such an embodiment can be configured, in various examples, to generate a thermocline within the tank 130 in a thermal storage medium stored within the cavity 616 of the tank 130 that includes a first and second layer of a thermal storage medium separated by a small horizontal gradient layer with a different in temperature between the first layer being greater than or equal to 5° C., 10° C., 15° C., 20° C., 25° C., 30° C., or the like.

Understanding the state of charge (SOC) of a thermal storage tank 130 can be desirable for providing good forecasting and system efficiency. Given a temperature gradient throughout one or more tanks 130 in some embodiments, a single temperature measurement at one point may not be sufficient in some examples to understand the state of charge (SOC) or energy currently stored by the system. Accordingly, embodiments can be configured in various suitable ways such that a suitable SOC of one or more tanks 130 can be determined, including solutions in software, hardware, or the like.

Through data collection and controls, it can be possible to in some embodiments infer the SOC of one or more thermal storage tanks 130 based on the uptime of different components and a few known values at certain points. Tank configurations and ambient temperatures can vary, leading to different coefficients of thermal losses in some examples.

One embodiment of software solutions that determine system SOC can comprise calculating the net energy in and net energy out of the system, including standby losses. This can be done in various suitable ways, including with direct on-system sensors to calculate temperatures and flow rates leaving and entering the system, or the like.

Another solution may not need to rely on sensors and can utilize existing datasets and machine learning algorithms to estimate the SOC of one or more tanks 130 of a thermal storage system. This is possible in some examples by understanding the thermal losses on the thermal storage system, the output of one or more heat pumps under different conditions, and the efficiency of a building's heat distribution system. This method can be desirable in some examples because in some embodiments such a method can refine itself as more data is collected and may not require additional sensors to be installed in some embodiments.

Figures 25A, 25B:
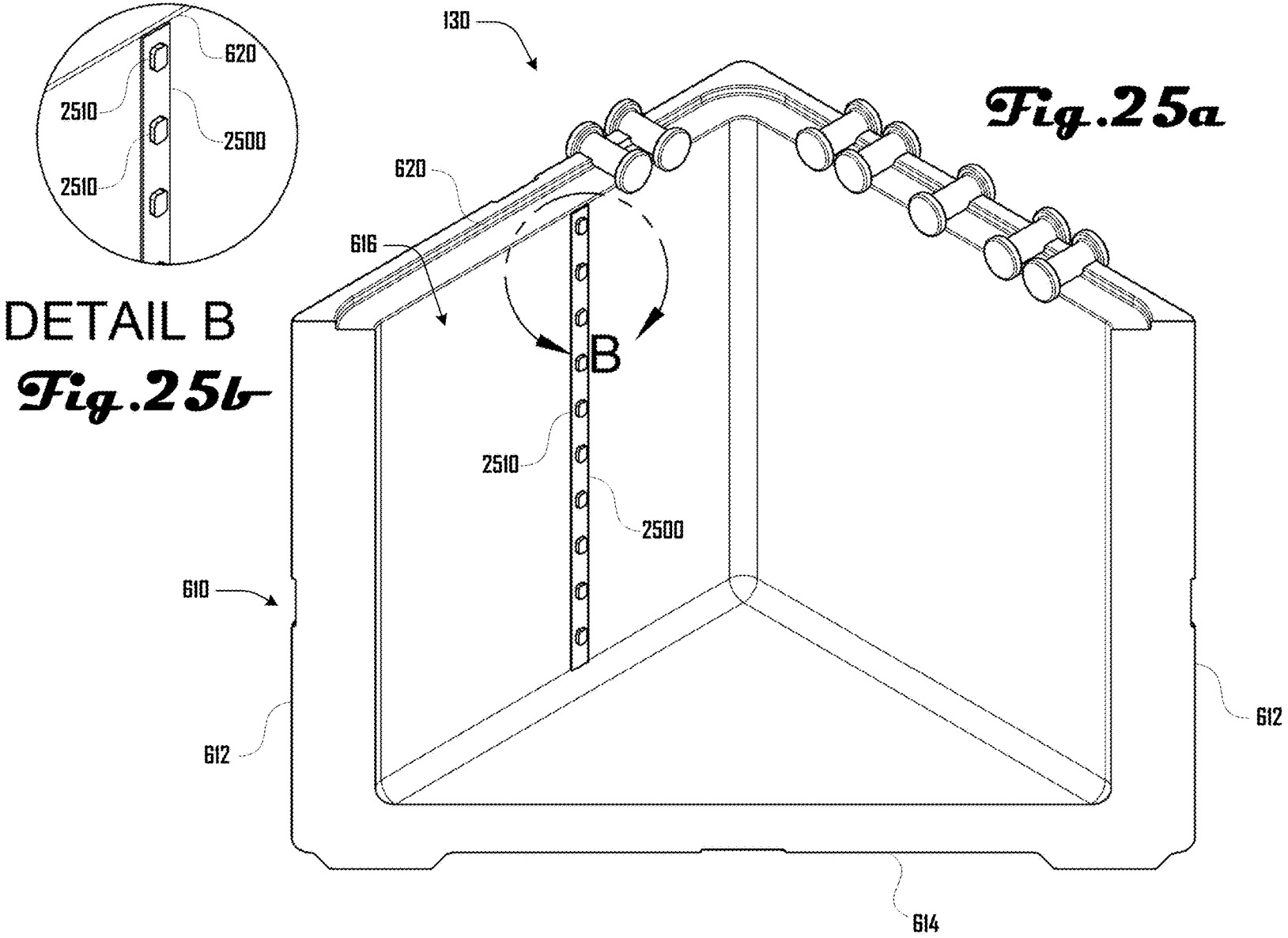
FIG. 25*a* illustrates an embodiment of a tank that comprises a temperature sensor array disposed on an internal portion of the tank facing the internal cavity and FIG. 25*b* illustrates a close up view of the sensor array of FIG. 25*a*.

In some embodiments, a waterproofed and dedicated sensor strip can be installed in a tank 130 and lined with temperature sensors such as a DS18B20 temperature sensor, or the like. For example, FIG. 25 illustrates an embodiment of a tank 130 that comprises a temperature sensor array 2500 disposed on an internal portion of the tank 130 facing the internal cavity 616 extending vertically from the base 614 to the rim 620 and comprising a plurality of temperature sensors 2510 along the length of the sensor array 2500. Further embodiments can include one or more sensor arrays 2500 that extend any suitable length and with any suitable plurality of temperature sensors 2510. In various embodiments, data from a plurality of temperature sensors 2510 can provide an understanding of a temperature profile within the tank 130 to an extent that provides the ability to track the movement and effectiveness of a thermocline in a tank 130 or otherwise determine a thermal state or state of charge of a thermal storage medium disposed within the cavity 616 of the tank 130.

Heat exchangers can exchange heat from one medium or fluid to another medium or fluid. Heat exchangers may be used in heating systems as described in some examples herein to move heat from (e.g., water to air) to heat a building, or the like.

Heating, Ventilation and Air Conditioning systems (HVAC) can operable based on heat exchange. Therefore, in various HVAC systems the efficiency, costs, and size of heat exchangers of the system can dominate the costs of equipment and can dictate many aspects of a heating or cooling system. Systems and methods to decrease the costs of such heat exchangers of an HVAC system can therefore be desirable in some examples.

Various hydronic heating and cooling systems can operate at a pressure between 10 PSI and 15 PSI. In some embodiments of thermal storage systems, it can be desirable to store energy via an unpressurized thermal storage medium such as an unpressurized body of water. In some embodiments, heat exchangers can be used to isolate the two systems from each other (pressurized vs. unpressurized). Therefore, heat exchangers can dominate the cost of some embodiments of an HVAC system.

Some embodiments can comprise corrugated stainless steel coils in a heat exchanger. In various examples, such corrugations can provide resistance to induce turbulent flow, which can improve heat exchange via the heat exchanger. For example, FIGS. 26*a* and 26*b* illustrate two example embodiments 1700D, 1700E of heat exchanger comprising corrugations 2600 with FIG. 26*c* illustrating a close-up view of the corrugations 2600 of FIG. 26*a*.

Figures 26A, 26B, 26C:
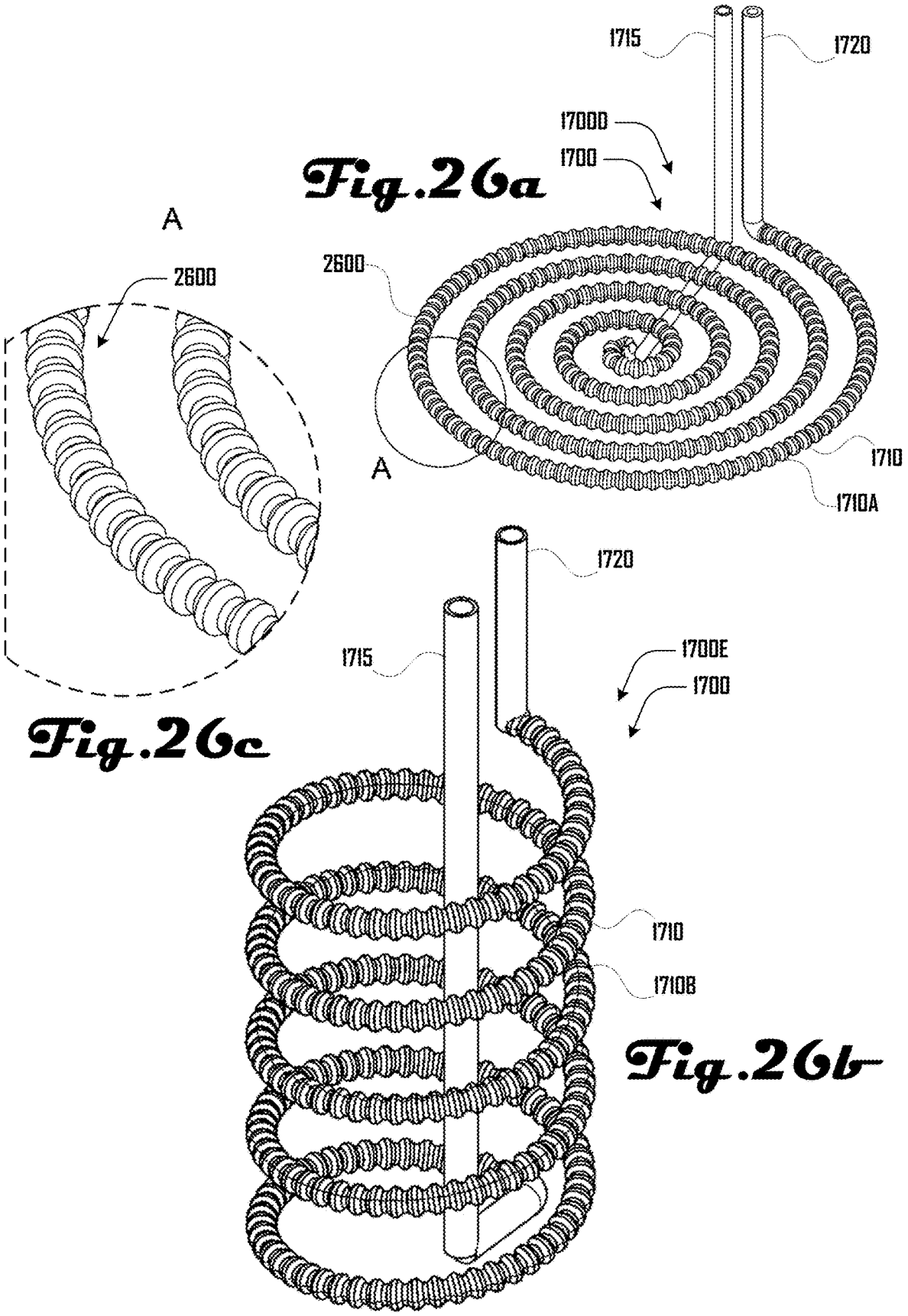
FIG. 26*a* illustrates a planar spiral coil.
FIG. 26*b* illustrates a helical spiral coil.
FIG. 26*c* illustrates a close-up view of the corrugations of FIG. 26*a*.

FIGS. 26*a* and 26*b* illustrate a heat exchanger assembly 1700 that comprises a heat exchange coil 1710 connected to inlet and outlet lines 1715, 1720. FIG. 26*a* illustrates a planar spiral coil 1710A and FIG. 26*b* illustrates a helical spiral coil 1710B. FIGS. 26*a* and 26*b* illustrate example embodiments where the heat exchange coils 1710 comprise corrugations 2600 which are shown close-up in FIG. 26*c*. Embodiments of corrugated tubing for heat exchange coils 1710 can range between 0.5" to 1.5" diameter and have groove depth of ⅛-¼". However, certain embodiments may use non-corrugated stainless tubing, plastics coiled similarly, and the like.

When retrofitting homes to new heating systems, some disadvantages can present themselves in various examples. Heating equipment that is already present (e.g., duct work, hydronic floors, air-handling units, and the like) may be undersized for low-temperature heating that of some hydronic floors, but may be well suited for heat pumps and other radiant solutions. While some high-temperature heat pumps can increase the temperature of water up to 80° C. or more, the coefficient of performance (COP) of some heat pumps decreases as the output temperature is increased. Therefore, it can be favorable in some examples to operate heat pumps at a lower temperature output.

In one aspect, the present disclosure presents systems and methods for efficiently and quickly converting buildings to different heating mechanisms. As of 2020, 60% of existing American housing stock is heated (and cooled) with forced-air systems. Many of these systems are designed poorly and suffer from efficiency losses, as well as poor distribution of energy, resulting in the heating/cooling of uninhabited space.

Accordingly, various embodiments of a thermal storage system can be configured to be retrofitted into and about existing forced-air systems. For example, some embodiments can comprise a heat-exchange element (e.g., a radiator) with a flexible, pre-insulated cable containing tubing for supply and return hydronics, as well as a power cable for electrical. A flexible design like this can easily be routed through existing ductwork in various examples and supply different heating equipment to a series of rooms. Embodiments of such a cable can also be configured for data communication (e.g., to relay temperature, humidity information, or the like on one or more zones).

Figure 27B:
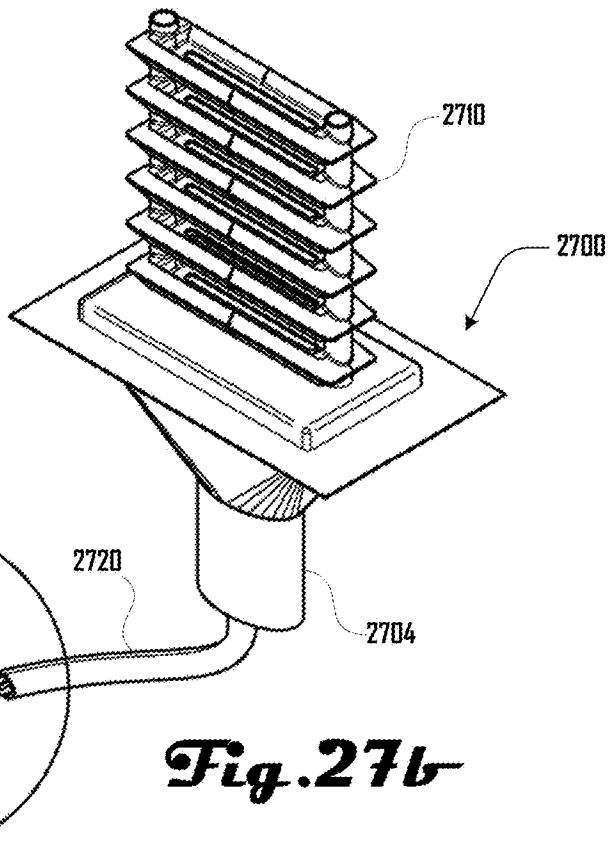
FIG. 27*b* illustrates an example of a radiator that can be retrofitted in place of the vent shown in FIG. 27*a*.
Figure 27A:
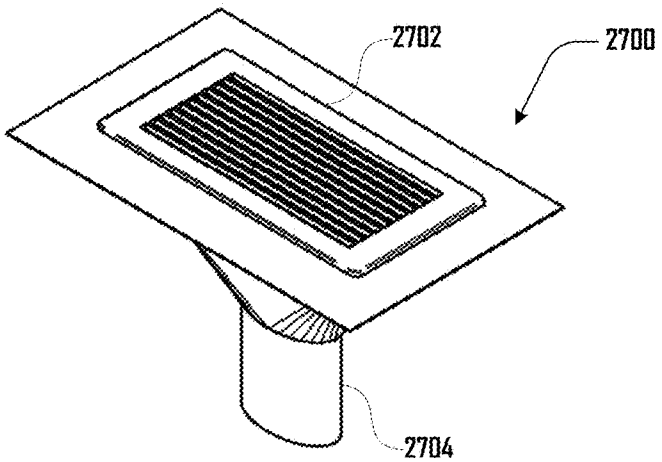
FIG. 27*a* illustrates a forced-air heating assembly comprising a vent and associated ducting.

For example, FIG. 27*a* illustrates a conventional forced-air heating assembly 2700 comprising a vent 2702 and associated ducting 2704. FIG. 27*b* illustrates an example of a radiator 2710 that can be retrofitted in place of the vent 2702 shown in FIG. 27*a*, with a cable 2720 of the radiator 2710 being routed through the existing ducting 2704. As shown in FIG. 27*b* and the close-up illustration of FIG. 27*c*, the cable 2720 can comprise a supply tube 2722, a return tube 2724 and a power line 2726. The supply and return tubes 2722, 2724 can extend through the ducting of the building and be coupled to a thermal storage system including one or more tanks 130 as discussed herein, which can store a thermal storage medium that can be introduced to the radiator 2710 at a first temperature via the supply tube 2722, where heat exchange can occur between the thermal storage medium and the environment around the radiator 2710, with thermal storage at a second temperature returning to the thermal storage system including one or more tanks 130 at a second temperature.

In various embodiments, the radiator 2710 can comprise an onboard fan to increase heat exchange with the environment around the radiator 2710. The power line 2726 can provide the electrical energy to the fan, and thus the fan or other electrically powered elements of the radiator 2710 may not need to take power from other appliances or receptacles in a location where the radiator 2710 is disposed. The power line 2726 can extend through ducting of the building and be coupled to the thermal storage system, which can be a source of electrical power (e.g., by the thermal storage system being plugged into a power receptacle of the building). In some embodiments, the radiator 2710 can comprise various suitable sensors such as temperature, humidity, light, motion sensors or the like. Such sensors can provide data to a computer system of the thermal storage system, which can be used to control the thermal storage system controlling thermal storage medium to one or more radiators 2710, or the like. Such data can be communicated wirelessly and/or via a wired connection (e.g., a via a communication line in the cable 2720).

Figure 28:
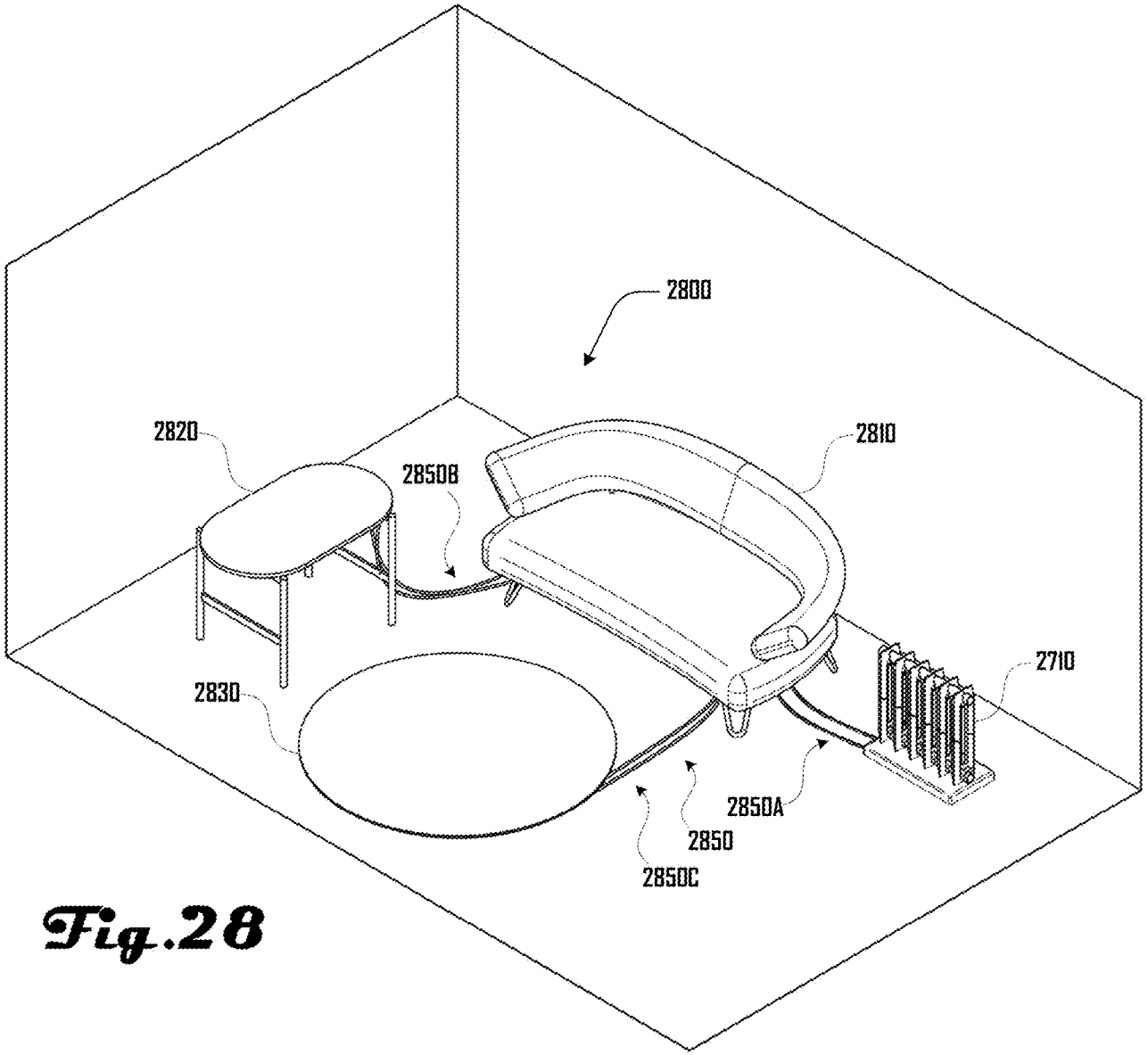
FIG. 28 illustrates an example embodiment of a portion of a thermal storage system disposed in a room of a building.
Figure 29:
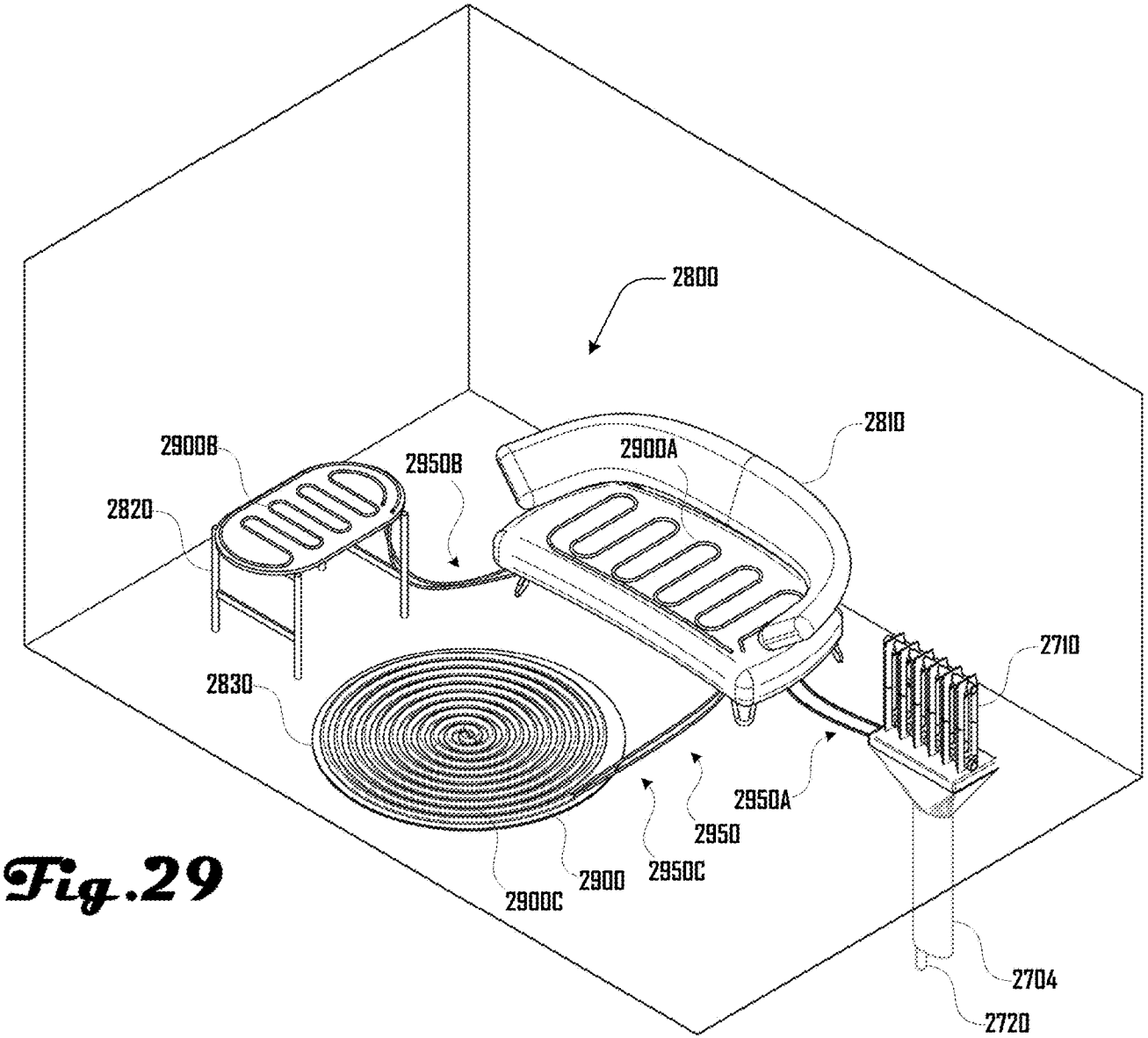
FIG. 29 illustrates a see-though version of the illustration of FIG. 28 showing a plurality of heat exchange elements disposed in, about or under a set of objects in the room including a couch, a table, and a rug.

To compensate for energy loss of buildings, high surface area of heat exchange can be desirable. By incorporating large surface areas of heat exchange into various everyday objects in a living space, this can be possible in various embodiments. For example, FIGS. 28 and 29 illustrate an example embodiment of a portion of a thermal storage system disposed in a room 2800 of a building. Specifically, a plurality of heat exchange elements 2900 are shown disposed in, about or under a set of objects in the room 2800 including a couch 2810, a table 2820, and a rug 2830.

The heat exchange elements 2900 can receive a flow of thermal storage medium via a set of respective lines 2950. For example a first set of lines 2950A from a radiator 2710 can provide thermal storage medium to/from a first heat exchange element 2900A in the couch 2810; a second set of lines 2950B can provide thermal storage medium to/from a second heat exchange element 2900B in the table 2920; and a third second set of lines 2950C can provide thermal storage medium to/from a third heat exchange element 2900C in the rug 2930. In some examples, the lines 2950 can provide thermal storage medium to/from heat exchange elements 2900 in parallel or in series. For example, in one embodiment, the first set of lines 2950 from the radiator 2710 can provide thermal storage medium to/from the exchange elements 2900 in parallel, such as via manifold under the couch 2810, or the like. In another embodiment, the second and third lines 2950B, 2950C can be operably connected directly to the first heat exchange element 2900A in the couch 2810 such that the second and third heat exchange elements 2900B, 2900C are in series with the first heat exchange element 2900A.

As shown in the examples of FIGS. 28 and 29, the first set of lines 2950 can extend from the radiator 2710 with thermal storage medium being received from and returned to tanks 130 via a cable 2720 that extends through ducting 2704 of a building. In some embodiments, one or more of the heat exchange elements 2900 can be disposed in parallel or in series from the radiator 2704. For example, one or a plurality of separate supply and return tubes 2722, 2724 (see FIGS. 27*b* and 27*c*) can be present in the cable 2704 extending though the ducting 2704, from which thermal storage medium can flow to/from the heat exchange elements 2900 and radiator 2710.

While the example of FIGS. 28 and 29 illustrate an example where a radiator 2710 is associated with ducting 2704 in place of a vent 2702 (see FIG. 27*a* and FIG. 27*b*), in some embodiments a radiator 2710 or other heat exchange element can be absent at the end of the ducting 2704 and one or more sets of lines 2950 and/or cables 2720 can extend from the ducting 2704 to be associated with one or more heat exchange elements 2900 in the room 2800.

As discussed herein, various embodiments include a method of retrofitting a building that has a forced-air HVAC system. For example, one embodiment includes removing forced-air heating and/or cooling system and installing a plurality of tanks 130 together that have the same size and shape (see e.g., FIGS. 9, 13-15, 31, 32*a* and 32*b*). Suitable heat exchange elements and plumbing can be installed in the tanks 130 (see, e.g., FIGS. 17-20) and other elements of the thermal storage system can be installed such as a heat pump 120, and the like. Plumbing can be installed that operably connects the elements of the heat exchange system. Additionally, a plurality of heat exchange cables 2720 can be run through existing forced-air ducting 2704 to one or more locations of vents 2702 in one or more rooms 2800 of the building. One or more heat exchange elements 2900, a radiator 2710, or the like can be installed in the one or more rooms 2800 and coupled to cables 2720 so that thermal storage medium can be introduced to and removed from such heat exchange elements 2900, radiators 2710, or the like, as discussed herein.

Also, while examples of FIGS. 27*a-c*, 28 and 29 illustrate embodiments where a thermal storage system is retrofitted within ducting 2704 of a forced-air system, further embodiments can be configured for new construction. For example, one or more rooms 2800 of a building can comprise one or more receptacles that allow thermal storage medium to flow to/from one or more heat exchange elements 2900 disposed within the one or more rooms 2800.

Additionally, while various examples relate to a single room 2800, it should be clear that a plurality of rooms or other locations can be configured with one or more heat exchange elements 2900 that can be disposed in various suitable objects or portions of a building. For example, heat exchange elements 2900 can be disposed in a floor, wall, ceiling, patio, fence, chair, cabinet, bed, blanket, toilet, shower, bathtub, window, bar, or the like. Also, while various examples discussed herein can relate to a residence, it should clear that other embodiments can be applied to a multi-unit building, a commercial building, vehicles such as a ship, outdoor areas, tents, and the like. Additionally thermal benefits that can be enabled by this design, such as only the spaces being inhabited being heated and the source of heat being close to the body of users. Certain embodiments of such a heat exchanger system can contain large thermal masses (stone, concrete, or the like).

In some embodiments, homes with forced air heating systems (e.g., central air) can comprise a unit that can sit in place of existing furnace infrastructure and still move energy to the home, after it sits in the thermal storage tanks 130. To accommodate homes of various sizes, an air handling unit (AHU) can exist in some examples that can be equipped to handle hydronics fed from one or more thermal storage tanks 130.

Figures 30A, 30B:
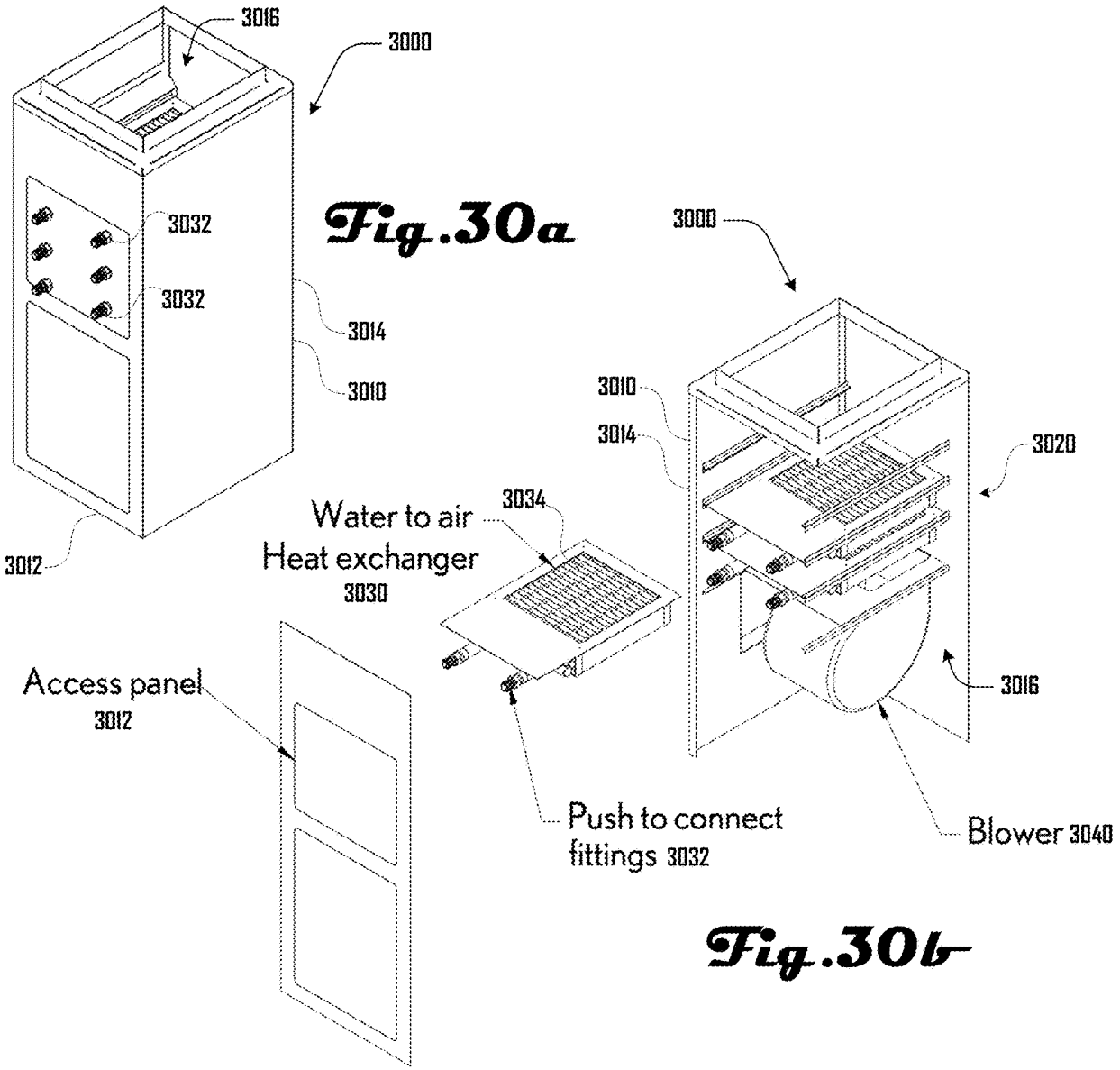
FIG. 30*a* illustrates a perspective view of an air-handling unit and FIG. 30*b* illustrates an exploded view of the air handling unit of FIG. 30*a*.

For example, FIG. 30*a* illustrates a perspective view of an air handling unit 3000 and FIG. 30*b* illustrates an exploded view of the air handling unit 3000, which comprises a housing 3010 that includes an access panel 3012 and one or more sidewalls 2014 that define an internal cavity 3016. The air handling unit 3000 can comprise a racking system 3020 configured for installing one or more heat exchanger layer units 3030. In some embodiments, the number and type of heat exchanger layer units 3030 installed can be configured based on the thermal load on the home. For climate zones where cooling is not needed, simpler, less expensive heat exchangers can be used that may not require plumbing to handle condensation. In various embodiments, the heat exchanger layer units 3030 can comprise a pair of fittings 3032 for flow of thermal storage medium into and out of the heat exchanger layer unit 3030 and a grate 3034 that allows air to pass over a heat exchanger coil (not shown) of the heat exchanger layer unit 3030. Additionally, one or more blowers 3040 can be disposed within the cavity 3020 which can be configured to blow air through the one or more heat exchanger layer units 3030.

The refrigerant used in heat pumps can dictate many conditions under which the refrigerant will operate in various examples. Some refrigerants (e.g., $CO_2$ and the like) can operate best with a very low inlet water temperature in some embodiments. In some examples of a combined heating and domestic hot water (DHW) system, a heat pump may operate most efficiently in some examples if the inlet temperature is cooled by the incoming street water. In various embodiments, this colder water can be piped into the heat pump to increase the efficiency of the system.

For example, FIG. 31 illustrates one embodiment of a thermal storage system 3100 that comprises a first and second tank 130A, 130B, a heat exchange system 3120, and a domestic water system 3140. Domestic utility water (e.g., from a street source) can enter the domestic water system 3140 at a domestic water inlet 3142 and travel into the first tank 130A to the first domestic water heat exchange coil 3144 disposed at the base 614 of the first tank 130A, which can be a cold, colder or coldest portion of a volume of a tank thermal storage medium disposed within the cavity 616 of the first tank 130A below a thermocline threshold. The domestic water can then flow into the second tank 130B to a second domestic water heat exchange coil 3146 at the top of the second tank 130B or at the top of a volume of a tank thermal storage medium disposed within the cavity 616 of the second tank 130B, which may be a hot, hotter or hottest portion of the volume of a tank thermal storage medium disposed within the cavity 616 of the second tank 130B. For example, the cold DHW supply can enter and chill a coldest portion of the thermal storage and then passes through a hottest section of the thermal storage medium, bringing the DHW to a high temp, ready for domestic use.

The domestic water can then flow to an instant hot water unit 3148, which can heat the domestic water to generate hot domestic water for use within the building via a domestic hot water line 3150. For example, to ensure the temperature of the DHW is sufficient for showers, sinks, etc., the DHW passes through the instant hot water heater 3148 before being distributed to the home.

Figure 27C:
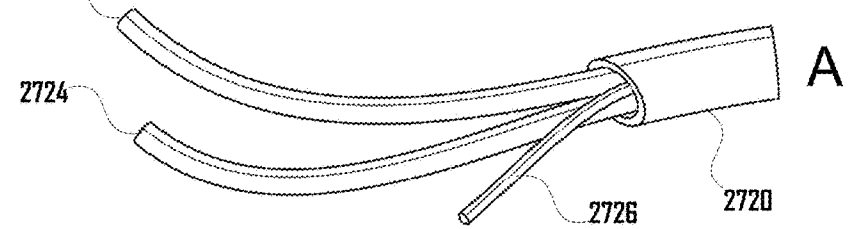
FIG. 27*c* is a close-up illustration of a cable associated with the radiator of FIG. 27*b*.

The heat exchange system 3120 can be configured to cause a working thermal storage medium to flow in and out of the first and second tanks 130A, 130B through first and second heat exchange coils 3122, 3124 where heat exchange can occur between the working thermal storage medium and the tank thermal storage medium disposed within the tanks 130. For example, heated working thermal storage medium can be introduced into working elements (e.g., one or more radiators 2710 as shown in FIGS. 27-29) via a supply line 3126, where heat can be introduced to one or more rooms 2800 of a building, with cooler fluid returning to the portion of heat exchange system 3120 shown in FIG. 31 via a return line 3128. For example, the supply and return lines 3126, 3128 can comprise or be coupled to supply and return tubes 2722, 2724 of one or more 2720 cables (see FIGS. 27*b*, 27*c*, and 29). The heat exchange system 3120 can further comprise a heat pump 120, which as described herein can introduce heat to the working thermal storage medium of the heat exchange system 3120.

Standby losses from a set of one or more tanks 130 can occur gradually because the temperature in the one or more tanks 130 can be higher than the temperature of the surrounding air. Additionally, standby losses can directly correlate to a surface area to volume ratio of the one or more tanks 130 and a volume of thermal storage medium disposed within cavities 616 of the one tanks 130. In other words, higher surface areas can generate larger thermal stand-by losses. Any additional insulation can further decrease the standby losses of the tanks 130.

Figures 32A, 32B, 32C:
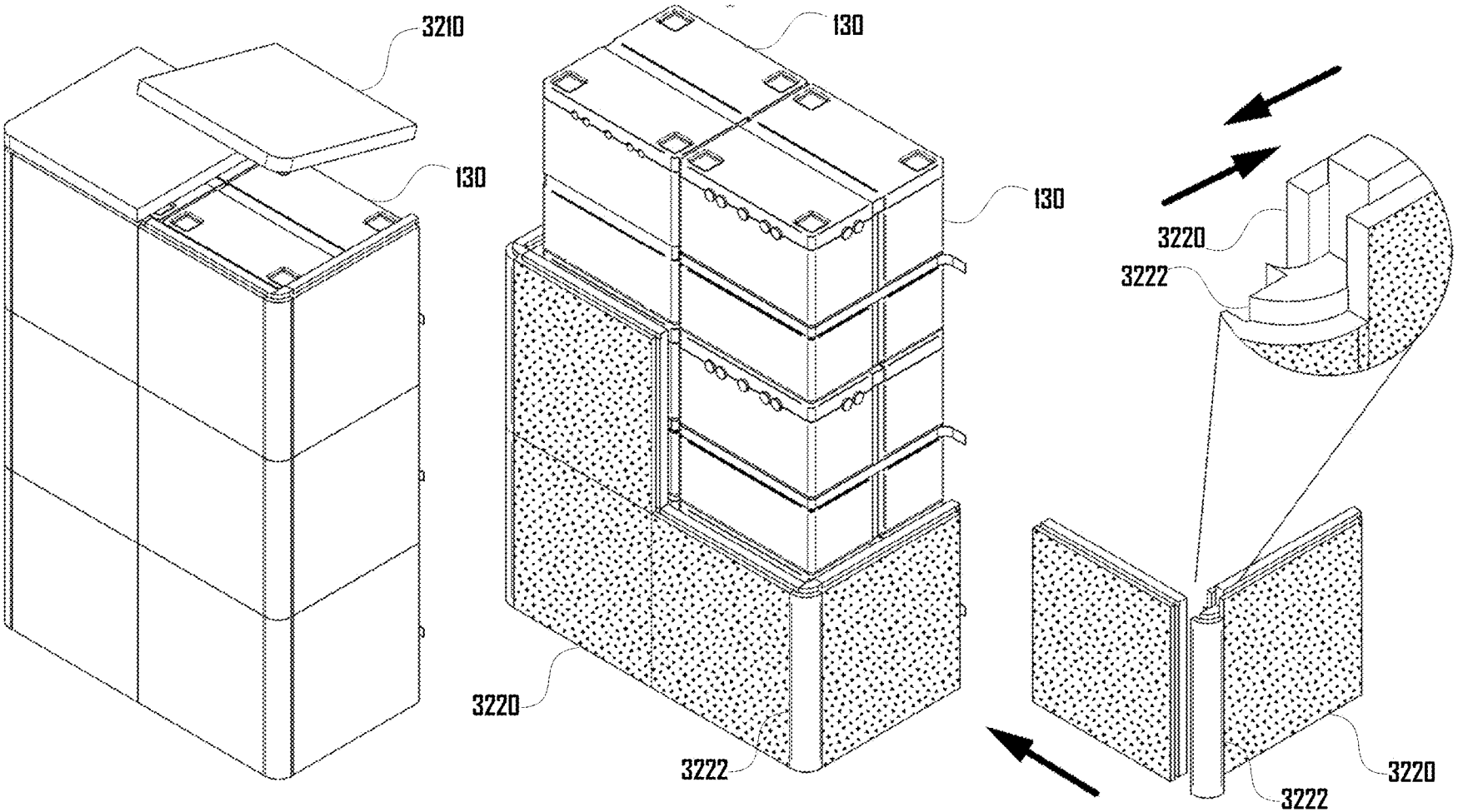
FIG. 32*a* illustrates a blanket insulation disposed over a plurality of grouped tanks.
FIG. 32*b* illustrates insulation sheets with a tongue-and-groove configuration disposed over a plurality of grouped tanks.
FIG. 32*c* illustrates a portion of the tongue-and-groove insulation sheets of FIG. 32*b*.
Figures 33A, 33B, 33C:
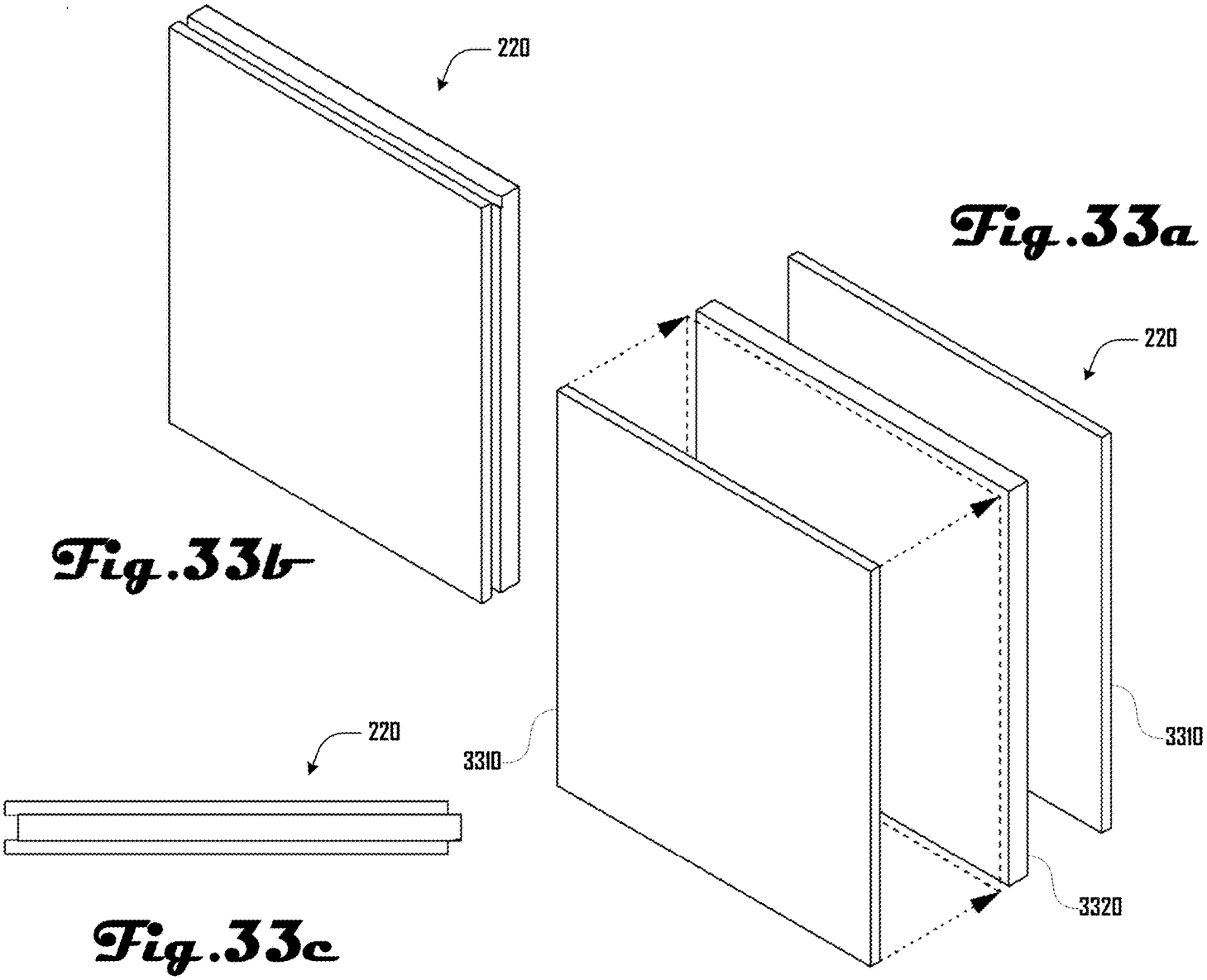
FIGS. 33*a*, 33*b* and 33*c* illustrate layers of the tongue-and-groove insulation material of FIGS. 32*b* and 32*c*.

For example, clumping a set of similar tanks 130 into a unit and then insulating the unit further as a whole can make it possible to see higher efficiencies in some embodiments without wasting space and materials. For example, once a set of tanks 130 are installed and plumbed, additional layers of insulation may be added to the system as a whole. Insulation of various suitable types can be used, including an inflatable blanket-like insulation 3210 as shown in FIG. 32*a* or thick sheets 3220 with a tongue-and-groove design allowing them to easily lock together to each other and edge pieces 3222 as shown in FIGS. 32*b* and 32*c*. Such a sheet 3220 can be fabricated and can comprise a plurality of layers 3310, 3320 as shown in FIGS. 33*a*, 33*b* and 33*c*. For example, sheets of a first insulation sheet 3310 can be disposed on opposing sides of a second insulation sheet 3320 with an offset to generate a tongue-and-groove design.

Figure 34A:
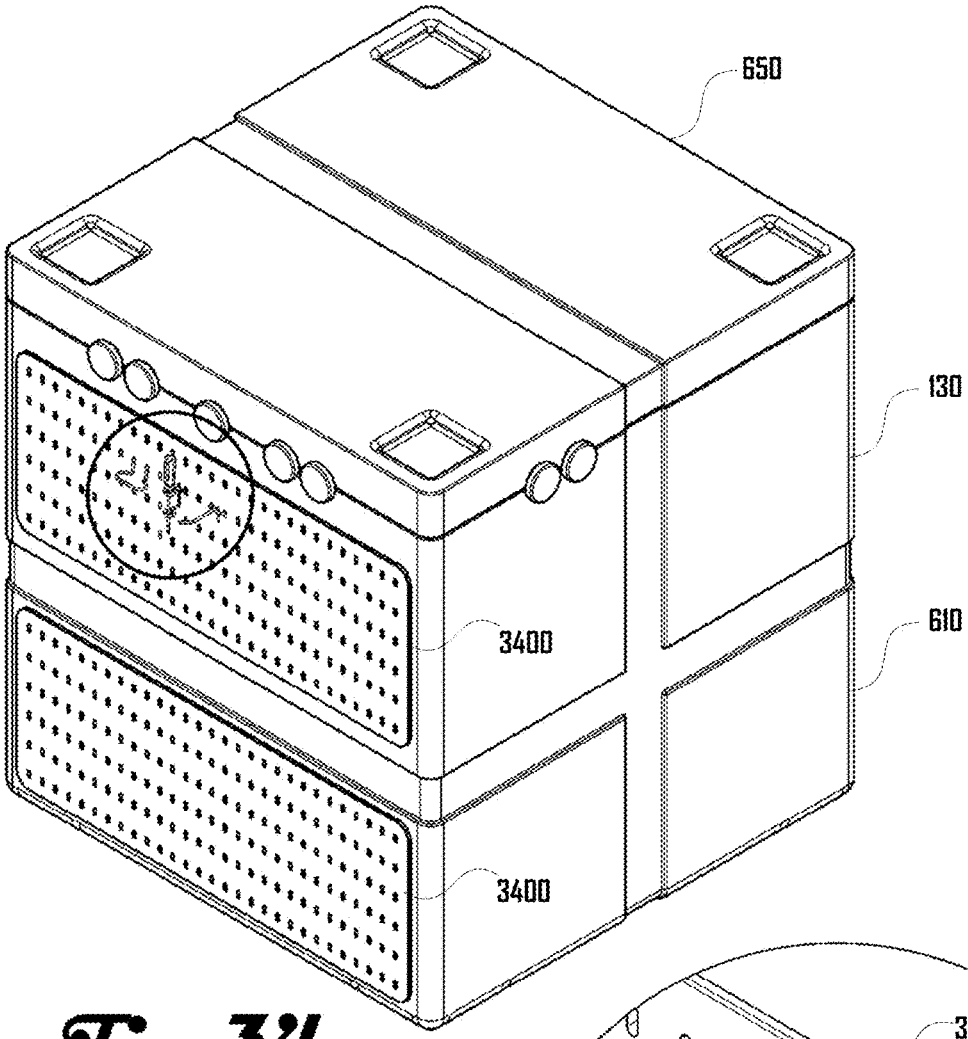
FIG. 34*a* illustrates a pegboard or French cleat clad surface on the exterior of a tank.
Figure 34B:
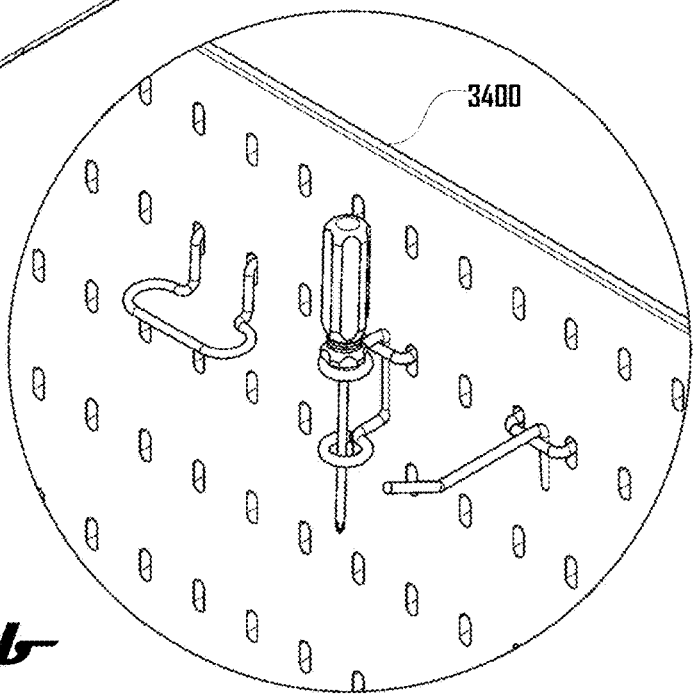
FIG. 34*b* illustrates a close-up view of a portion of FIG. 34*a*.

For embodiments of the tanks installed in a garage, a surface can be applied to the tanks to give them additional use in a domestic environment. For example in some embodiments, such as shown in FIGS. 34*a* and 34*b*, a pegboard or French cleat clad surface 3400 can allow users to affix tools or other objects to the exterior of a tank 130 without damaging the exterior of the tank 130. Given the nature of various embodiments of tanks 130, and the contents that such tanks 130 may store (e.g., liquids), it can be desirable in some examples to maintain a sealed interior such as via a lid 650 sealed to the tank body 610.

Some embodiments of heat pumps can require high voltage and amperage power supplies (e.g., a minimum of 240V and 15 amps). It is possible in some embodiments, however, to pair heat pumps with lower capacities and thus smaller voltage requirements. These heat pumps, for example, can run off the 110V power that is found in American homes, which can simplify the electrical work needed to install a thermal storage system.

Figure 35:
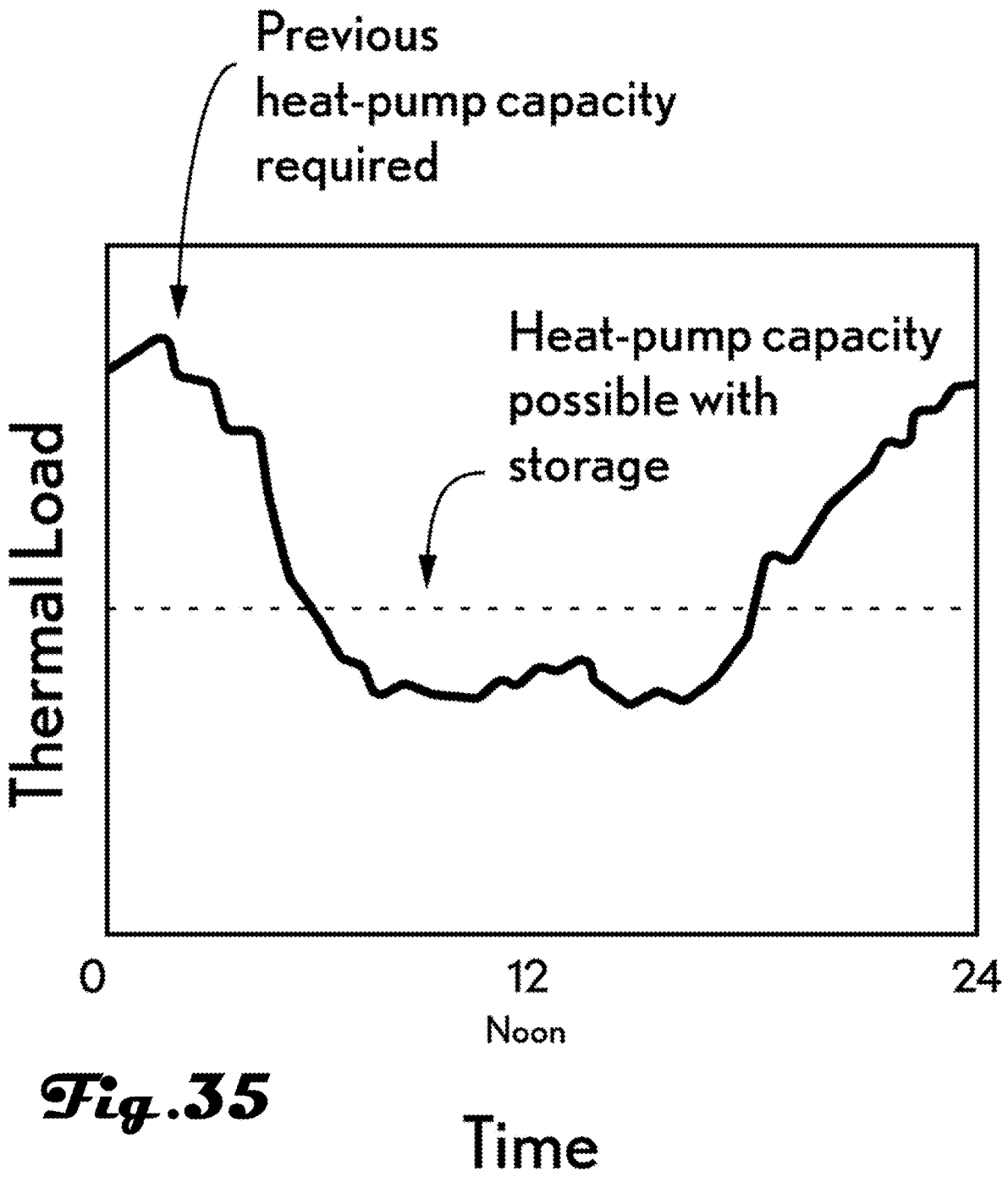
FIG. 35 is a graph of thermal load over time illustrating a lower heat-pump capacity necessary in some embodiments of a thermal storage system discussed herein compared to other heat systems.

Along this vein, thermal storage in some examples can additionally enable the system to operate based on the average thermal load on a building, as opposed to the peak thermal load (which HVAC equipment may be sized for). For example, FIG. 35 is a graph of thermal load over time illustrating a lower heat-pump capacity necessary in some embodiments of a thermal storage system discussed herein compared to other heat systems.

A mismatch between renewable energy generation and demand can create a supply and demand problem. A form of combating such a supply and demand mismatch can be the introduction of time-of-use or dynamic-energy pricing. In such a structure, end users or electricity customers ("ratepayers") can pay a variable rate for electricity from the grid depending on the time of day, and the additional economics of electricity supply and demand from generation, transmission, and distribution.

This relationship can provide an opportunity to leverage energy storage via a thermal energy storage system as discussed herein to give ratepayers and third-party intermediaries the economic incentive to curtail and time shift their energy consumption. This leverage opportunity can take several forms and can be referred to as 'arbitrage.' Response to these price signals can rely on active behavior change from ratepayers or can provide automated demand-responsive services. In some existing utility programs, the former (relying on a change in behavior) yields lower efficacy while the latter is typically reserved for commercial buildings with dedicated energy management systems.

In various embodiments, a computing device of a thermal storage system can allow premise locations (e.g., house, multi-family dwelling, apartment, small commercial, school, etc.) to respond to changes in rate structures, peak and off-peak rates, and demand curtailment incentive programs (also known as demand-response programs), and in various examples without any or substantial compromise or noticeable difference in the desired thermal experience of the building occupants.

To achieve this, the computer device of the system can receive pricing and demand response data from a utility or independent/regional system operators via direct, Advanced Distribution Management System (ADMS), Distributed Energy Resources Management System (DERMS) platforms, or the like. Such data can be pushed from electricity providers and the computer device can control the thermal storage system to respond and predict when load shifting is economically beneficial. As this occurs, the energy needed to provide consistent and expected services to ratepayer premise locations can be consumed by the thermal storage system prior to a high rate or demand response event. The computer device of the system can automate the consumption of energy and can decouple demand from the grid and demand within the premise location (e.g., house, building, facility). In other words, in various examples, energy can be drawn from the grid and/or from localized generation (e.g., rooftop solar PV, community solar, or local micro-grid) and the thermal storage system can store thermal energy in one or more tanks 130 by heating a thermal storage medium in the one or more tanks 130, where such thermal energy can be stored until it is requested by the premise such as use in a radiator 2710 (see FIGS. 27*b*, 28 and 29), or the like.

Figure 36:
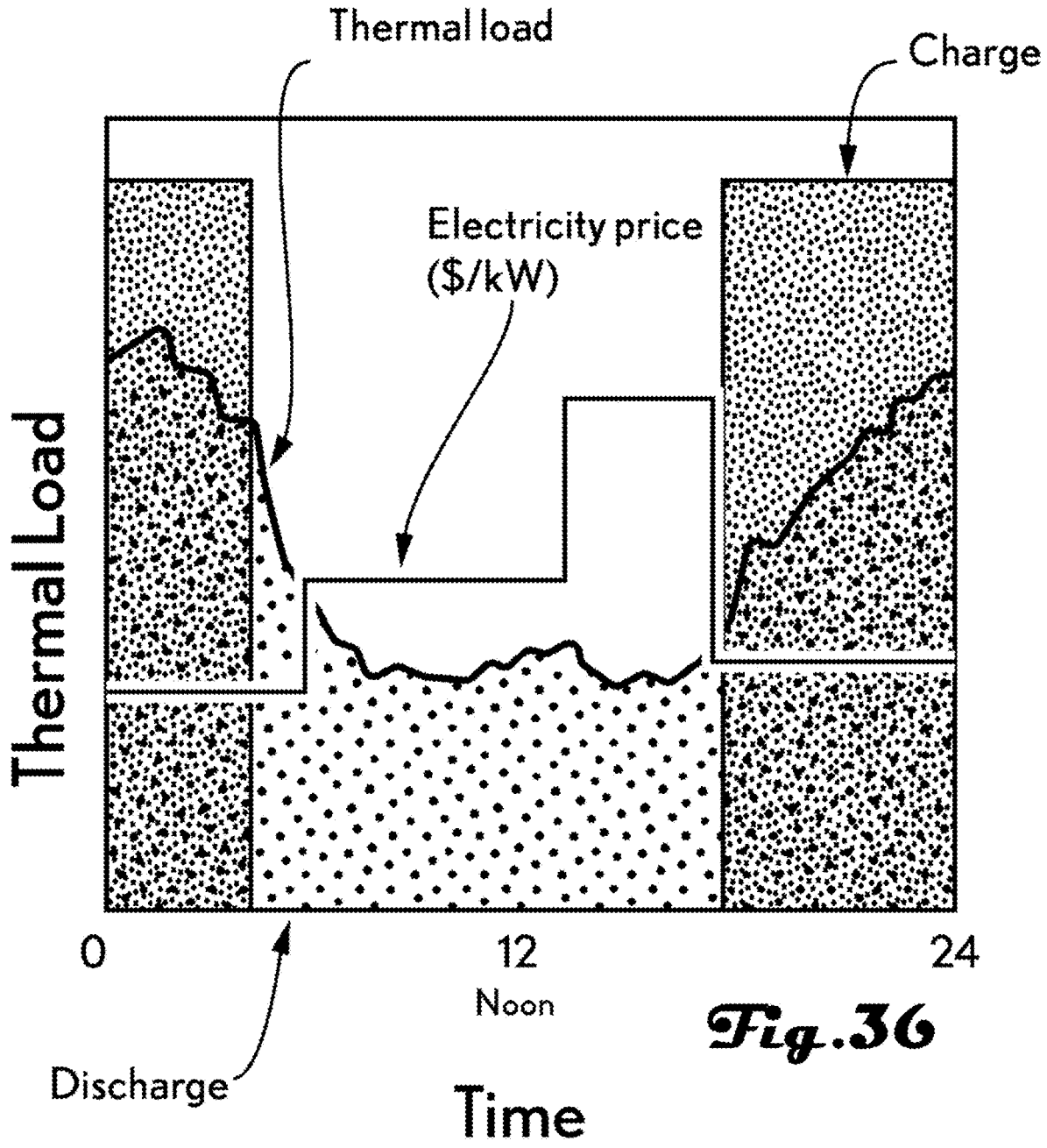
FIG. 36 is a chart that illustrates an example of how thermal load can be charged and discharged based on grid electricity price, which in some embodiments can be automated by a computing device of the thermal storage system.
Figure 37:
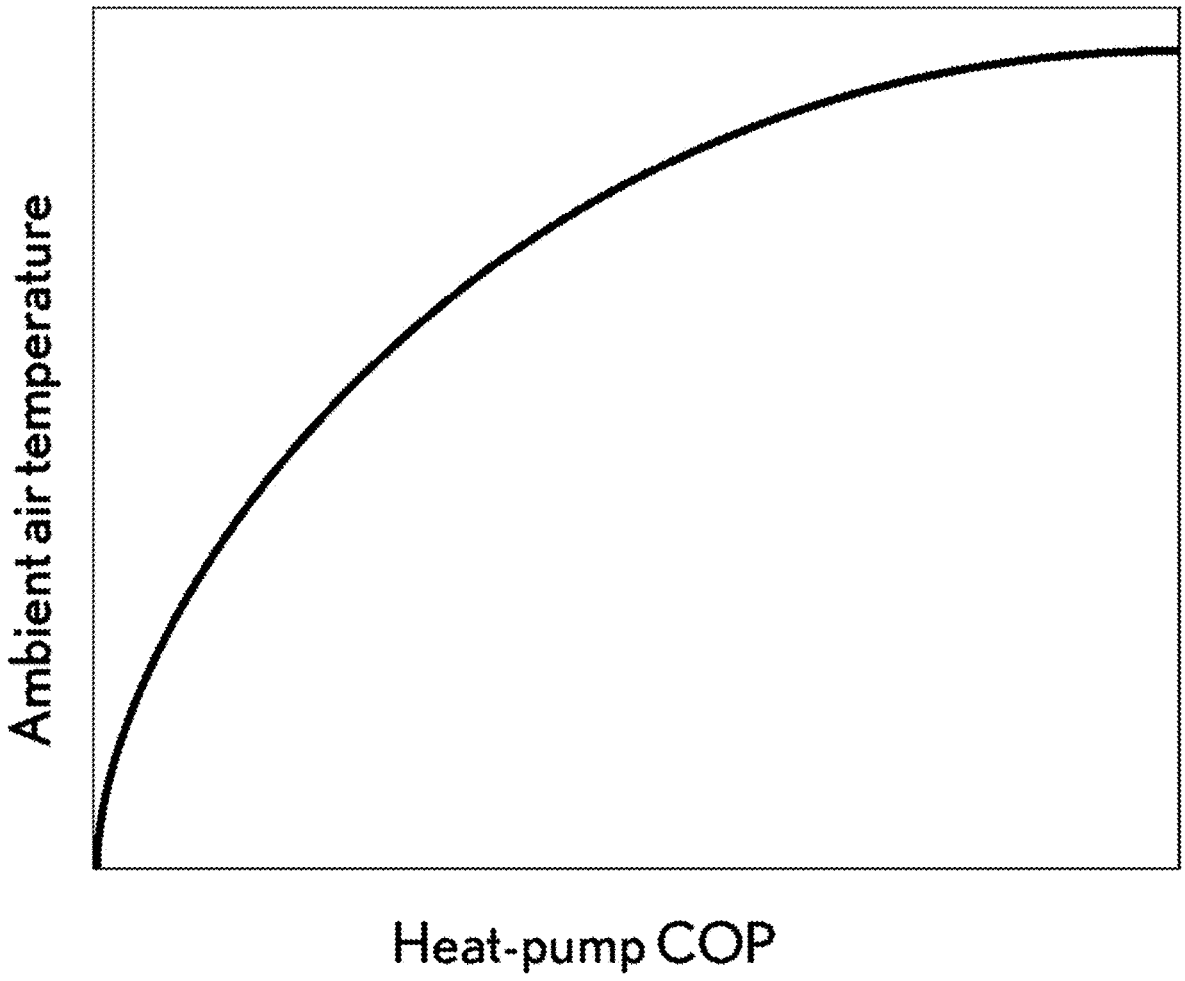

In various embodiments, the computer device can utilize predictive analytics to anticipate electricity generation availability and premise-level demand based on historical demand data from the premise (e.g., building), from historical demand data of a plurality of premises, or the like. For example, the thermal storage system can store the energy needed for an HVAC system as needed and adjust to changing time-of-use rates through a utility interface. FIG. 36 is a chart that illustrates an example of how thermal load can be charged and discharged based on grid electricity price, which in some embodiments can be automated by a computing device of the thermal storage system.

Figure 37:
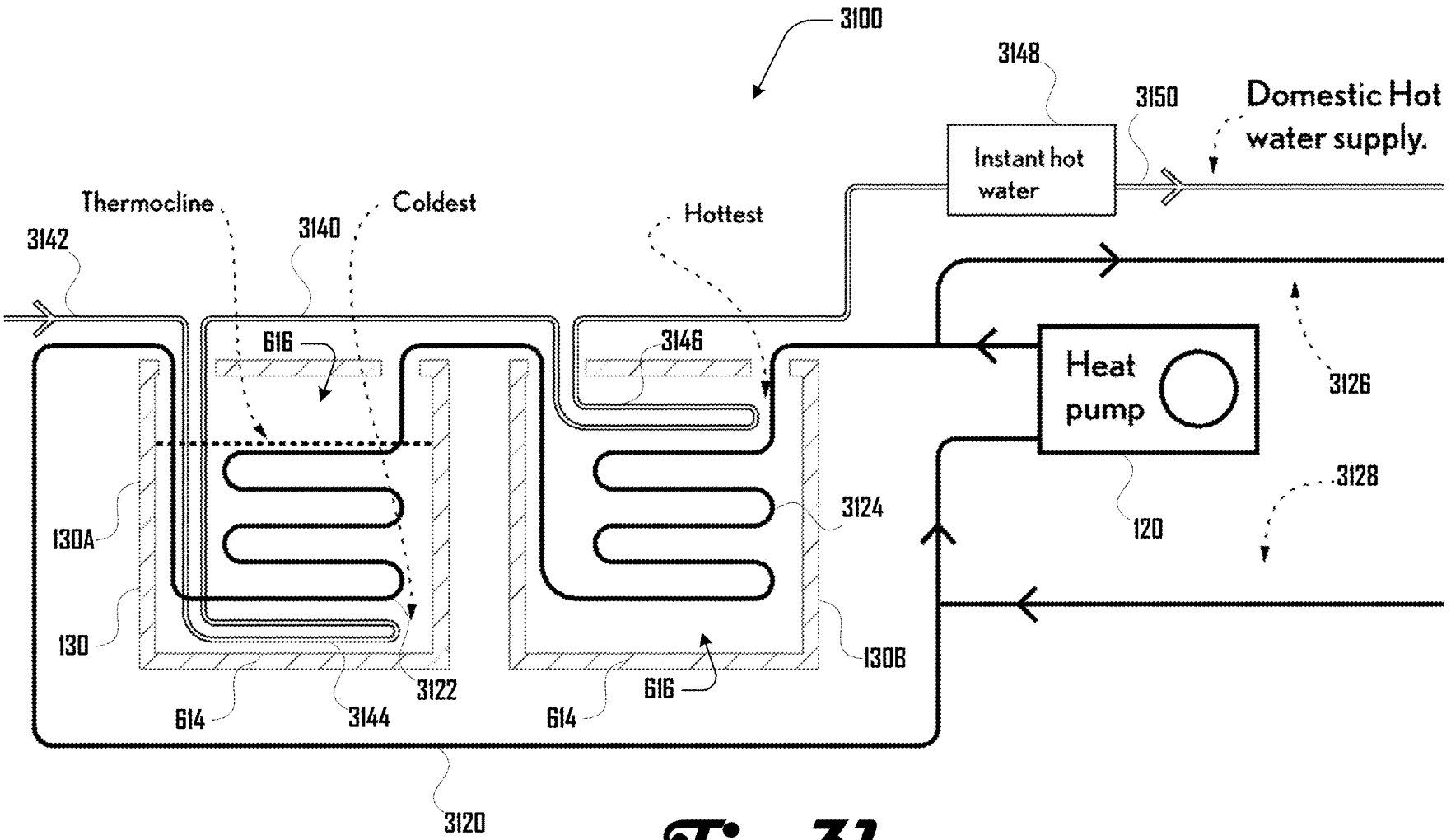
FIG. 37 is a graph illustrating an example relationship between ambient air temperature and Coefficient of Performance (COP) of a heat pump.

Heat pumps can operate by running a compression-expansion cycle of refrigerants to "pump" energy from one region to another. This principle can be what gives heat pumps beneficial efficiencies; however, these efficiencies can directly correlate to the source temperature leading to the heat pump 120. For ground source heat pumps, in some examples this temperature can depend on the soil normal temperature, and in some examples, air-source heat pumps can depend on ambient air temperatures. Such a relationship can depend on the refrigerants in use and other factors. For example, FIG. 37 is a graph illustrating an example relationship between ambient air temperature and Coefficient of Performance (COP) of a heat pump 120.

Figure 38:
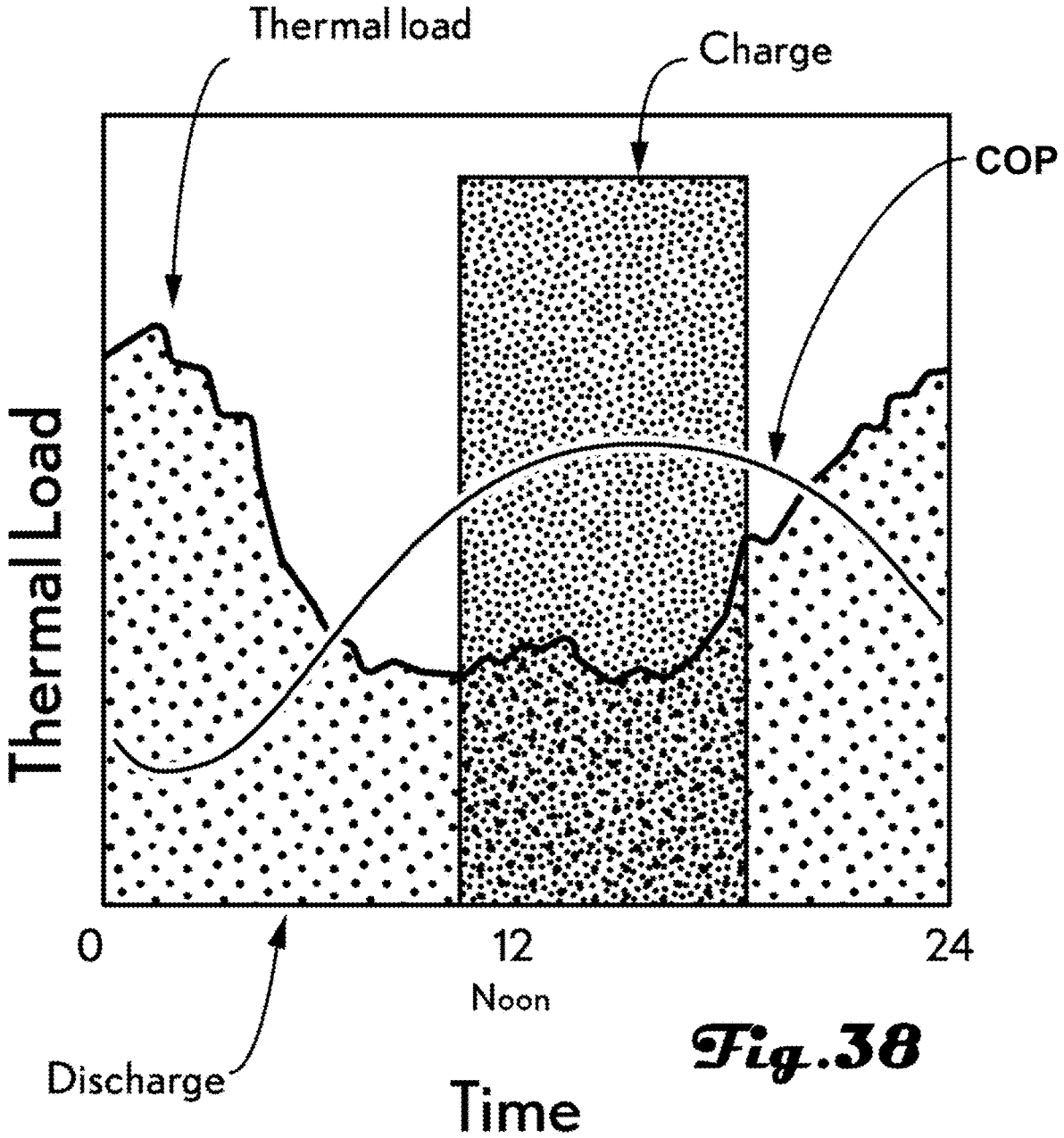
FIG. 38 is a chart illustrating selective charging and discharging of thermal load of a thermal storage system based on a Coefficient of Performance (COP) of a heat pump.

Accordingly, arbitrage can be achieved in some embodiments through the selective operation of the heat pump 120 when Coefficient of Performance is determined to be highest or above a threshold value. For example, FIG. 38 is a chart illustrating selective charging and discharging of thermal load of a thermal storage system based on a Coefficient of Performance (COP) of a heat pump 120.

A computer device of a thermal storage system can optimize for costs and efficiency in various other suitable ways. For example, some embodiments of the thermal storage system can follow a mixed arbitrage method that leverages various suitable types of data to provide the greatest or increased savings to the customer, the environment, and/or the grid.

Figure 39:
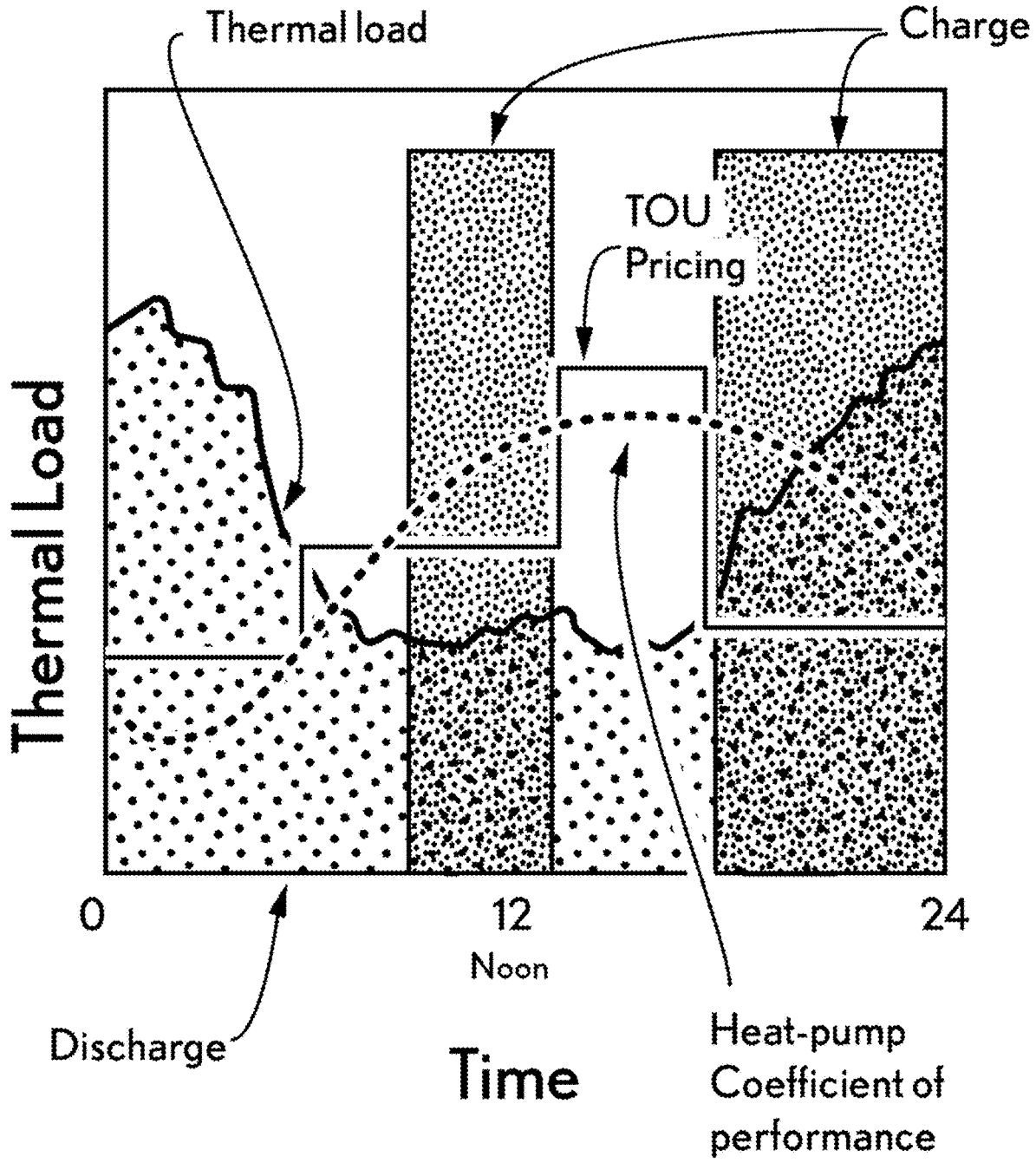
FIG. 39 is a chart illustrating selective charging and discharging of thermal load of a thermal storage system based on a Coefficient of Performance (COP) of a heat pump and grid electricity price or time of use (TOU) rates.

Various efficiency settings, thresholds or parameters can be set (e.g., by a user or remotely by the grid) for the thermal storage system, which can define one or more efficiency parameters that the thermal storage system should be configured to optimize for. Such examples can be considered 'mixed arbitrage' methods in various examples and can change the cycle under which a heat pump 120 operates. For example, FIG. 39 is a chart illustrating selective charging and discharging of thermal load of a thermal storage system based on a Coefficient of Performance (COP) of a heat pump 120 and grid electricity price or time of use (TOU) rates.

Accordingly, in various embodiments, a computer device of a thermal storage system can implement a method of operating the thermal storage system based at least in part on one or more of thermal load of one or more tanks 130, COP of a heat pump 120 and/or grid electricity price or time of use (TOU) rates. For example, one such method can comprise obtaining or determining thermal load of one or more tanks 130, COP of one or more heat pump 120 and/or grid electricity price or TOU rates; determining whether to charge and/or discharge a thermal charge of one or more tanks 130 based at least in part on the thermal load of one or more tanks 130, COP of the one or more heat pump 120 and/or grid electricity price or TOU rates; and causing the thermal storage system to charge and/or discharge a thermal charge of one or more tanks 130 based at least in part on the determination.

Using the illustration of FIG. 36 as an example, data indicating electricity price or a projection of electricity price can be obtained, and if the electricity price is below a threshold for a defined amount of time, then a determination can be made to charge the system (shown in dark shading) by adding thermal energy to one or more tanks 130 and/or working thermal storage medium (e.g., via an electric heat pump 120); however, if the electricity price is above a threshold for a defined amount of time, then a determination can be made to allow discharge of the system where necessary (e.g., removing thermal energy from one or more tanks 130 to be discharged into one or more rooms of a building as discussed herein) and/or not charge the system (e.g., via an electric heat pump 120).

For example, where the cost of electricity from the electrical grid is low or anticipated to be low, it can be desirable to take the opportunity to charge one or more tanks 130 via an electric heat pump 120 and/or use an electric heat pump 120 to heat working thermal storage medium that is being used to heat a building (e.g., via one or more radiators 2710 as discussed herein). This can be desirable because thermal energy can be generated and stored for later use via the one or more tanks 130, for when the cost of electrical energy is higher. Where the cost of electricity from the electrical grid is determined to be above or is anticipated to be above a threshold amount for a certain period of time, then a determination can be made to not use the heat pump 120 to charge the system and/or heat working thermal storage medium that is being used to heat a building. Accordingly, where heating the building is necessary, thermal energy from one or more tanks 130 can be discharged to the working thermal storage medium via heat exchange. This can be desirable to save cost on heating the building by using thermal energy generated when electrical costs were lower.

While in some examples a determination of electrical rates can be based on rates reported in real time or at various times during a day, in some embodiments, operation of a thermal storage system can be based on anticipated changes in rates throughout the day and not based on rate data received that day. For example, rate schedules based on time, day of the week, month, season, weather, or the like can be used to determine anticipated or actual rates over a given time period. Accordingly, in some embodiments, operation of a thermal storage system can be based on times and/or schedules corresponding to electrical rate changes. Additionally, as discussed herein, determined cost of electrical power from the grid can be used to determine whether to switch to or rely only on locally generated electrical power such as via solar panels, wind turbines, water turbines, fuel-based generator, or the like.

Using the illustration of FIG. 38 as another example, data regarding Coefficient of Performance (COP) of one or more heat pumps 120 or other data regarding efficiency or inefficiency of various portions of a thermal heat storage system can be obtained, and if an efficiency value is, or is anticipated to be, below a threshold for a defined amount of time, then a determination can be made to charge the system (shown in dark shading) by adding thermal energy to one or more tanks 130 and/or working thermal storage medium (e.g., via an electric heat pump 120); however, if the efficiency value is, or is anticipated to be, below a threshold for a defined amount of time, then a determination can be made to allow discharge of the system where necessary (e.g., removing thermal energy from one or more tanks 130 to be discharged into one or more rooms of a building as discussed herein) and/or not charge the system (e.g., via an electric heat pump 120).

For example, where a heat pump 120 is or is anticipated to operate at an efficiency above a certain threshold for a certain period of time, it can be desirable to take the opportunity to charge one or more tanks 130 via the heat pump 120 and/or use the heat pump 120 to heat working thermal storage medium that is being used to heat a building (e.g., via one or more radiators 2710 as discussed herein). This can be desirable because thermal energy can be generated and stored for later use via the one or more tanks 130, for when one or more heat pumps 120 will be operating most efficiently and requiring less electrical energy to generate more thermal energy than other times. Where the heat pump 120 is or is anticipated to operate at an efficiency below a certain threshold for a certain period of time, then a determination can be made to not use the heat pump 120 to charge the system and/or heat working thermal storage medium that is being used to heat a building. Accordingly, where heating the building is necessary, thermal energy from one or more tanks 130 can be discharged to the working thermal storage medium via heat exchange. This can be desirable to save cost on heating the building by using thermal energy generated when electrical costs were lower due to heat pumps 120 being able to run more efficiently.

In some embodiments, efficiency of one or more heat pumps 120 can be determined based on a determination of electrical input compared to thermal energy generation or output from the one or more heat pumps 120 (e.g., from the heat pumps 120 directly, at one or more tanks 130, in working thermal storage medium, or the like). In further embodiments, efficiency can be determined based on one or more determined or expected environmental conditions such as temperature, humidity, or the like. For example, data from one or more environmental sensors, or time of day, season or year along with expected or reported weather condition can be used to determine expected efficiency of heat pumps 120 or other portions of a thermal storage system.

Additionally, using the illustration of FIG. 39 as a further example, in some embodiments, data regarding actual or expected efficiency along with data regarding expected or actual electric energy cost can be used to control a thermal storage system. For example, a score can be generated based on efficiency and energy cost, and such a score being above or below a defined threshold can determine operation of the thermal storage system as discussed herein.

State of thermal charge of a thermal storage system can be defined and determined in various suitable ways. For example, state of thermal charge can be based on temperature or average temperate of a thermal storage medium in one or more tanks 130 along with the volume of the thermal storage medium present in the one or more tanks 130. Temperature or average temperature can be determined by one or more sensors as discussed herein, and volume can be determined based on a float or other suitable volume or level sensor. In some embodiments, thermal charge of a thermal storage system can comprise a determination of thermal energy present in working thermal storage medium being used to heat a building, temperature of a heat pump 120, or the like.

Figure 40:
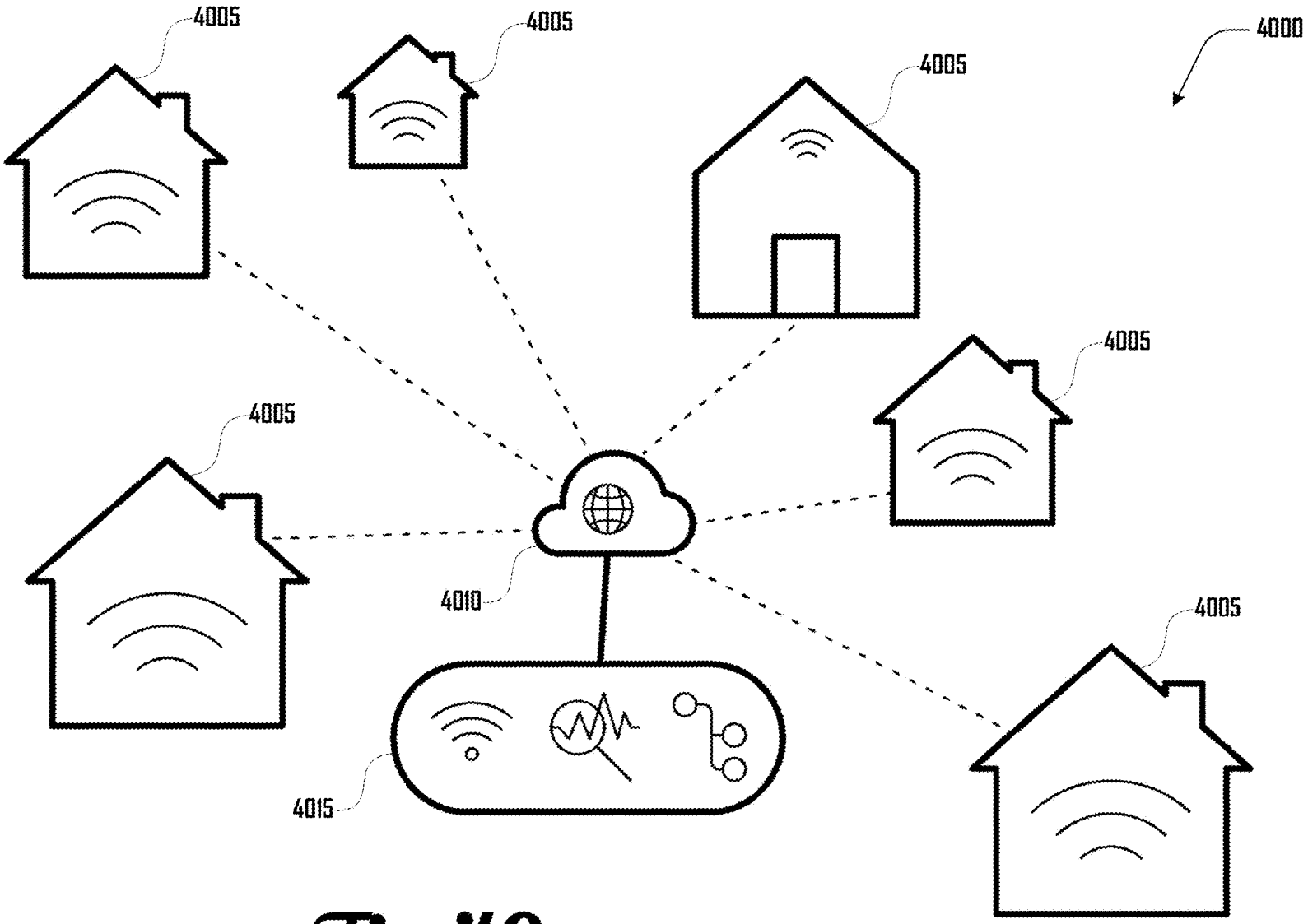
FIG. 40 illustrates a thermal storage system network that comprises a plurality of separate thermal storage systems that are operably connected via a communication network.

In various embodiments, a plurality of separate thermal storage systems can share data, which can be used to understand thermal loads of the homes in an area in real time or historically; used to determine separate thermal storage systems of specific homes that are performing above or below average; allow for improved interaction with the electrical grid, and the like. For example, FIG. 40 illustrates a thermal storage system network 4000, that comprises a plurality of separate thermal storage systems 4005 (e.g., via respective computer devices of the thermal storage systems 4005) that are operably connected via a communication network 4010. The communication network can comprise a wired and/or wireless network, which can include Wi-Fi, Bluetooth, the Internet, a Local Area Network (LAN), a Wide Area Network (WAN), or the like.

The thermal storage system network 4000 can further comprise a thermal storage server 4015 that can comprise one or more physical or virtual servers that can be remote from the plurality of thermal storage systems 4005. In various embodiments, the thermal storage server 4015 can be configured to receive data from the plurality of thermal storage systems 4005 and send data, control instructions, software updates, and the like, to the plurality of thermal storage systems 4005.

For example, data used to determine local control of a thermal storage system 4005 can be provided to the thermal storage system by the thermal storage server 4015, such as actual or expected, electrical rate data, weather data, actual or expected system efficiency data, a score based on rate and efficiency data, and the like. In some examples, the thermal storage server 4015 can determine and directly control how respective thermal storage systems 4005 operate, which can include causing the plurality of thermal storage systems 4005 to operate the same or for one or more of the thermal storage systems 4005 to operate differently based on different conditions at the respective thermal storage systems 4005. For example, the thermal storage server can receive data from the thermal storage systems 4005 such as volume of tank and working thermal storage medium, thermal charge of the thermal storage systems 4005, local environment conditions at the thermal storage systems 4005, and the like, and the thermal storage server 4015 can control the respective thermal storage systems based on such data.

The thermal storage systems 4005 of a thermal storage network 4000 can be located in various locations and various locations relative to each other. For example, in some examples, one or more thermal storage systems 4005 can be located in different or the same continents, countries, states, counties, cities, towns, areas, blocks, streets, building, or the like. In some examples, thermal storage systems 4005 can be controlled or provided data in groups based on location. For example, local or regional weather, environmental conditions and/or electrical rates can allow one or more thermal storage systems 4005 to be provided data or operated differently.

In certain embodiments of an installed or retrofitted system discussed above, a building that will have a thermal storage system installed in it may already have existing thermostats, sensors, and heating distribution systems in place. A retrofit and replacement of these units is possible but can be expensive and time consuming in some embodiments, plus, it may be difficult to complete non-intrusively, which may make such an embodiment less-desirable. Accordingly, various embodiments include a control mechanism (e.g., a computer device) that can properly predict and adapt to changing thermal loads without any embedded sensors or controllers in the building itself. This can work in some examples by treating the building (e.g., residential or commercial) as a black box, and collecting data on the energy requested by the home for some or all thermal end uses (e.g., heating, cooling, domestic hot water, and the like).

Figure 41:
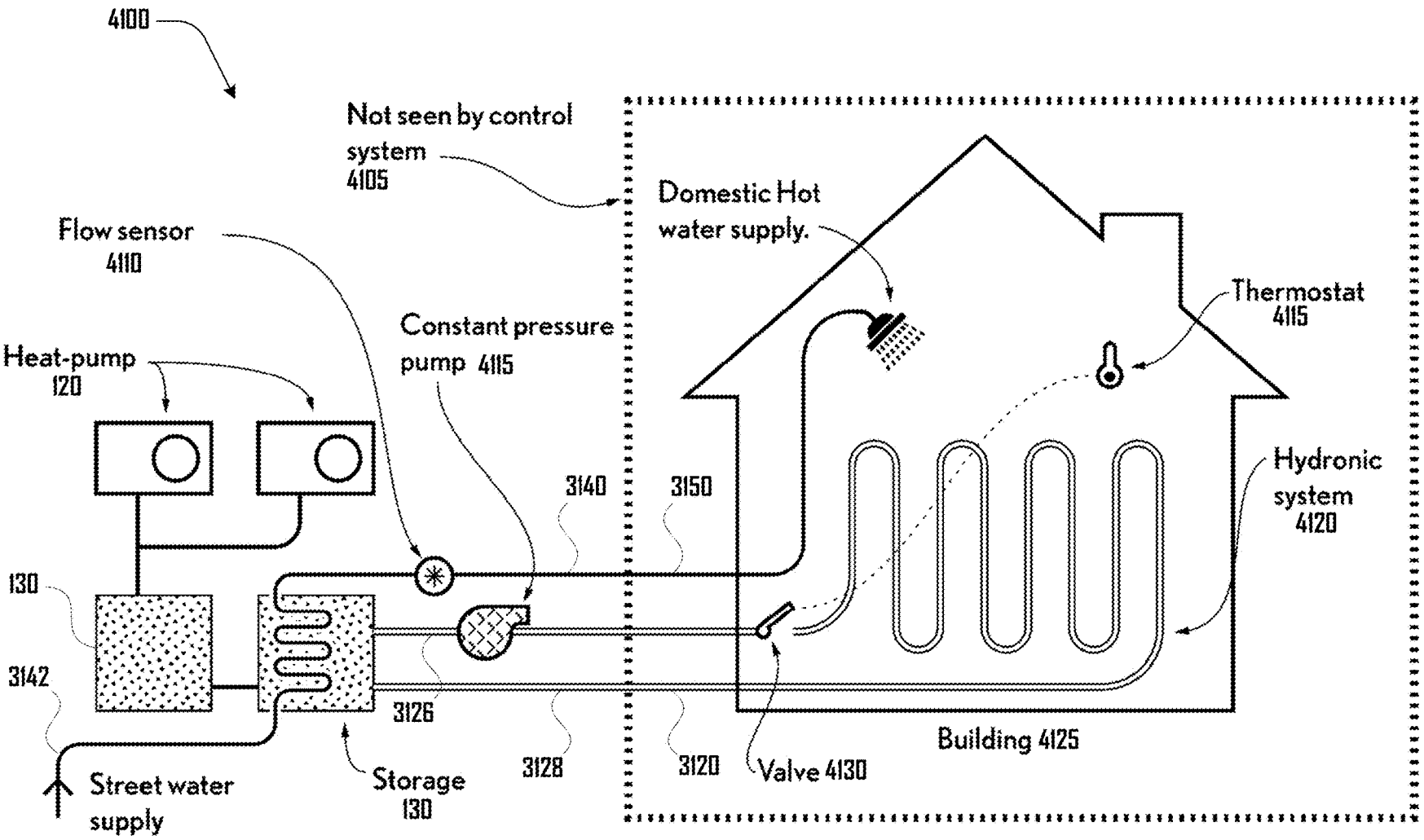
FIG. 41 illustrates a thermal storage system that comprises a portion that is not directly observable by a computer device or other control system of the thermal storage system where such a portion can be treated as a "black box."

For example, FIG. 41 illustrates a thermal storage system 4100 that comprises a portion 4105 that is not directly observable by a computer device or other control system of the thermal storage system 4100 (e.g., elements of the system portion 4105 can lack sensors that provide information about such elements directly) and such a portion 4105 can be treated as a "black box."

In some embodiments, flow rate (e.g., via flow sensor 4110) and/or temperature (e.g., via thermostat 4115) on the supply to the home's domestic hot water system 3140 can be determined. A constant pressure pump 4115 leading to a hydronic system 4120 such as hydronic floors or hydronic air handling units (e.g., radiators 2710, coils 2900, or the like) can also be used to determine flow rate of working thermal storage medium. When thermal energy is requested to the building 4125, one or more downstream valves 4130 can open and the constant pressure pump 4115 can initiate circulation of thermal energy to the building 4125 via flow of working thermal storage medium.

Building materials and methods are rapidly changing. In various embodiments, it can be desirable to build homes on ground screws or helical piles as they are an environmentally conscious alternative to concrete for foundations.

Air-source heat pumps operating in cold climates can experience low COP's during winter months because the ambient air temperature can be low in some examples. An alternative to air-source heat pumps are ground-source heat pumps which can rely on moderate subterranean soil temperatures year round to maintain solid heat pump efficiencies. Some embodiments of such systems can be incredibly expensive and can require heavy machinery to dig vast trenches or large drilling machines to core deep into the ground nearby.

Figure 42C:
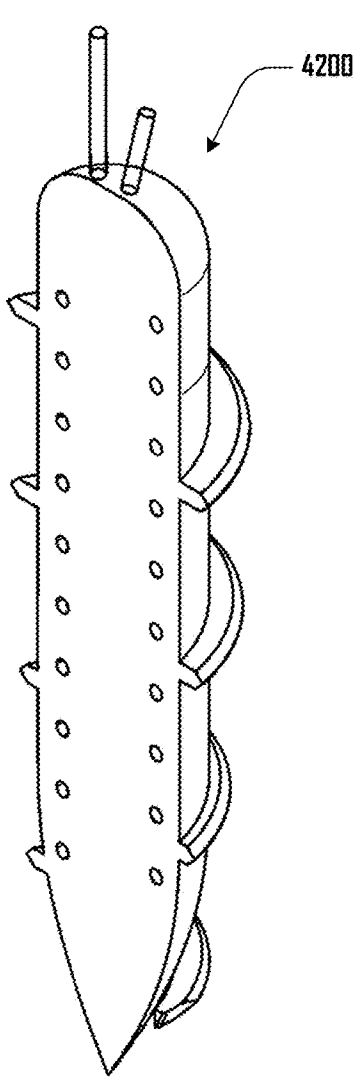
FIG. 42*c* illustrates a cross-sectional view of the ground screw of FIGS. 42*a* and 42*b*.
Figure 42B:
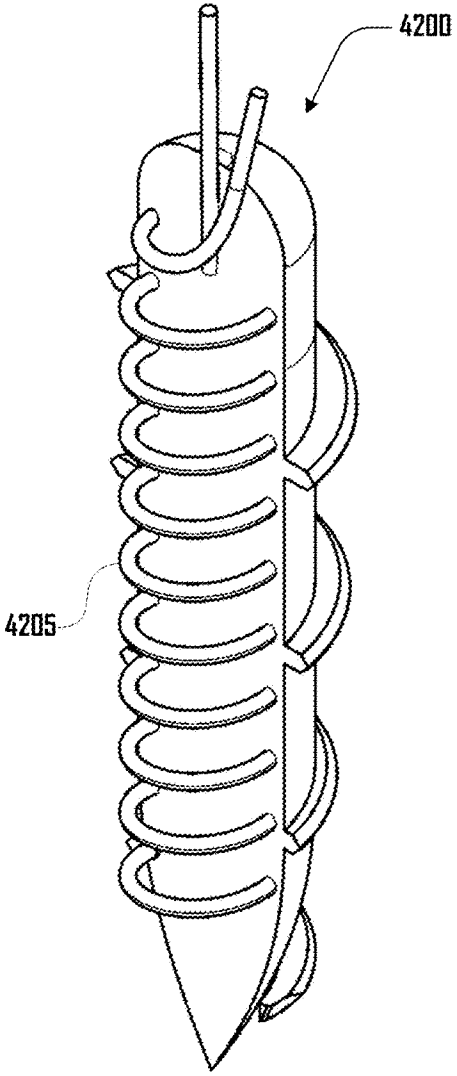
FIG. 42*b* illustrates a partial cutaway view of the ground screw of FIG. 42*a*.
Figure 42A:
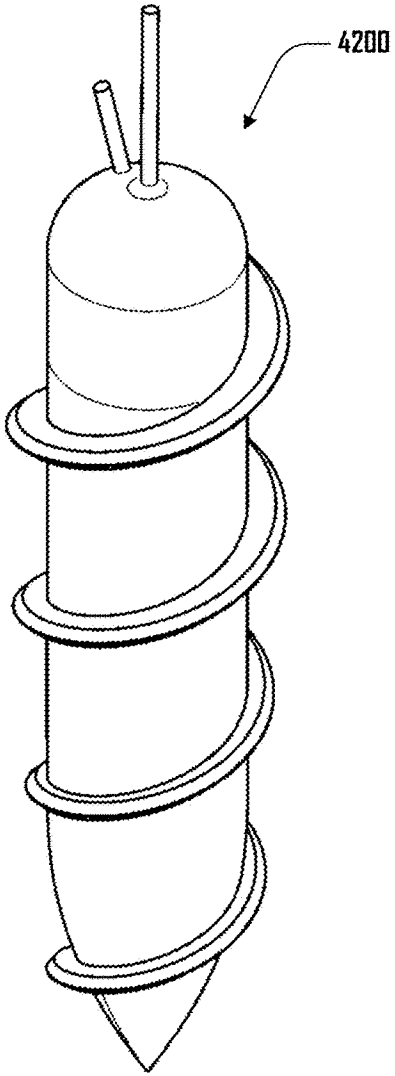
FIG. 42*a* illustrates a perspective view of a ground screw.
Figure 43:
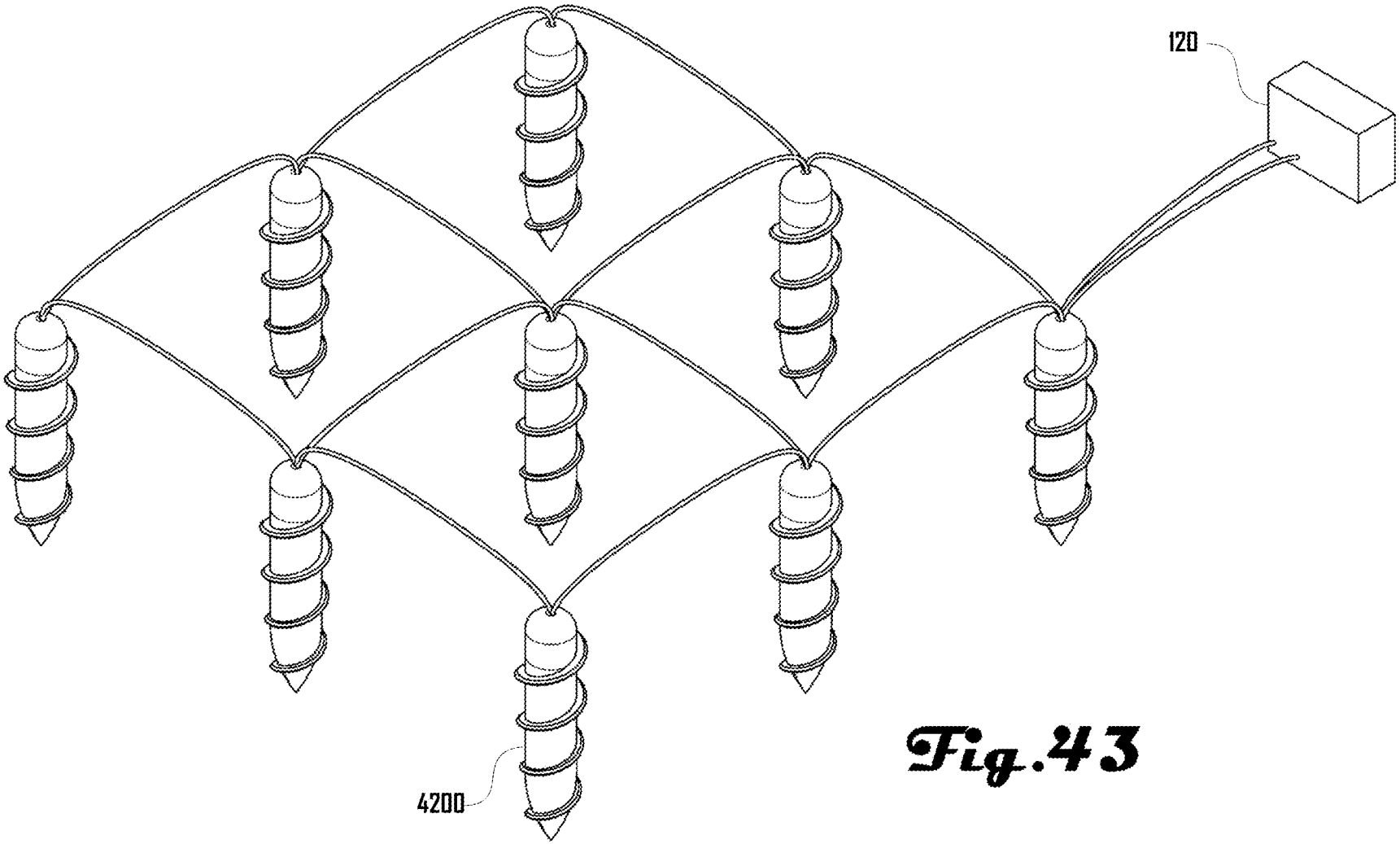
FIG. 43 illustrates ground loops piped into a ground-source heat pump.

In some embodiments, a ground screw (e.g., ground screw 4200 as shown in FIGS. 42*a-c*) can be used as a heat transfer device to inexpensively install ground loops 4205 in the soil or other medium. These ground loops 4205 can be piped into a ground-source heat pump 120 as shown in FIG. 43 to increase the COP of the ground-source heat pump 120. Such ground screws 4200 in some examples can be easily installed with torque-drivers or large poles, and a large surface area of metal and fins to dig into the ground can provide a large surface area over which heat transfer may take place.

Figure 44A:
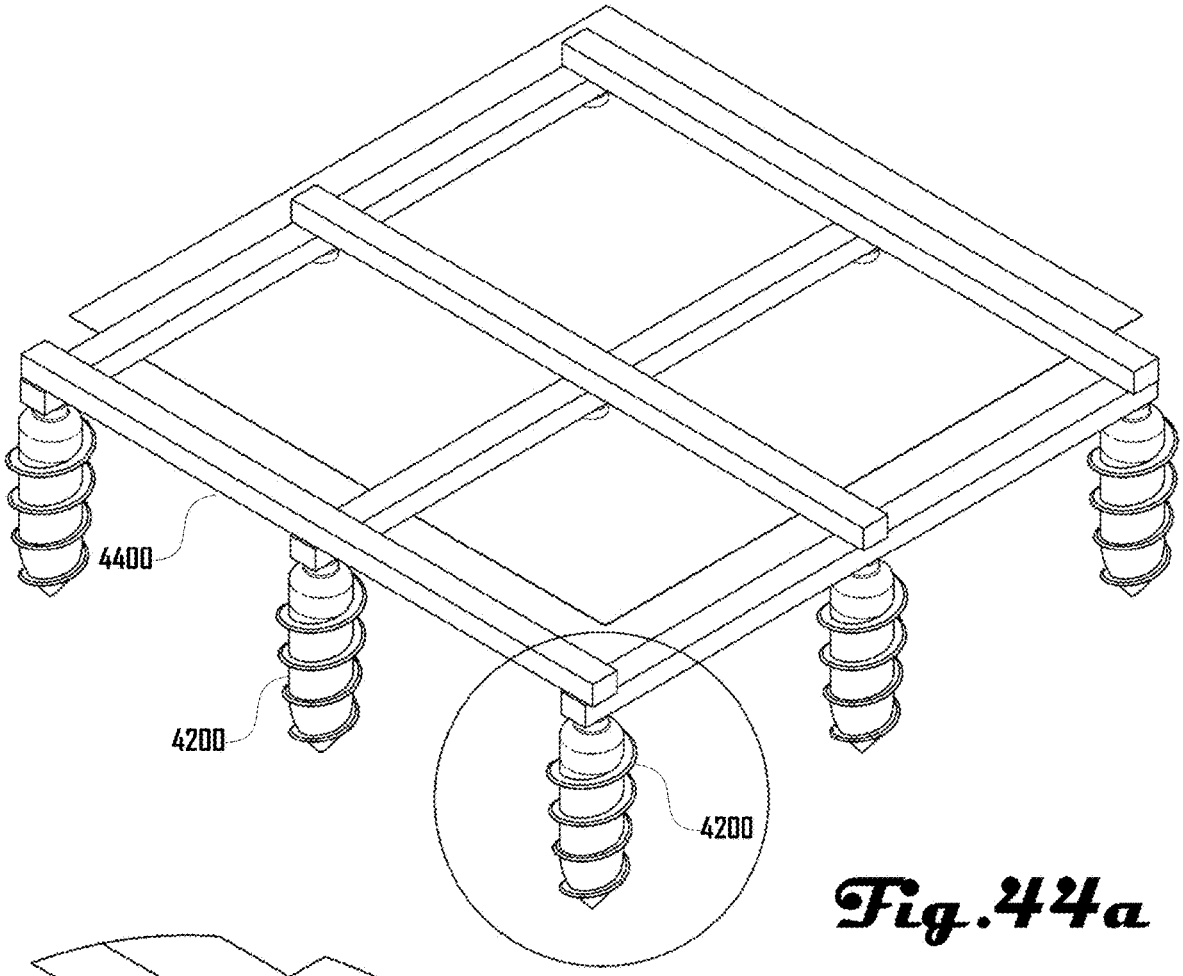
FIG. 44*a* illustrates an example embodiment of a plurality of ground screws coupled to a support architecture and FIG. 44*b* illustrates a close-up view of a ground screw of FIG. 44*a*.
Figure 44B:
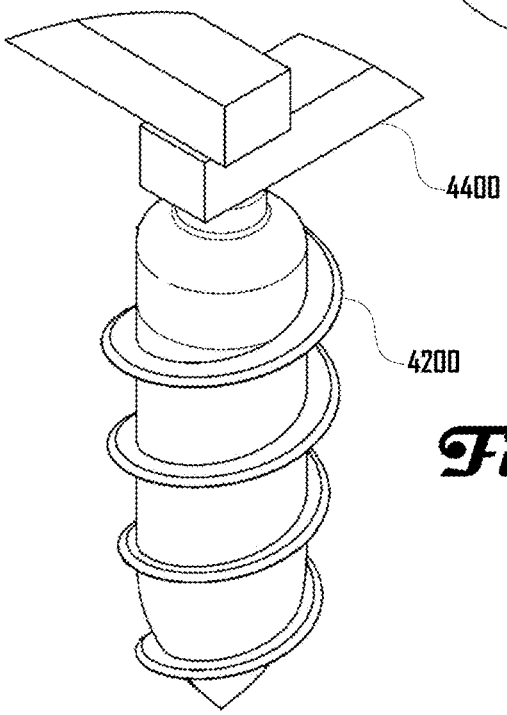
Figure 45:
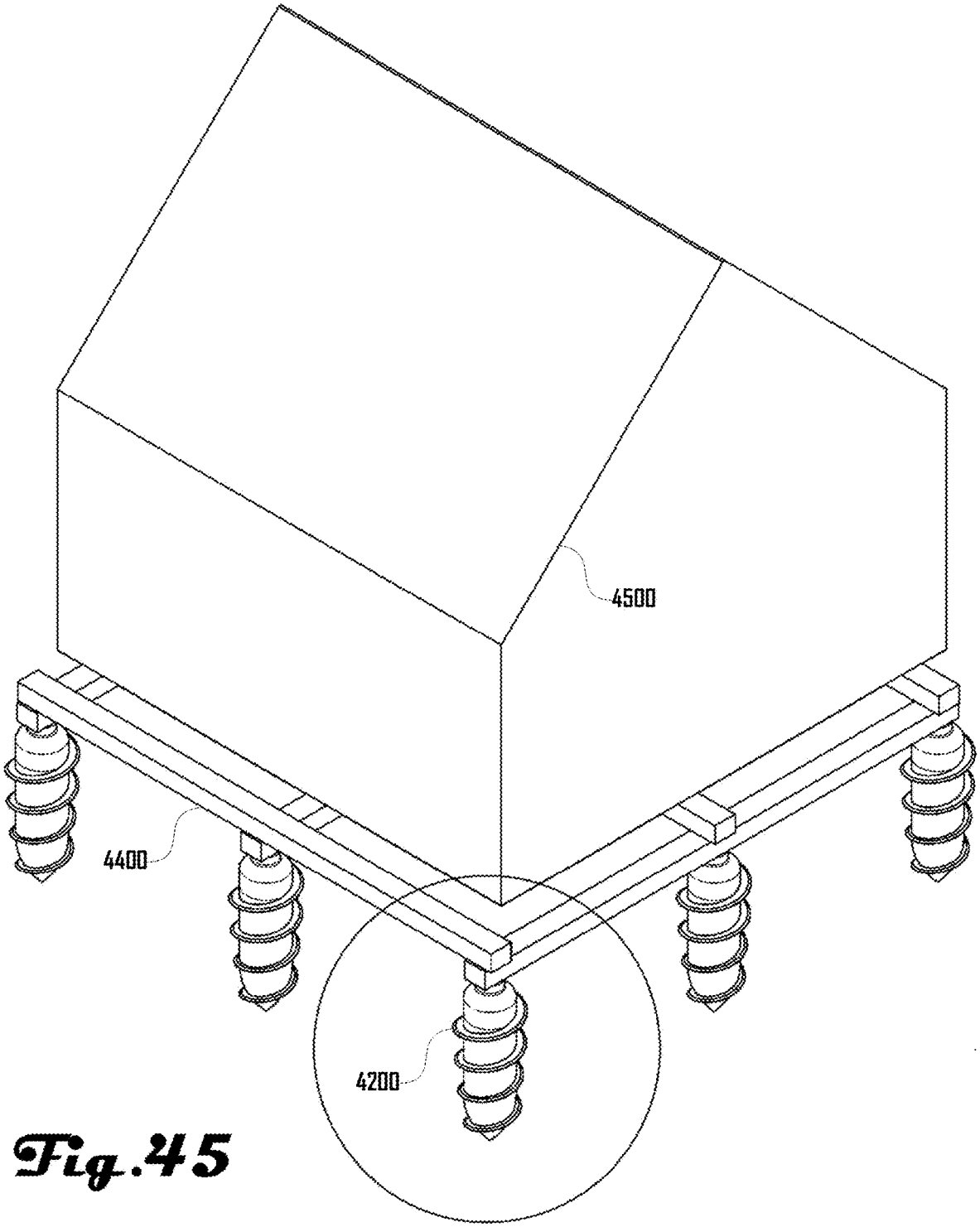
FIG. 45 illustrates an example embodiment of a plurality of ground screws coupled to a support architecture supporting a building.

In some embodiments, ground screws 4200 can be configured to act as foundational supports for a structure located on top of the ground screws 4200. For example, FIGS. 44*a*, 44*b* and 45 illustrate an example embodiment of a plurality of ground screws 4200 coupled to a support architecture 4400 that can be configured to support a building 4500 as shown in FIG. 45.

Figure 46A:
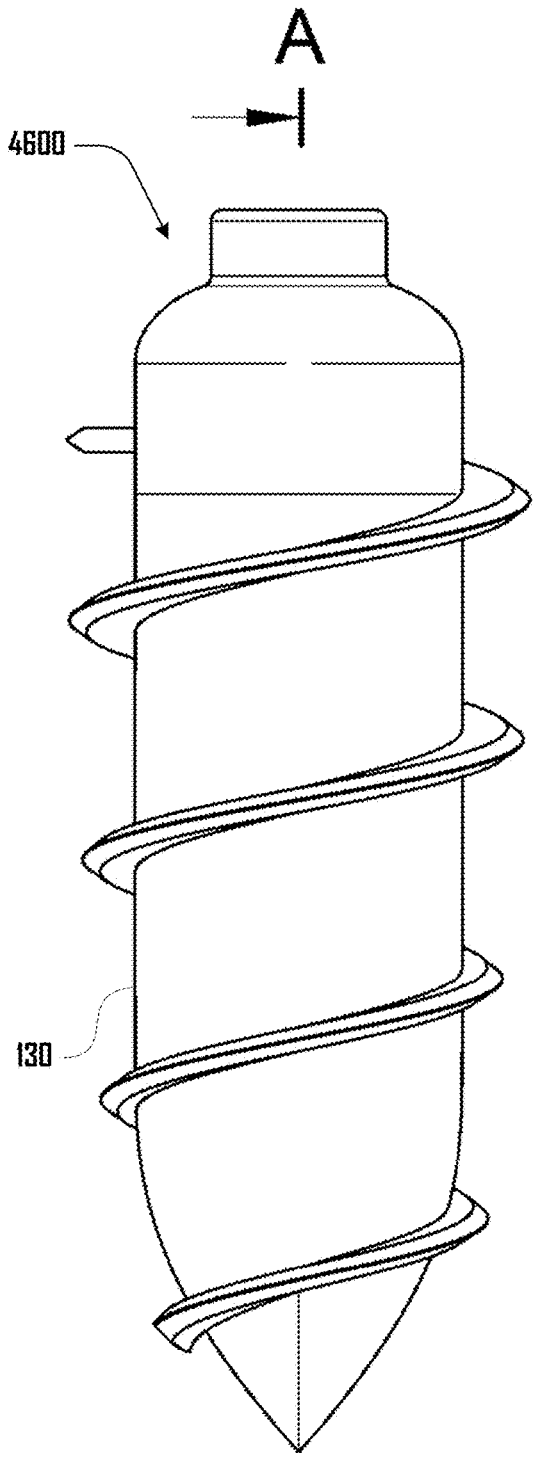
FIG. 46*a* illustrates a perspective view of an embodiment of hollowed-out ground screw that can serve as a thermal storage tank where a thermal storage medium can be disposed within a tank cavity defined by the ground screw and FIG. 46*b* illustrates a cross-sectional view of the hollowed out ground screw of FIG. 46*a*.
Figure 46B:
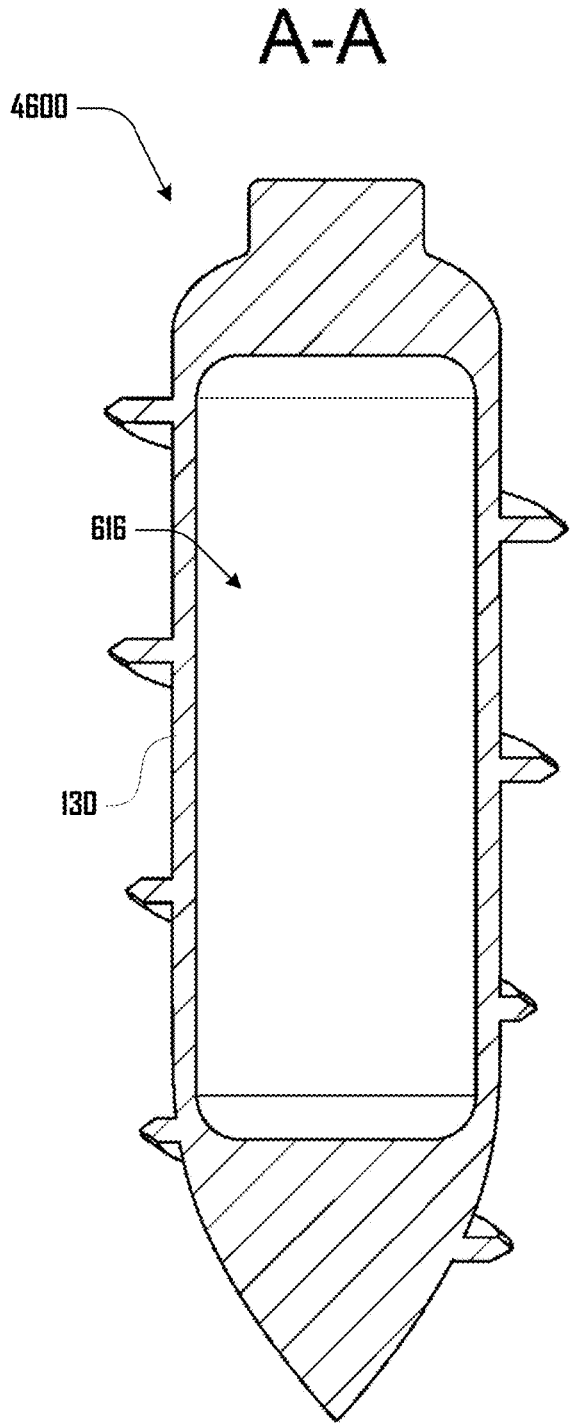

In some embodiments, soils or other substrates can provide additional thermal mass for thermal storage. For example, FIGS. 46*a* and 46*b* illustrate an embodiment of a hollowed-out ground screw 4600 that can serve as a thermal storage tank 130 where a thermal storage medium (along with other elements discussed herein) can be disposed within a tank cavity 616 defined by the ground screw 4600. As discussed herein, such a thermal storage medium can be piped to and from a home distribution system, heat pump 120, and the like.

The described embodiments are susceptible to various modifications and alternative forms, and specific examples thereof have been shown by way of example in the drawings and are herein described in detail. It should be understood, however, that the described embodiments are not to be limited to the particular forms or methods disclosed, but to the contrary, the present disclosure is to cover all modifications, equivalents, and alternatives. Additionally, elements of a given embodiment should not be construed to be applicable to only that example embodiment, and therefore elements of one example embodiment can be applicable to other embodiments. Additionally, elements that are specifically shown in example embodiments should be construed to cover embodiments that comprise, consist essentially of, or consist of such elements, or such elements can be explicitly absent from further embodiments. Accordingly, the recitation of an element being present in one example should be construed to support some embodiments where such an element is explicitly absent.

What is claimed is:

1. A method of operating a thermal storage system in a building, the method comprising:

installing the thermal storage system in the building, the thermal storage system comprising:

an electric heat pump;

a plurality of modular cuboid thermal storage tanks having the same shape and size, each of the modular cuboid thermal storage tanks comprising:

a tank body that includes four sidewalls and a base that define a tank cavity configured to hold a tank thermal storage liquid in a non-pressurized aqueous state that comprises a thermocline with a temperature difference between hot and cold layers greater than or equal to 20° C., the four sidewalls extending to define a rim that defines a plurality of gaps that define a respective first portion of a plurality of ports; and a removable tank lid that engages and creates a seal with the rim of the tank body, the tank lid comprising a plurality of notches that define a respective second portion of the plurality of ports;

a plurality of heat exchanger assemblies respectively coupled to and hanging from the rim of a respective one of the plurality of thermal storage tanks into the tank cavity of the respective thermal storage tanks, with each heat exchanger assembly comprising a helical spiral or planar spiral heat exchange coil connected to inlet and outlet lines that extend through respective port plugs disposed within one or more ports of the plurality of ports of the thermal storage tank, the plurality of heat exchanger assemblies configured to run a flow of working thermal storage liquid through the respective thermal storage tanks so that heat exchange occurs between the flow of working thermal storage liquid and the tank thermal storage liquid disposed within the tank cavities of the thermal storage tanks;

a plurality of cables that extend through existing forced-air ducting of the building that replace and provide a retrofit for a forced-air conditioning system associated with the existing forced-air ducting of the building, the cables extending through the existing forced-air ducting of the building to a plurality of separate rooms of the building to one or more forced-air receptacles in the separate rooms of the building, the plurality of cables each comprising a supply tube and a return tube that introduce a flow of the working thermal storage liquid to the plurality of separate rooms;

a plurality of heat exchange elements disposed within the plurality of separate rooms, the plurality of heat exchange elements configured to receive the flow of the working thermal storage liquid from the plurality of cables so that heat exchange occurs between the flow of the working thermal storage liquid and environments of the respective rooms of the building;

a set of plumbing that operably connects the electric heat pump, the plurality of heat exchanger assemblies, and the plurality of cables such that the electric heat pump can generate thermal heat in the working thermal storage liquid; and a computer device that at least automates operation of the electric heat pump and the flow of working thermal storage liquid, extending the plurality of cables through the existing forced-air ducting of the building that replace and provide a retrofit for a forced-air conditioning system associated with the existing forced-air ducting of the building, the cables being extending through the existing forced-air ducting of the building to the plurality of separate rooms of the building to the one or more forced-air receptacles in the separate rooms of the building;

installing the plurality of heat exchanger assemblies in a respective one of the plurality of thermal storage tanks by hanging the plurality of heat exchanger assemblies from the rim of the respective one of the plurality of thermal storage tanks into the tank cavity of the respective thermal storage tanks, the hanging including coupling the respective exchanger assembly from the rim of the respective one of the plurality of thermal storage tanks;

introducing a tank thermal storage liquid into the respective tank cavities of the plurality of modular cuboid thermal storage tanks;

generating in the tank thermal storage liquid in the respective tank cavities of the plurality of modular cuboid thermal storage tanks, while in a non-pressurized aqueous state, a respective thermocline in the tank thermal storage liquid with a temperature difference between hot and cold layers greater than or equal to 20° C.;

run a flow of working thermal storage liquid through the respective thermal storage tanks so that heat exchange occurs between the flow of working thermal storage liquid and the tank thermal storage liquid disposed within the tank cavities of the thermal storage tanks; and introducing a flow of the working thermal storage liquid to the plurality of separate rooms via the respective supply tube of the plurality of cables.

2. The method of claim 1, wherein the heat exchange coils of the plurality of heat exchange assemblies comprise one of a corrugated helical spiral coil and a corrugated planar spiral coil.

3. The method of claim 1, wherein the plurality of thermal storage tanks comprise an internal portion made of formed metal and an external portion made of a polymer, with the internal and external portions coupled at a joint about the rim of the tank body and defining an insulation cavity in at least the sidewalls and base of the thermal storage tanks.

4. The method of claim 1, wherein the plurality of modular cuboid thermal storage tanks are grouped together engaging each other and a wall of the building in a two-dimensional group comprising a set of a plurality of thermal storage tanks disposed in at least one row and a plurality of stacked groups of tanks defining one or more columns of tanks.

5. The method of claim 1, wherein the thermal storage tanks further comprise a respective electric resistance heat unit with heating coil extending into the tank cavity of the thermal storage tank, with the heating coil connected to power lines that extend through one or more port plugs disposed within one or more port of the thermal storage tank, the electric resistance heat units configured to be controlled by the computer device to generate thermal heat in the tank thermal storage liquid disposed in the tank cavities of the thermal storage tanks.

6. The method of claim 1, wherein the plurality of heat exchange elements disposed within the plurality of separate rooms are embodied in one of a radiator, a rug, a table and a couch.

7. A method of operating a thermal storage system a building, the method comprising:

installing the thermal storage system in the building, the thermal storage system comprising:

an electric heat pump;

a plurality of modular thermal storage tanks having the same shape and size, each of the modular thermal storage tanks comprising:

a tank body that includes four sidewalls and a base that define a tank cavity that holds a tank thermal storage liquid, the sidewalls extending to define a rim that defines a plurality of gaps that define a respective first portion of a plurality of ports; and a removable tank lid that engages and creates a seal with the rim of the tank body, the removable tank lid comprising a plurality of notches that define a respective second portion of the plurality of ports;

a plurality of heat exchanger assemblies respectively installed in one of the plurality of thermal storage tanks in the tank cavity of the respective thermal storage tanks, with each heat exchanger assembly comprising a heat exchange coil connected to inlet and outlet lines that extend through respective port plugs disposed within ports of the thermal storage tank, the plurality of heat exchanger assemblies configured to run a flow of working thermal storage liquid through the respective thermal storage tanks so that heat exchange occurs between the flow of working thermal storage liquid and the tank thermal storage liquid disposed within the tank cavities of the thermal storage tanks;

one or more cables that extend through the building to one or more rooms of the building;

one or more heat exchange elements disposed within the one or more rooms, the one or more heat exchange elements configured to receive a flow of the working thermal storage liquid from the one or more cables so that heat exchange occurs between the flow of the working thermal storage liquid and an environment of the one or more rooms of the building;

a set of plumbing that operably connects the electric heat pump, the plurality of heat exchanger assemblies, and the one or more cables such that the electric heat pump can generate thermal heat in the working thermal storage liquid; and a computer device that at least automates operation of the electric heat pump and the flow of working thermal storage liquid, extending the one or more cables through the building to the one or more rooms of the building;

installing the plurality of heat exchanger assemblies respectively in one of the plurality of thermal storage tanks in the tank cavity of the respective thermal storage tanks;

introducing the tank thermal storage liquid into the respective tank cavities of the plurality of modular thermal storage tanks; and running a flow of working thermal storage liquid through the respective thermal storage tanks so that heat exchange occurs between the flow of working thermal storage liquid and the tank thermal storage liquid disposed within the tank cavities of the thermal storage tanks.

8. The method of claim 7, wherein the modular thermal storage tanks are cuboid in shape.

9. The method of claim 7, wherein the tank thermal storage liquid is stored in the tank cavity in a non-pressurized aqueous state that comprises a thermocline.

10. The method of claim 7, wherein the one or more cables extend through existing forced-air ducting of the building that replace and provide a retrofit for a forced-air conditioning system associated with the existing forced-air ducting of the building, the one or more cables extending through the existing forced-air ducting of the building to the one or more rooms of the building to one or more forced-air receptacles in the one or more rooms of the building, the one or more cables each comprising a supply tube and a return tube that introduce a flow of the working thermal storage liquid to the one or more rooms.

11. The method of claim 7, wherein the plurality of modular thermal storage tanks are grouped together engaging each other and a wall of the building in a two-dimensional group comprising a set of a plurality of thermal storage tanks disposed in at least one row and a plurality of stacked groups of tanks defining one or more columns of tanks.

12. A method of operating a thermal storage system in a building, the method comprising:

installing the thermal storage system in the building, the thermal storage system comprising:

one or more thermal storage tanks that include a tank body that defines a tank cavity configured to hold a tank thermal storage medium, wherein the tank thermal storage medium is stored in the tank cavity in a non-pressurized aqueous state that comprises a thermocline with a temperature difference between hot and cold layers greater than or equal to 20° C., the tank body further defining one or more ports;

a heat exchanger assembly disposed in the tank cavity of the one or more thermal storage tanks and comprising a heat exchange coil connected to inlet and outlet lines that extend through at least one of the one or more ports of the thermal storage tank, the heat exchanger assembly configured to run a flow of working thermal storage medium through the one or more thermal storage tanks so that heat exchange occurs between the flow of working thermal storage medium and the tank thermal storage medium disposed within the tank cavities of the thermal storage tanks;

one or more cables that extend through the building to one or more rooms of the building; and one or more heat exchange elements disposed within the one or more rooms, the one or more heat exchange elements configured to receive a flow of the working thermal storage medium from the one or more cables so that heat exchange occurs between the flow of the working thermal storage medium and an environment of the one or more rooms of the building, extending the one or more cables through the building to the one or more rooms of the building.

13. The method of claim 12, wherein the thermal storage system further comprises:

an electric heat pump; and a set of plumbing that operably connects the electric heat pump, the one or more heat exchanger assemblies, and the one or more cables such that the electric heat pump can generate thermal heat in the working thermal storage medium.

14. The method of claim 12, wherein the thermal storage system further comprises a computer device that controls and automates at least a portion of operation of the thermal storage system.

15. The method of claim 12, wherein the thermal storage tanks are modular and cuboid in shape including four sidewalls and a base.

16. The method of claim 12, wherein the tank body further defines a rim and the thermal storage tank further comprises a tank lid that engages with the rim of the tank body to define a plurality of ports.

17. The method of claim 12, wherein the one or more cables extend through existing forced-air ducting of the building that replace and provide a retrofit for a forced-air conditioning system associated with the existing forced-air ducting of the building, the one or more cables extending through the existing forced-air ducting of the building to the one or more rooms of the building to one or more forced-air receptacles in the one or more rooms of the building, the one or more cables each comprising a supply tube and a return tube that introduce a flow of the working thermal storage medium to the one or more rooms.

18. The method of claim 12, wherein the thermal storage system comprises a plurality of modular thermal storage tanks grouped together engaging each other in a two-dimensional group comprising a set of a plurality of thermal storage tanks disposed in at least one row and a plurality of stacked groups of tanks defining one or more columns of tanks.

19. The method of claim 12, wherein the one or more heat exchange elements disposed within the one or more rooms are embodied in at least one of a radiator, a rug, a table and a couch.

* * * * *